US012498206B1

(12) United States Patent
Citron

(10) Patent No.: US 12,498,206 B1
(45) Date of Patent: Dec. 16, 2025

(54) PRIMER PLACEMENT WITH SHUTTLE

(71) Applicant: Mannis Operations LLC, Jupiter, FL (US)

(72) Inventor: Jeffrey Citron, Jupiter, FL (US)

(73) Assignee: Mannis Operations LLC, Jupiter, FL (US)

( * ) Notice: Subject to any disclaimer, the term of this patent is extended or adjusted under 35 U.S.C. 154(b) by 0 days.

(21) Appl. No.: 19/290,161

(22) Filed: Aug. 4, 2025

(51) Int. Cl.
*F42B 33/00* (2006.01)
*F42B 33/04* (2006.01)
*F42C 19/08* (2006.01)

(52) U.S. Cl.
CPC ..... *F42B 33/04* (2013.01); *F42B 33/001* (2013.01); *F42C 19/0823* (2013.01)

(58) Field of Classification Search
CPC ..... F42B 33/00; F42B 33/001; F42B 33/04; F42C 19/08; F42C 19/0823
USPC ..... 86/19.8, 36
See application file for complete search history.

(56) References Cited

U.S. PATENT DOCUMENTS 3,143,919 A 8/1964 Estes
3,205,762 A * 9/1965 Parke ..... F42B 33/04 86/36
3,363,296 A 1/1968 Duffield
3,440,923 A 4/1969 Purdie
3,705,515 A 12/1972 Lee
4,590,841 A * 5/1986 Davis ..... F42B 33/04 86/36
4,723,472 A 2/1988 Lee
4,836,078 A 6/1989 Lee
5,635,661 A 6/1997 Tuftee
5,649,465 A 7/1997 Beebe
6,050,169 A 4/2000 Voros
6,397,720 B1 6/2002 Fox et al.
9,303,965 B1 * 4/2016 Dykstra ..... F42B 33/04
9,395,155 B1 7/2016 Bockmon
9,464,871 B2 10/2016 Bay
9,574,860 B1 2/2017 Mobley
10,794,676 B1 10/2020 Aerni
11,067,375 B1 7/2021 Helgason
11,333,473 B2 5/2022 Carper et al.
11,713,950 B1 * 8/2023 Reed ..... F42B 33/04 86/23
2006/0177104 A1 8/2006 Prokoski
2011/0114725 A1 5/2011 Young
2012/0160081 A1 6/2012 Beebe
2014/0110482 A1 4/2014 Bay
2016/0084617 A1 3/2016 Lyren
2017/0138712 A1 5/2017 Teig et al.
(Continued)

FOREIGN PATENT DOCUMENTS

WO 9736701 A1 10/1997
WO 2019161053 A2 8/2019
WO 2023057040 A1 4/2023

*Primary Examiner* — James S Bergin
(74) *Attorney, Agent, or Firm* — Davis Wright Tremaine LLP

(57) ABSTRACT

An apparatus, system, computer-readable medium, process, or combination thereof to seat a primer in a projectile casing. For example, a primer may be seated according to a depth indexed from a bottom of a projectile casing. A user, programmer, or control can seat, place, adjust, or otherwise determine a depth to seat a primer from a projectile casing bottom. A method to index a depth to seat a primer from a base of a projectile casing.

30 Claims, 66 Drawing Sheets

(56) References Cited

U.S. PATENT DOCUMENTS

| | | | |
|---|---|---|---|
| 2017/0205197 | A1 | 7/2017 | Sammut et al. |
| 2020/0056870 | A1 | 2/2020 | Carper et al. |
| 2022/0349676 | A1 | 11/2022 | Maguire |

* cited by examiner

PRIMER PLACEMENT WITH SHUTTLE

CROSS REFERENCE TO RELATED APPLICATIONS

This application incorporates by reference for all purposes the full disclosure of U.S. patent application Ser. No. 18/909,053, entitled "CLEANING A PROJECTILE CASING," filed Oct. 8, 2024, and U.S. patent application Ser. No. 18/909,064, entitled "SEATING OF A PRIMER," filed Oct. 8, 2024.

TECHNICAL FIELD

An apparatus, system, device, computer-readable medium, and/or process to place a primer in a projectile casing, such as to index a depth of the placement from a base of the projectile casing. For example, consistently seating a primer to a defined depth relative to the base of the projectile casing can improve ignition reliability and pressure consistency, resulting in more predictable projectile performance for the marksman compared to casings with irregular primer seating.

BACKGROUND

Ballistics includes the science of projectiles and firearms, such as the motion of objects (e.g., rounds of projectiles) that are driven forward. For example, ballistics includes the study of effects of firing a round for a projectile, where the round comprises a cartridge including a projectile casing, the projectile (e.g., bullet, slug, or shot), and a primer to ignite powder to fire the projectile. There are many factors to consider when a firearm prepares a projectile to be fired and/or fires a projectile according to ballistics. For example, the exit speed of the bullet from a barrel, the shape of the bullet, the size of the bullet, and the material of the bullet can affect the round's trajectory. Also, properties of the barrel such as length, material, width, and design can affect the firing of a round, impacting the result. These are various factors a marksman can consider while preparing a cartridge to be fired. However, a marksman can still consider these factors and have performance affected (e.g., missing a target, having less accuracy and/or consistency), as there are many factors to consider when preparing a projectile to be fired and/or firing a projectile. Accordingly, there exists a need to improve preparing a projectile to be fired and/or firing a round of a projectile using a primer.

DETAILED DESCRIPTION

Figure 1A:
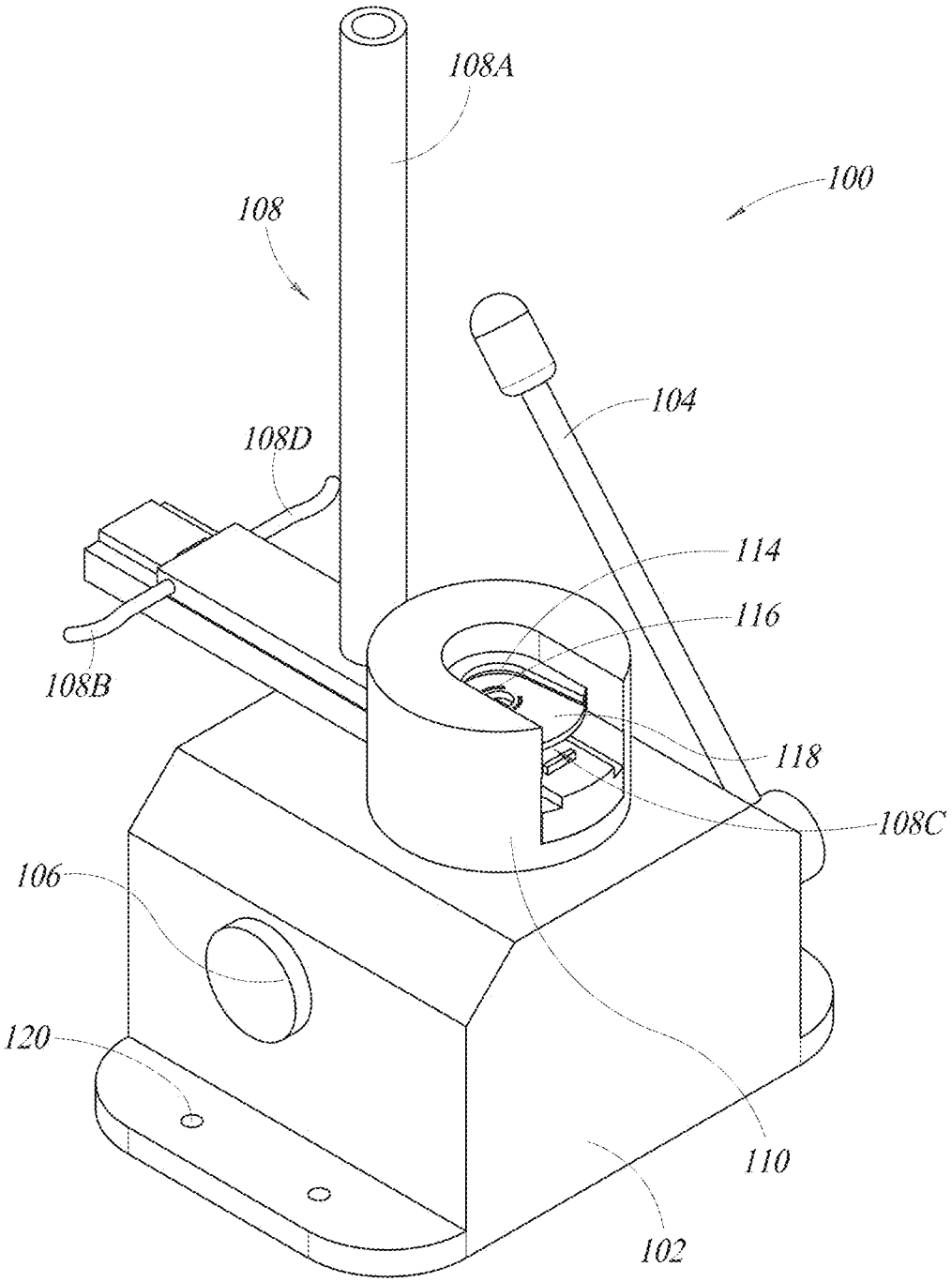
FIGS. 1A-1D illustrate a schematic view of a system to place a primer in a primer pocket of a projectile casing by indexing from a base of the projectile casing, in accordance with at least one embodiment.

A marksman may seek to place a primer at a depth indexed from the bottom of a casing. Further, a marksman may further wish to utilize a system that includes a primer rod component capable of being interchanged with a second primer rod. As an example, a second primer rod may be a new primer rod when a first has become worn and/or a primer rod of a length to correspond with a depth desired to seat a primer. Incorrect placement of a primer within a primer pocket of a projectile casing (e.g., bullet) can affect the performance and reliability of ammunition. If the primer is positioned too far out (e.g., it sticks out from a base of a bullet casing), it can cause the firing pin to strike with insufficient velocity, potentially resulting in a misfire or a weak ignition. Additionally, an improperly seated primer may slide forward when struck, leading to inconsistent ignition and suboptimal ballistic performance. Conversely, if the primer is seated too deeply within the pocket, the firing pin may not reach it effectively, causing a failure to ignite. Also, some marksmen may prefer to place a primer flush with a projectile casing. Overall, a marksman wants to be able to consistently place a primer in a primer pocket of a projectile casing to get consistent results when firing, even if projectile casings have varying sizes, shapes, and diameters, including varying primer pocket dimensions (e.g., due to firing a projectile casing) that can affect how a primer is seated in a primer pocket.

There are many considerations when choosing a method of setting (e.g., seating) a primer in a projectile casing, which if used may ignite powder to fire a projectile. As an example, a projectile casing has a chamber (e.g., primer pocket) within which a primer is placed. However, a preferred distance (e.g., depth) of a primer to be placed within a projectile casing may vary based, at least in part, on the type of projectile casing and/or a type of primer. As an example, a type (e.g., size, manufacturer, diameter, shape) of projectile casing may be designed specifically to a type of projectile (e.g., bullet, slug, and/or shot), an amount and/or type of powder, and/or a type of firearm to fire a projectile. Different types of projectile casings may then receive different types of primers, such as primers with different sizes (e.g., depth, circumference, length, diameter, and/or other measurements relative to a type of projectile casing and/or projectile), types of propellant charges (e.g., combustion and/or electric), weight, pressure, and/or an amount of powder designed to ignite in a cartridge (e.g., magnum).

There are systems that place the primer at a particular depth within the primer pocket. For example, a marksman can use calipers or a depth gauge to measure and seat a primer within a primer pocket. However, this measurement can vary depending on the thickness, shape, or dimensions of the projectile casing (e.g., bullet casing), as these factors influence the pocket depth and the amount of force required to seat the primer correctly. Also, such techniques to set the depth of a primer are based on the length of a primer setting rod that then extends into a projectile casing, which may be changed independently from the base of the projectile casing, causing irregularities from the factory default. For example, the projectile casing is held in place by an extraction groove in a device for seating a primer, and then a rod inserts the primer into the projectile casing. Also, there may be irregularities (e.g., manufacturing and/or due to their previous use) between the brass (e.g., depth of projectile casing base and/or projectile casing groove) of two projectile casings of the same type that would cause the depth of the primer to be placed differently for the same type of cartridge.

However, in preparation for loading a projectile into a case, a projectile casing may need a primer seated at a desired depth (e.g., depth selected within a manufacturer-recommended range). If any irregularities are present, such as due to unwanted debris or misshaped brass with an extraction groove, a primer seating rod if not measured (e.g., indexed) directly from a projectile casing base may seat primers at an irregular depth. As an example, a marksman may want one or more primers inserted at a desired depth measured directly from a projectile casing base. As another example, if irregularities (e.g., scratches, dents, and/or inconsistencies) are present in the brass of the projectile casing, a depth a primer rod inserts a primer may vary if not ensuring a measurement begins at the base of a projectile casing. A depth where a primer is seated may be selected and then consistently applied across a type of cartridge, such that each is placed at a consistent depth measured from a projectile casing base.

A type of primer may correspond to a type of projectile casing and/or projectile, such as with factory recommendations of a distance to be seated into a projectile casing. As an example, this is given as a range of the depth with which the primer is recommended to be seated into the projectile casing. For example, a primer should be seated approximately 0.003 inches to 0.007 inches from flush with the case head (e.g., bottom of casing opposite from neck or shoulder of casing). This length may help prevent seating a primer's depth too far or too little. To place a primer within a projectile casing, a rod may push the primer at a depth corresponding to the length of the rod. If a primer is seated at too low of a depth, the primer may protrude (e.g., extend) beyond the projectile casing and/or not ignite the powder of the cartridge as intended. If a primer is seated at too high of a depth, there may not be sufficient room for igniting the powder (e.g., oxygen for combustion), and/or the primer may be crushed too much, accidentally setting off the primer. Within this factory range, the depth of the primer placement may be tailored to the type of components of a cartridge to fire a projectile (e.g., powder, projectile casing, projectile type, and/or size). A marksman measuring the depth of a primer consistently may then isolate and/or control this as a variable, which may improve consistency when firing a projectile.

To provide accurate and consistent placement of a primer (e.g., seating of a primer) in a projectile casing, the disclosed technology includes an apparatus, system, device, computer-readable medium, and/or process to measure a depth of seating a primer in a projectile casing, such as to index a measurement of depth to seat a primer from a casing base. For example, a primer with consistent placement (e.g., seating) can result in a marksman having a more predictable firing of a projectile than a projectile with inconsistent primer placement. In at least one embodiment, because the primer placement is indexed (e.g., measured, aligned) from the base of the projectile casing, its placement in the primer pocket is more consistent than other methods that insert a primer using a predetermined force and/or distance. This approach reduces the likelihood of misfires or inconsistent ignition by ensuring that the primer is seated at an optimal depth relative to the casing's base, accommodating variations in casing thickness, shape, or material. Further, this approach of using an index rod to index (e.g., by coming into contact) a primer's depth from the base of a casing may include using a system with the capability of interchanging one or more primer rods of one or more varying dimensions. Consequently, the disclosed technology enhances overall projectile performance and reliability, providing marksmen with more predictable and accurate firing outcomes.

The disclosed technology here can include indexing a depth to seat a primer from a casing base. For example, a projectile casing may be held in a device, such that a base of a projectile casing is in contact with one or more prongs (e.g., of an outer cylinder) and a primer rod (e.g., inner cylinder) sets the primer at a depth corresponding to a measurement from the base of a projectile casing (e.g., indexing from a base of a casing) because the primer rod extends beyond the prongs in a longitudinal direction but is prevented from moving further once the one or more prongs contact the bottom of the casing.

While measurements of projectiles and projectile casings are provided in this application in inches, they can also be provided in millimeters or another measuring system. Also, the technology disclosed here can be applied to bullets of different sizes, shapes, and designs, as well as to projectile casings with different sizes, shapes, and designs (e.g., an operator would change the primer, a depth to insert a primer, and/or components of the projectile casing).

An apparatus, system, computer-readable medium, computer-implemented method, and/or process to place a primer in a primer pocket of a projectile casing, where the placement is indexed from the base of the projectile casing. In at least one embodiment, a method includes setting a primer in a projectile casing. This process starts by providing a projectile casing that includes a base and a primer pocket. The primer pocket is designed to hold a primer and has a certain depth, e.g., a first depth that is measured by a marksman or provided by a manufacturer. The base of the casing is located opposite the neck, where the bullet would be seated. The primer is then aligned, e.g., by a primer aligner, with the primer pocket. Using a positioning mechanism (e.g., outer and inner cylinders as shown in the FIGS. 1A-16), the system indexes the distance from the base of the projectile casing to a specific depth within the primer pocket. For example, a positioning mechanism can include an inner cylinder that is free-floating and an outer cylinder that is secured to a projectile casing holder (e.g., by screw threads), where a projectile casing has a bottom that sits flush with the outer cylinder and the outer cylinder has a surface that is wider than at least a portion of the primer pocket. A marksman or machine can push the inner cylinder up (inside the outer cylinder) such that the primer is inserted to a particular, second depth, and the outer cylinder prevents the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, ensuring it is properly seated without going too deep. The mechanism includes a blocking component that prevents the primer from moving past this desired depth.

In at least one embodiment, the disclosed technology can be implemented through a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, the disclosed technology for positioning a primer in a projectile casing includes several components. For example, a system can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the primer pocket. This mechanism is equipped with a blocking component to prevent the primer from being pressed too far. Additionally, a lever is attached to the positioning mechanism to move it, ensuring that the primer is pressed in place correctly. A depth to set a primer may be adjusted using adjustment mechanisms and/or by interchanging one or more primer rods of one or more differing dimensions. After the primer is set, a casing extractor may remove the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology.

In at least one embodiment, the disclosed technology includes a method of indexing (e.g., measuring) the depth to seat a primer in a projectile casing (e.g., projectile case) from a base of a projectile casing. The method can be performed by a human, machine, or a combination thereof. The method can at least include to insert a casing, insert a primer according to a position indexing from the bottom of the casing using one or more prongs and a primer, stop inserting a primer when the one or more prongs are in contact with a bottom of a casing, unload a casing with a seated primer, and/or combinations thereof. As an example, the method can at least include adjusting the length of a primer rod (e.g., first cylinder) to a type of projectile casing (e.g., or interchanging a primer rod for a new primer rod), inserting a primer according to an adjusted length, stopping insertion of a primer at length indexed from a base of a casing, obtaining a projectile casing with primer seated at an adjusted length measured from the projectile casing's base, and/or combinations thereof. The disclosed technology can be used for cartridges designed for different types of projectiles, such as those fired by guns (e.g., of a particular caliber or gauge), though the disclosed technology may also be used for other guns, such as projectile cartridges for artillery. A type of gun can impact ballistics associated with firing a bullet and may require differing amounts of gunpowder. A gun can be any type of firearm used by an individual, such as a handgun (e.g., pistol), shotgun (e.g., slugs or shot), or rifle (semi-automatic or automatic). A gun may also include crew-served equipment to fire a projectile from a barrel, such as artillery or naval guns. In some embodiments, the disclosed technology can be integrated with cartridges for guns (e.g., rifles) used for precision shooting (e.g., long range). Example embodiments are described herein with reference to the accompanying drawings.

A primer positioning system can include components to cause a primer to be inserted into a primer pocket using a base of a projectile case as a starting point (e.g., an index). A positioning mechanism can include a primer rod (e.g., an inner cylinder component) and one or more prongs (e.g., outer cylinder component), a set screw, a knob, and/or mechanisms as shown in FIGS. 1A-17.

A primer can be seated in a primer pocket of a projectile casing using a primer rod that includes a central rod portion and at least one prong. The central rod can extend farther in the insertion direction (e.g., longitudinal direction) than the prong or prongs. This height difference between the central rod and the prongs can define how far the primer is inserted into the pocket. When the prong makes contact with the base of the projectile casing, it can stop further advancement of the central rod, allowing the primer to be seated to a controlled depth that is indexed from the base of the casing. A resulting primer depth can be configured to allow for a desired amount of primer crush (e.g., depending on performance needs or loader preferences).

The prong or prongs can be wider than the primer pocket and positioned in various ways relative to the central rod. For example, one, two, or more prongs can be used, and they can be spaced on opposite sides, circumferentially around, or asymmetrically with respect to the central rod. The prongs can be straight, curved, jagged, or include combinations of such shapes, and can be integrally formed with the central rod or fixed to a surrounding collar. In some implementations, the central rod and prongs form a single, unitary body, while in others, the central rod is slidable relative to the prongs or interchangeable to allow for seating primers at different depths.

The primer rod can be operated manually or with mechanical assistance (e.g., for automation), such as through a lever, spring mechanism, or press. An adjustment mechanism, such as a threaded stop or dial, can be included to fine-tune how far the central rod projects relative to the prongs. The device holding the projectile casing can include a fixed reference plane to keep the base of the casing stationary during primer insertion. In some embodiments, a shuttle or sliding component can receive the primer, move it beneath the casing, and provide slots to accommodate both the prongs and the central rod during insertion.

Once seated, the casing with the inserted primer can be transferred to a storage or loading station for further processing. The system and method described here can accommodate varying primer types, casing shapes, and manufacturing tolerances while improving the consistency and control of primer depth relative to the casing base.

The primer seating structure can include a primer rod, which may also be referred to as a seating rod, insertion rod, or insertion member. The primer rod can have a central portion—also described herein as a central rod, axial member, or middle rod—that is configured to press against a primer and drive it into a primer pocket of a projectile casing. Surrounding the central portion, one or more peripheral rod portions—also referred to as prongs, indexing extensions, outer projections, or mechanical stops—can extend in the same general insertion direction. The peripheral portions may be connected to a collar or shared base and can be straight, curved, angled, or jagged. These prongs can contact the base of the casing to limit how far the central rod travels (e.g., moves, advances, crushes the primer), thereby indexing the primer depth relative to the casing base.

To align the rod with the casing and/or to guide the prongs and central rod during insertion, a shuttle, carrier, or guide component can be used. This shuttle can include slots, recesses, openings, or prong-receiving channels (also called prong holes or guide paths) that are shaped to receive and direct the prongs and central rod toward the primer pocket. In some cases, protrusions or raised features on the rod or shuttle can help position components for proper seating alignment. Any reference to prongs, indexing members, or outer stops should be understood to encompass various geometric configurations and naming conventions unless otherwise expressly limited.

In some embodiments, the central portion of the primer rod can have a diameter that is smaller than the diameter of the primer pocket of a projectile casing, allowing it to extend into the pocket and push the primer into place. The central rod can be narrow enough to avoid interference with the pocket walls but wide enough to provide stable axial support for the primer during insertion, minimizing wobble or lateral misalignment. For example, the primer pocket may have a diameter of approximately 0.175 inches, while the central rod may have a diameter between 0.160 inches and 0.172 inches, providing a slight clearance fit. The rod may also include a slight taper or cylindrical gripping section that centers and temporarily supports the primer during upward motion. In contrast, one or more prongs positioned adjacent the central rod can span a combined lateral width greater than the primer pocket—e.g., a total width of 0.190 inches or more—ensuring that the prongs contact the base of the projectile casing rather than entering the pocket. This geometry allows the prongs to act as mechanical stops, controlling the seating depth of the primer as the central rod continues to apply pressure.

In some embodiments, the shuttle or shuttle plate used to position the primer beneath the casing can include one or more receiving holes or slots configured to interact with both the primer and the primer rod. A receiving hole in the shuttle can include beveled or chamfered upper edges designed to guide the primer into proper alignment as it is loaded into the shuttle. The beveled surface can prevent the primer from falling entirely through the hole while allowing the primer to rest in a stable, centered position. The diameter of the receiving hole can be narrower than the diameter of the primer flange, thereby supporting the primer during upward insertion. At the same time, the receiving hole can be wide enough to permit the central portion of the primer rod—such as a cylindrical seating rod with a diameter of 0.160 to 0.172 inches—to pass through and engage the primer from below, which can allow the shuttle to hold the primer in alignment while enabling the central rod to advance through the hole and push the primer into the primer pocket without interference from the shuttle structure.

The figures are not necessarily drawn to scale. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and to be open-ended in that an item or items following any one of these words is not meant to be an exhaustive listing of such item or items or meant to be limited to only the listed item or items. It should also be noted that, as used herein and in the appended claims, the singular forms "a," "an," and "the" include plural references unless the context clearly dictates otherwise.

FIGS. 1A-1D illustrate a schematic view of a system to place a primer in a primer pocket of a projectile casing by indexing from a base of a projectile casing, in accordance with at least one embodiment. In at least one embodiment, system 100 includes system base 102, lever 104, adjustment knob 106, primer queue component 108 (e.g., primer queue 108A, primer lever 108B and D, primer channel 108C), primer seating component 110, attachment grooves 114, inner cylinder (e.g., primer rod) recess, prong holes 116, outer cylinder 118, one or more holes 120 to secure base 102, and/or combinations thereof.

System 100 may include a mechanism for indexing a depth to seat a primer from the base of a projectile casing using one or more prongs. The one or more prongs (e.g., one or more prongs 220, see FIG. 2B) make contact with the projectile casing, such that the primer depth is indexed from the bottom of the casing. This design may allow for precise placement of the primer, which may improve performance and functionality of the projectile cartridge with a seated primer. Additionally, system 100 may include a primer rod that is interchangeable, such as for replacing a worn primer rod or for using a primer rod of a different length, to change a depth to seat a primer. Interchangeability of a primer rod may enhance the versatility and longevity of the device. As an example, system 100 may include a mechanism, threading, and/or knob to release or secure a primer rod, such as for replacement.

The schematic view in FIG. 1A includes an illustration of a front view for primer seating system 100. System 100 may include base 102, primer queue (e.g., staging) component 108, and/or primer seating component 110. A base 102 may include fastening means to secure base 102, such as holes 120 to be secured (e.g., to a table) via a fastener (e.g., screw). Base 102 includes or is otherwise attached to primer queue component 108, primer seating component 110, lever 104, adjustment knob 106, and/or means to use said components herein. As an example, base 102 is a housing of primer seating component 110. As another example, base 102 is a housing of primer queue (e.g., staging) component 108.

A base 102 may have a lever 104 attached, such that it may be used to operate primer seating component 110. Operating lever 104 is illustrated by one or more parts illustrated in FIGS. 2A-6B and/or 8A-C. Lever 104 in a first position may result (e.g., using one or more systems in FIGS. 1A-9E) in an inner cylinder 214 (e.g., primer rod and prongs) receding from a projectile casing and/or otherwise where a projectile casing would be placed. Lever 104 in a first position may include an inner cylinder 214 receding in an outer cylinder 118, such that a primer may be positioned, using primer queue component 108, into primer seating component 110. As an example, a lever 104 in a first position causes inner cylinder 214 (e.g., primer rod and/or one or more prongs) to recede and create inner cylinder recess and one or more prong holes 116. A lever 104 in a second position may cause inner cylinder 214 to further insert into outer cylinder 118, cause one or more prongs to proceed from outer cylinder 118 (e.g., outer material) to contact a projectile casing, and/or otherwise insert primer according to a selected depth (e.g., depth determined using adjustment knob 106). One or more prongs may protrude from an outer cylinder 118, indexing a primer's depth from contacting a projectile casing secured in system 100 using a means of attachment, such as attachment grooves 114. Grooves 114 may correspond to one or more types of a projectile casing being secured and/or be adjusted to a type of projectile casing. As an example, lever 104 causes the position of an inner cylinder 214 to recede or change position within an outer cylinder 118. In at least one embodiment, an outer cylinder 118 may be fixed or loosely secured, such as to allow lever 104 to cause inner cylinder to push outer cylinder 118 to contact projectile casing prior to inserting inner cylinder 214 (e.g., primer rod) and one or more prongs a selected depth (e.g., using adjustment knob 106 and/or using a length of a primer rod). In at least one embodiment, lever 104 includes a means of changing location of lever 104 relative to base 102, such as from a right-hand grip to left-hand grip.

Knob 106 may perform adjustments (e.g., micro-adjustments) of a depth with which a primer is inserted into a projectile casing and may include measurements corresponding to primer seating depth on a dial, such as a depth indexed from a projectile casing base. Knob 106 may be rotatably attached to base 102, controlling a depth with which a primer is inserted into a cartridge. An adjustment by knob 106 may correspond to a length that an inner cylinder 214 (primer rod) and/or one or more prongs will protrude (e.g., extend) from an outer cylinder 118, contacting a projectile casing. Knob 106 may be another means to adjust a depth with which a primer is set (e.g., seated) into a projectile casing, such as a button, electric and/or hydraulic control, dial, lever, and/or control described herein. Knob 106 may adjust a depth with which a primer seating component 110 inserts a primer into a projectile casing. In another embodiment, a knob 106 may be a release mechanism of a primer rod, such that a primer rod may be interchanged with a second primer rod (e.g., new primer rod and/or primer rod of new length).

Figure 1B:
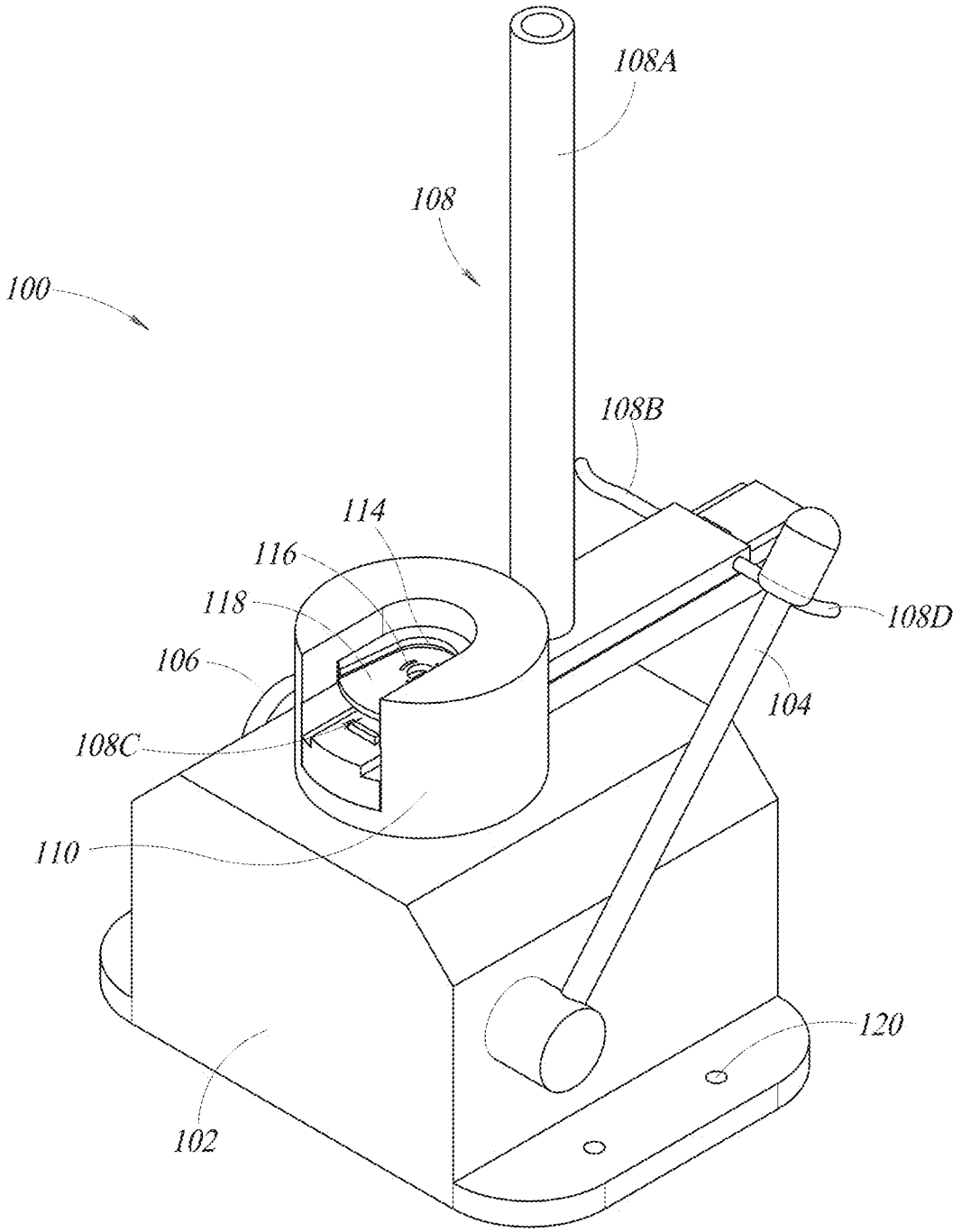

The schematic view in FIG. 1B includes an illustration of a front view for primer seating system 100, according to at least one embodiment. In at least one embodiment, system 100 includes primer queue component 108. A primer queue component 108 may place (e.g., set) a primer in primer seating component 110. A primer queue component 108 may include primer queue 108A, primer lever 108B and D, and/or primer channel 108C. Primer lever 108B and 108D can be connected or separated, and primer levers can be referred to as "a handle" or "handles" for moving the primer by moving the shuttle that is connected to the handles. The primer levers can be different shapes such that a human can use his fingers or hand to move them; alternatively, a machine can be configured to move them to automate the primer placement process.

A primer queue component 108 may use a combination of gravity, levers, and/or other controls to insert a primer into a primer seating component 110. In at least one embodiment, primer queue component 108 includes a primer queue 108A, such as a stack and/or series of primers which may be inserted into primer seating component 110. A primer queue 108A may receive a series of primers stacked. In at least one embodiment, primer queue 108A is a cylinder with a recess (e.g., hole) to receive one or more primers. A primer from primer queue 108A may drop into primer channel 108C when primer lever 108B and D returns to a first position (e.g., open position). A primer in primer channel 108C may be pushed into primer seating component 110 when a primer lever 108B and 108D changes from a first position to a second position (e.g., closed position). Primer lever 108B and 108D may otherwise be a handle to slide material (e.g., metal, plastic, and/or composite) to push primer into primer seating component 110. In at least one embodiment, primer queue (e.g., staging) component 108 is substituted by hand placement of a primer, such as into inner cylinder (e.g., primer rod) recess and/or one or more prong holes 116.

A primer may be positioned by a primer seating component 110. As an example, primer seating component 110 is a positioning mechanism, such as to position a primer in a projectile casing. Primer seating component 110 may seat a primer based, at least in part, on indexing from a bottom (e.g., base) of a projectile casing. Indexing of a primer seating component 110 (e.g., position mechanism) may include one or more prongs proceeding from an outer cylinder 118 to making contact with a projectile casing (e.g., through one or more prong holes 116) and an inner cylinder 214 (e.g., primer rod) inserting a primer 224 into a primer pocket until a stopping mechanism 226 prevents exceeding a depth of insertion, causing indexing to a depth measured from a base of a casing.

Figure 1C:
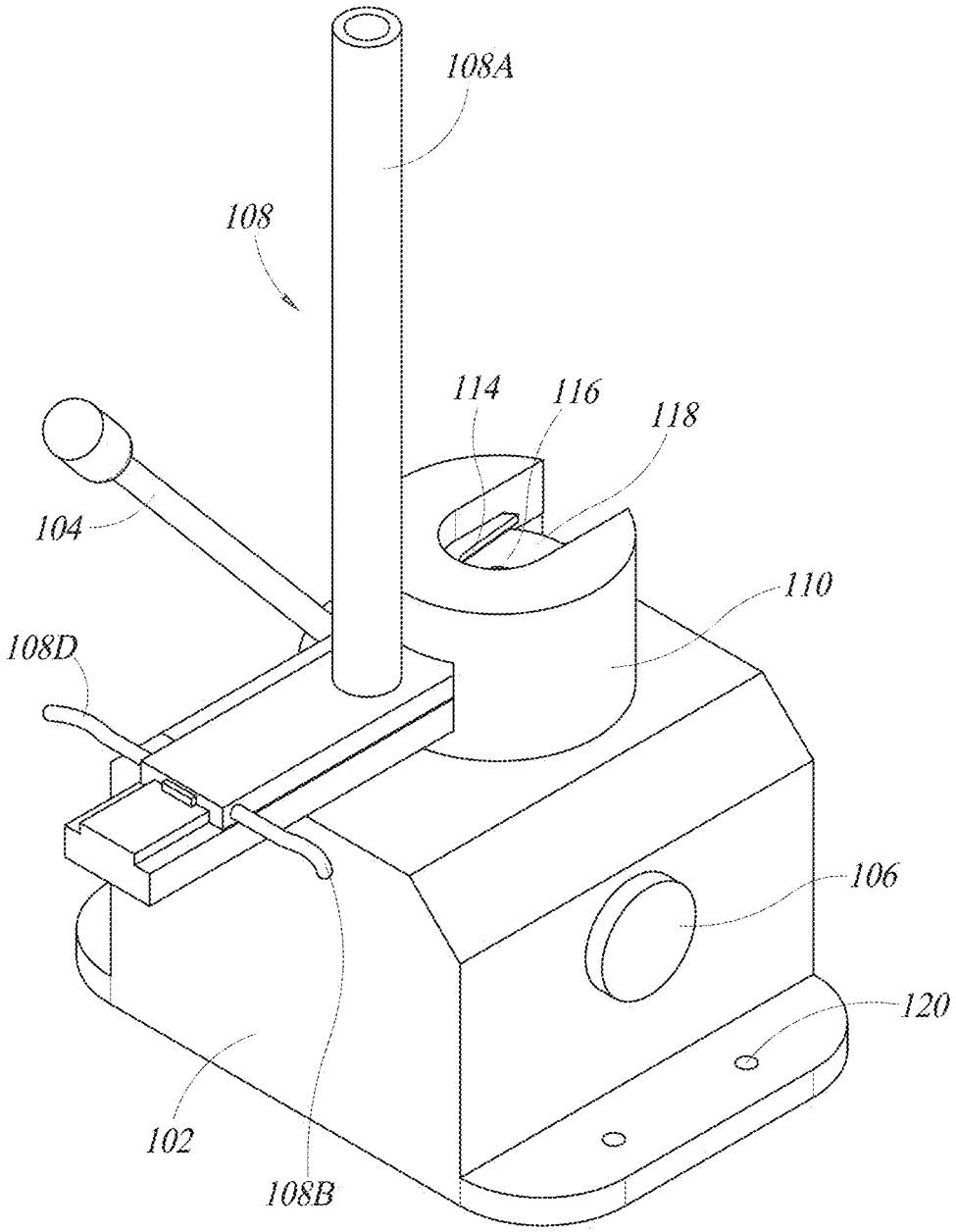
Figure 1D:
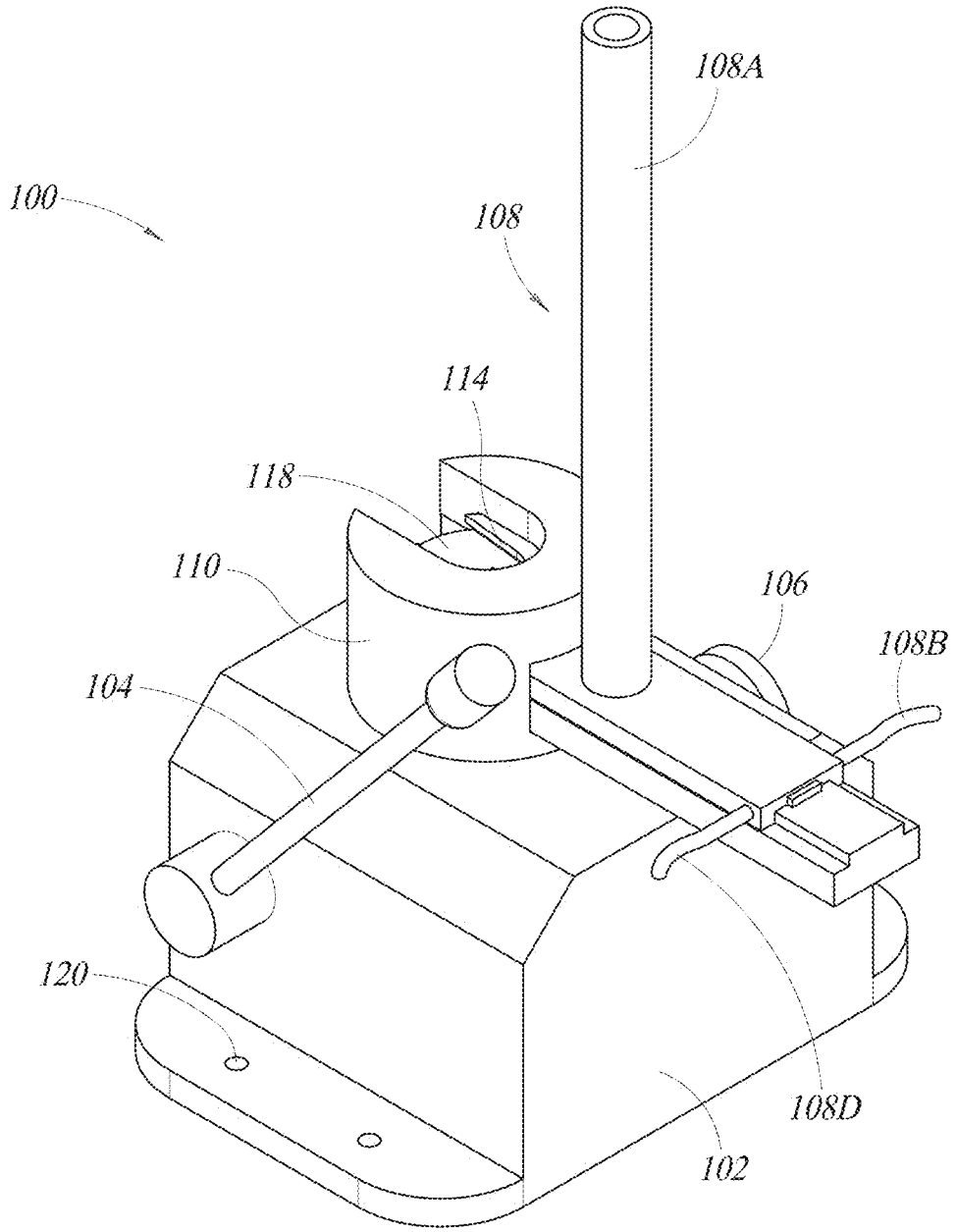

One or more schematic diagrams in FIGS. 1C and 1D include an illustration of a rear view for primer seating system 100, according to at least one embodiment. System 100 includes seating a primer according to an adjusted depth measured (e.g., indexed) from a base of a projectile casing. One or more embodiments may include components of system 100 attached and/or housed by base 102, oriented through, on a side, top, and/or bottom.

In at least one embodiment, a system, such as system 100, includes a collection of one or more hardware and/or software computing resources with instructions that, when executed, performs one or more communication processes such as those described herein. In at least one embodiment, a system, such as system 100, is a software program executing on computer hardware, application executing on computer hardware, and/or variations thereof. In at least one embodiment, one or more processes (e.g., process 1700) of system 100 are performed by any suitable processing system or unit (e.g., graphics processing unit (GPU), general-purpose GPU (GPGPU), parallel processing unit (PPU), central processing unit (CPU)), a data processing unit (DPU), such as described below, and in any suitable manner, including sequential, parallel, and/or variations thereof. In at least one embodiment, system 100 uses a machine learning training framework such as PYTORCH, TENSORFLOW, BOOST, CAFFE, MICROSOFT COGNITIVE TOOLKIT/CNTK, MXNET, CHAINER, KERAS, DEEPLEARNING4J, and/or other training framework to implement and perform operations described herein to seat a primer in a projectile casing and/or otherwise perform operations described herein.

In at least one embodiment, system 100 includes one or more processors and/or components to an apparatus, system, computer-readable medium, computer-implemented method, and/or process to place a primer in a primer pocket of a projectile casing, where the placement is indexed from the base of the projectile casing. System 100 can perform a method that includes seating a primer in a projectile casing according to a depth indexed from a base of a casing, where the process starts by providing a projectile casing that includes a base and a primer pocket. The primer is then aligned, e.g., by a primer aligner, with the primer pocket. Using a positioning mechanism (e.g., primer rod, one or more prongs, and outer cylinder as shown in the FIGS. 1A-17), the system indexes the distance from the base of the projectile casing using one or more prongs contacting with a casing base and one or more primer rods seating the primer at a set depth. For example, a positioning mechanism can include an inner cylinder, one or more prongs, and an outer cylinder that is secured to a projectile casing holder (e.g., by screw threads), where a projectile casing has a bottom that sits flush with the outer cylinder and the outer cylinder has a surface that is wider than at least a portion of the primer pocket. A marksman or machine can push the inner cylinder (e.g., primer rod and/or one or more prongs) up (inside the outer cylinder) such that the primer is inserted to a particular, second depth, and the one or more prongs prevent the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, ensuring it is properly seated without going too deep. The mechanism includes a blocking component that prevents the primer from moving past this desired depth indexed from a projectile casing base. As an example, a blocking component may be a feature of one or more prongs under an outer cylinder, such that when the one or more prongs proceed through prong holes an amount they are halted by coming into contact with an outer cylinder.

In at least one embodiment, system 100 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 100 can position, locate, or otherwise move a primer into a projectile casing. For example, a system 100 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the primer pocket. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 100 is, is included in, and/or otherwise includes systems illustrated in FIGS. 1A-17 to position, locate, or otherwise seat a primer into a projectile casing by indexing from a base of a casing and/or otherwise perform operations described herein. In at least one embodiment, system 100 performs one or more processes illustrated in FIGS. 1A-17, such as process 1700 to position, locate, or otherwise seat a primer into a projectile casing by indexing from a base of a casing and/or otherwise perform operations described herein.

Figure 2A:
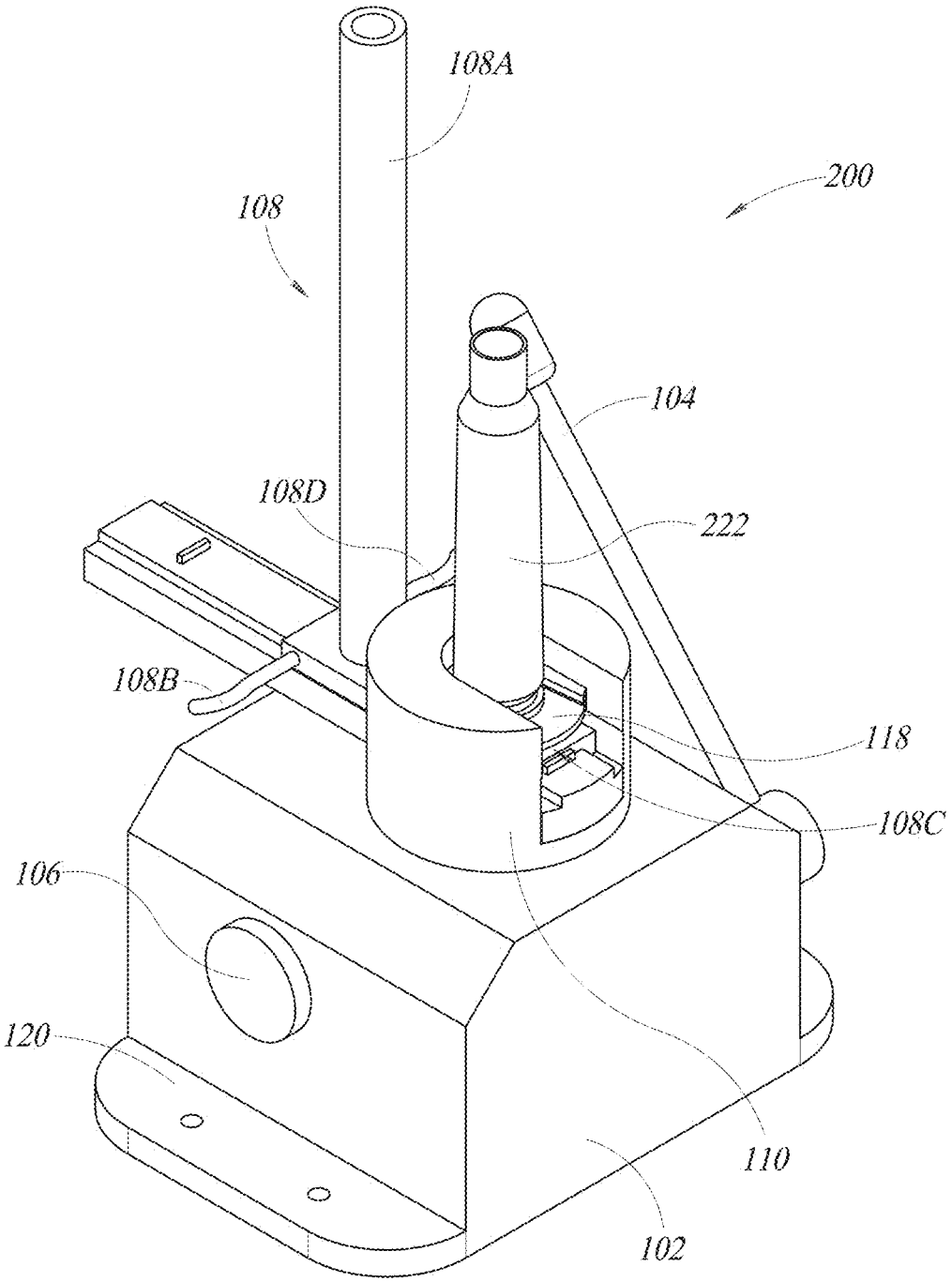
FIG. 2A illustrates a schematic view of a system to receive a projectile, in accordance with at least one embodiment.
Figure 2B:
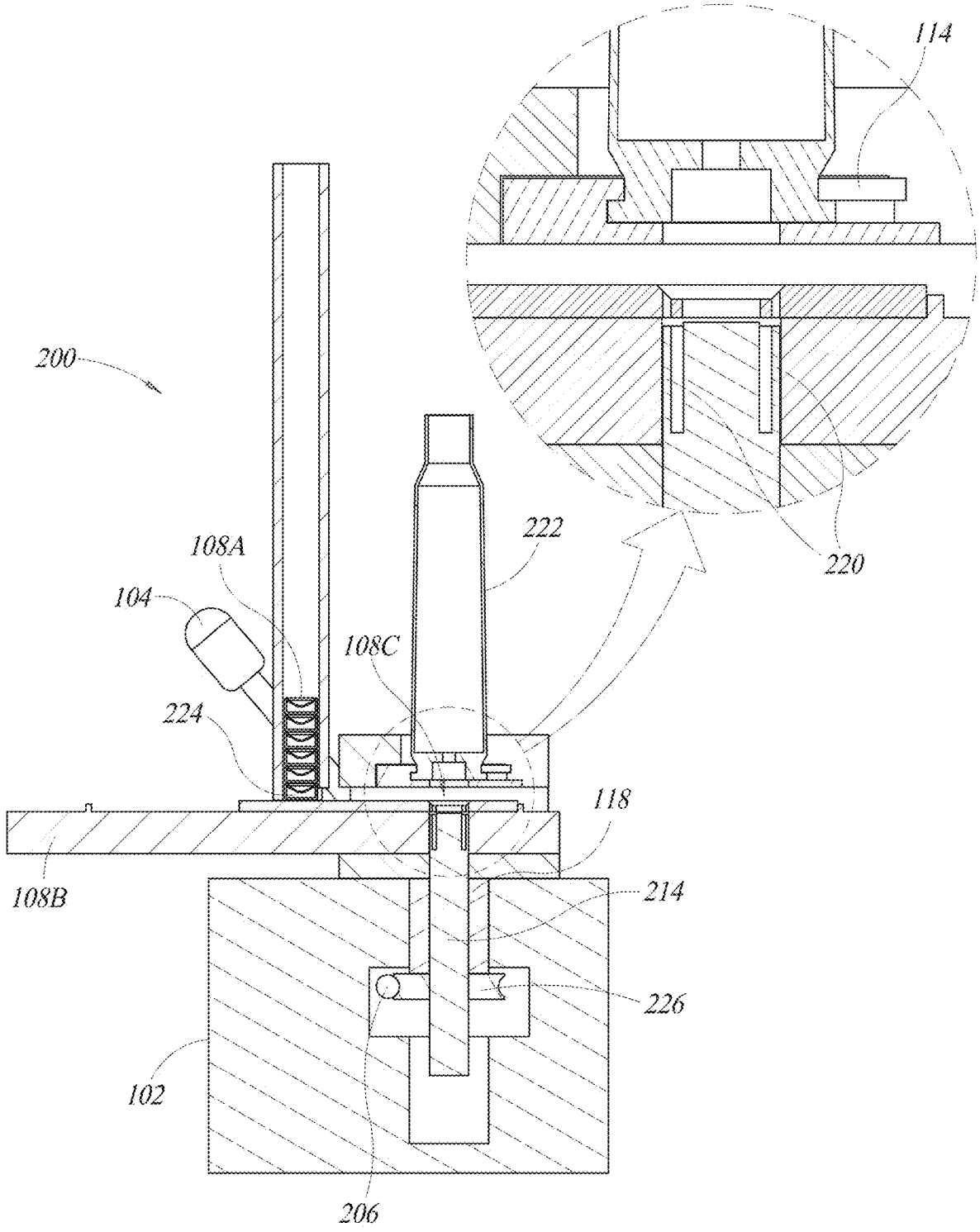
FIG. 2B illustrates a cross-sectional view of a system to receive a projectile, in accordance with at least one embodiment.

FIGS. 2A and 2B illustrate a schematic and cross-sectional view of a system to receive a projectile, in accordance with at least one embodiment. In at least one embodiment, system 200 includes base 102, lever 104, adjustment knob 106, primer queue component 108 (e.g., primer queue 108A, primer lever 108B and D, primer channel 108C), primer seating component 110, attachment grooves 114, inner cylinder recess and/or one or more prong holes 116 (also referred to as "slots" or "receiving areas"), outer cylinder 118, one or more holes 120 to secure base, inner cylinder 214 (e.g., primer rod), one or more prongs 220 (e.g., fixed or not-fixed to an inner cylinder), projectile casing 222, primer 224, stopping mechanism 226, adjustment knob mechanism 206 and/or combinations thereof. A primer 224 may otherwise be illustrated as primer 1024.

FIG. 2A illustrates a schematic view of a system 200 to receive a projectile casing 222, according to at least one embodiment. In at least one embodiment, system 200 receives a projectile casing 222. Projectile casing 222 has a recess (e.g., primer pocket) with which it may receive a primer 224. Projectile casing 222 may be inserted into system 200 along one or more grooves 114, which may be adjusted such that projectile casing is secured to outer cylinder 118 (e.g., outer material). In at least one embodiment, outer cylinder 118 need not be a cylinder, rather it is a material to receive an inner cylinder (e.g., primer rod and/or one or more prongs). As an example, outer material may be a cuboid that contacts a casing. Grooves 114 may be set to receive the projectile casing type of projectile casing 222. When projectile casing is inserted into system 200, said projectile casing may be aligned such that it may receive a primer 224 from primer seating component 110, such as by shuttling a primer into a primer pocket (e.g., recess, gap, and/or space in projectile casing to receive a primer).

FIG. 2B illustrates a cross-sectional view of a system 200 to receive a projectile, according to at least one embodiment. As an example, system 200 may include inner cylinder 214 (e.g., primer rod and/or prongs 220), projectile casing 222, primer 224, stopping mechanism 226, adjustment knob mechanism 206 and/or combinations thereof. Primer seating component 110 may include inner cylinder 214 (e.g., primer rod and/or prongs 220), outer cylinder 118, stopping mechanism 226, adjustment knob mechanism 206, and lever 104.

A projectile casing 222 may be inserted into system 100 (see FIG. 1) when primer lever 108B and D is in a first (e.g., closed) or second (e.g., open) position. As an example, system 200 illustrates inserting a projectile casing when primer lever 108B and D is in a first (e.g., closed) position. A primer 224 may rest on material controlled by primer lever 108B and D, residing in primer channel 108C.

Primer channel 108C may include a portion of outer cylinder 118, such as a portion that may allow a primer 224 to slide into position resting on an inner cylinder 214. In at least one embodiment, inner cylinder 214 may move independently of outer cylinder 118. As an example, inner cylinder 214 is attached to stopping mechanism 226 which can contact (e.g., index from) an outer cylinder 118 when lever 104 is in a second (e.g., open) position or a recess in an outer cylinder 118 that can receive a primer 224 when lever 104 is in a first (e.g., closed) position. As an example, one or more prongs 220 may act as an outer cylinder 118, adjustable using one or more adjustment mechanisms, and an inner cylinder 214 may include a primer rod. As an example, an adjustment knob mechanism 206 may also serve as a release to replace one or more primer rods. System 200 may illustrate a lever 104 in a first (e.g., closed) position where space exists above an inner cylinder 214 with which a primer positioning mechanism may receive a primer 224.

System 200 may also include an adjustment knob mechanism 206, which may adjust the length of the inner cylinder 214 that extends above stopping mechanism 226 and/or be a release to replace one or more primer rods. Stopping mechanism may otherwise be illustrated by a stopping mechanism (see FIGS. 9A-E). Adjustment knob mechanism 206 may be a means for knob 106 to control depth that an inner cylinder 214 will protrude (e.g., extend) from outer cylinder 118 in system 500 (see FIGS. 5A and/or B), such as a depth indexed from a casing base, and/or release primer rod such that it may be replaced. As an example, adjustment knob mechanism 206 includes a screw with threading that spins stopping mechanism 226 along (e.g., upwards, or downwards) threading along an inner cylinder 214 which may correspond to either the depth a primer rod enters a casing, a length of one or more prongs 220 relative to a primer rod, or move an inner cylinder 214 (e.g., primer rod and/or one or more prongs). Stopping mechanism 226 may then be adjusted to a depth with which an inner cylinder 214 should seat a primer 224 into a projectile casing 222.

In at least one embodiment, system 200 includes one or more processors and/or components to place a primer in a primer pocket of a projectile casing, where the placement is indexed from the base of the projectile casing. System 200 can perform a method that includes setting a primer in a projectile casing, where the process starts by providing a projectile casing that includes a base and a primer pocket. The primer is then aligned, e.g., by a primer aligner, with the primer pocket. Using a positioning mechanism (e.g., outer and inner cylinders as shown in the FIGS. 1A-16), the system indexes the distance from the base of the projectile casing to a specific depth within the primer pocket. For example, a positioning mechanism can include an inner cylinder that is free-floating and an outer cylinder that is secured to a projectile casing holder (e.g., by screw threads), where a projectile casing 222 has a bottom that sits flush with the outer cylinder and the outer cylinder has a surface that is wider than at least a portion of the primer pocket. A marksman or machine can push the inner cylinder up (inside the outer cylinder) such that the primer is inserted to a particular, second depth, and the outer cylinder (e.g., including one or more prongs) prevent the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, halted using one or more prongs 220, ensuring it is properly seated without going too deep. The mechanism includes a blocking and/or securing component of one or more primer rods, such that one or more prongs 220 (e.g., fixed or not fixed to a primer rod) may index the primer rod from a base of a casing, preventing the primer from moving past this desired depth.

In at least one embodiment, system 200 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 200 can position, seat locate, or otherwise move a primer into a projectile casing by indexing a depth from a base of a casing. For example, a system 200 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the primer pocket. This mechanism is equipped with a blocking component to prevent the primer from being pressed too far and uses one or more prongs (e.g., fixed to a primer rod or fixed to an outer cylinder) to index from a base of a casing. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 200 is, is included in, and/or otherwise includes systems illustrated in FIGS. 1A-16B to position, seat, locate, or otherwise move a primer into a projectile casing while indexing depth from the base of the projectile casing and/or otherwise perform operations described herein. In at least one embodiment, system 200 performs one or more processes illustrated in FIGS. 1A-17, such as process 1700 to position, seat, locate, or otherwise move a primer into a projectile casing a depth indexed from a base of a casing and/or otherwise perform operations described herein.

Figure 3A:
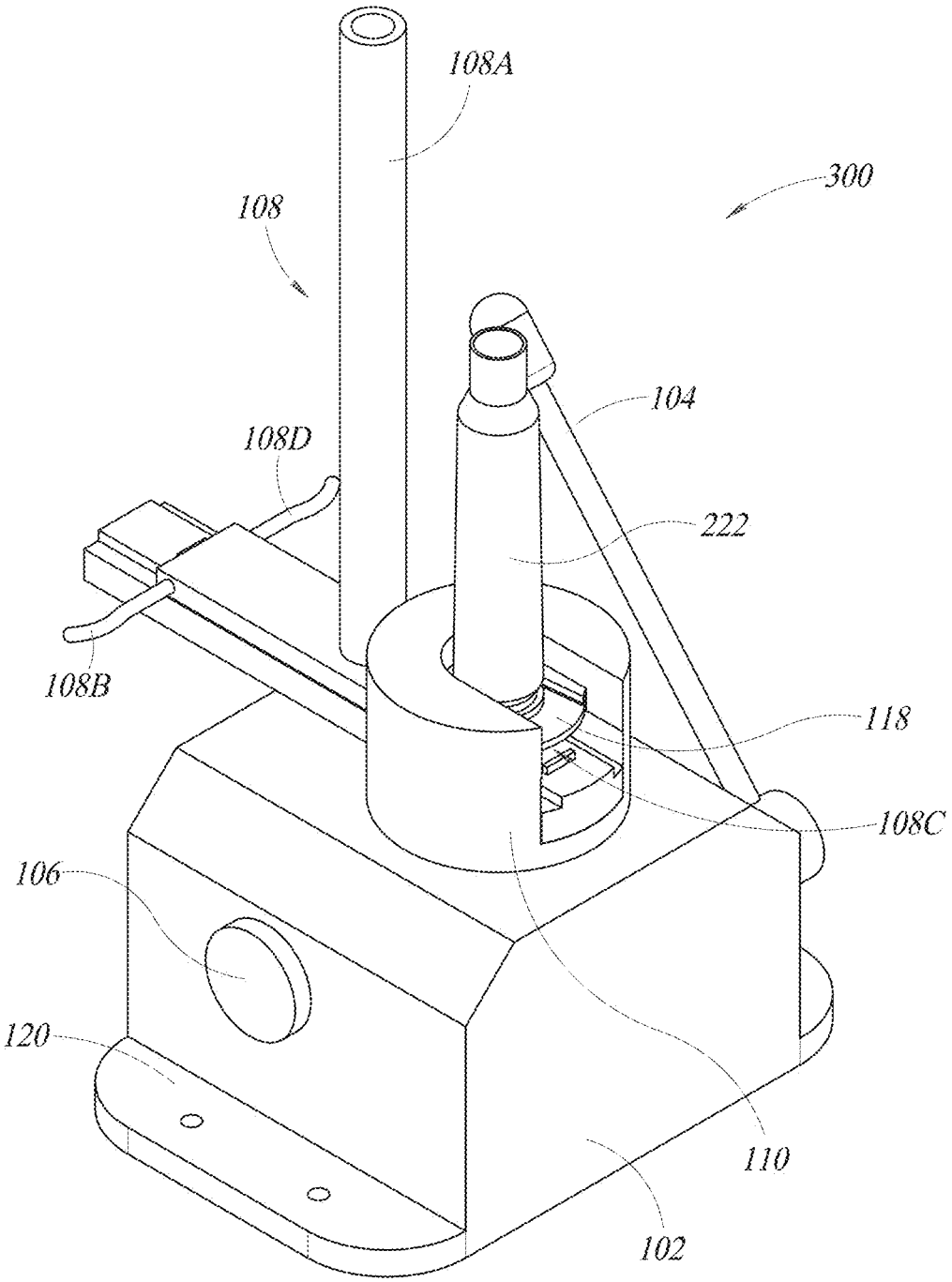
FIG. 3A illustrates a schematic view of a system with a primer in a primer channel, in accordance with at least one embodiment.
Figure 3B:
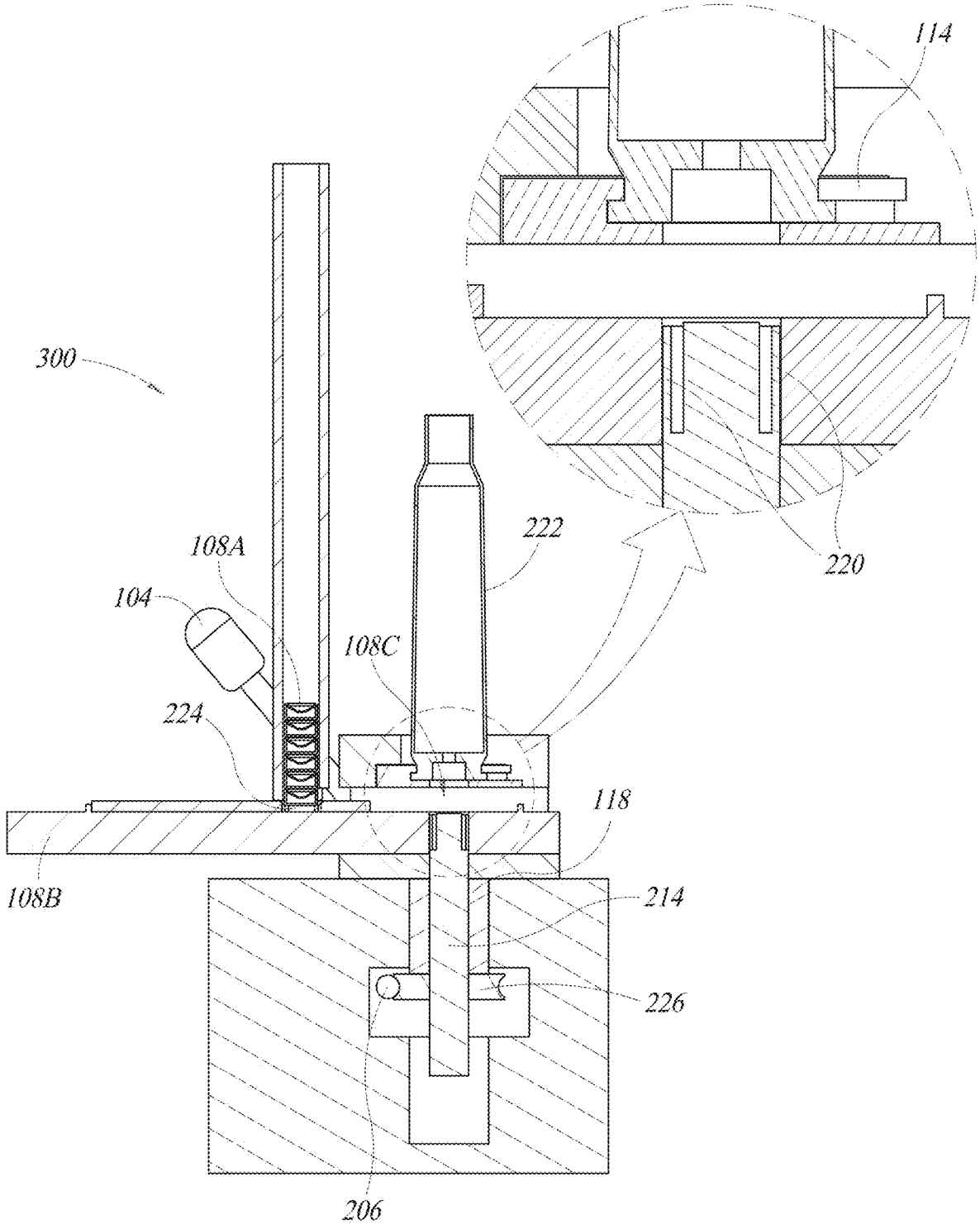
FIG. 3B illustrates a cross-sectional view of a system with a primer in a primer channel, in accordance with at least one embodiment.

FIGS. 3A and 3B illustrate a schematic and cross-sectional view of a system with a primer in a primer channel, in accordance with at least one embodiment. System 300 can include base 102, lever 104, adjustment knob 106, primer queue component 108 (e.g., primer queue 108A, primer lever 108B and D, primer channel 108C), primer seating component 110, attachment grooves 114, inner cylinder recess, one or more prong holes 116, outer cylinder 118, one or more holes 120 to secure base, inner cylinder 214 (e.g., primer rod), one or more prongs 220, projectile casing 222, primer 224, stopping mechanism 226, adjustment knob mechanism 206 (e.g., primer rod release knob) and/or combinations thereof.

FIG. 3A illustrates a schematic view of a system 300 with a primer in a primer channel, according to at least one embodiment. As an example, a primer lever 108B and D is shifted (e.g., changed) from a first (e.g., closed) position to a second (e.g., open) position. Primer lever 108B and D may move away, moving the primer shuttle along the primer channel 108C to receive a primer 224. Primer lever 108B and D may move a distance until space opens below a primer queue 108A to receive a primer (e.g., using gravity). In at least one embodiment, primer lever 108B and D may be extracted from system 300. In at least one embodiment, primer lever 108B and D includes a catch (e.g., grooves and ending of said grooves) to prevent pulling a lever beyond a point in the channel 108C, such as a point after a primer 224 is received by the shuttle such that the primer may then be pushed along channel 108C.

FIG. 3B illustrates a cross-sectional view of a system 300 with a primer in a primer channel, according to at least one embodiment. Once a lever is positioned into a second (e.g., open) position, space in primer channel 108C exists to receive a primer 224, such as into a shuttle. Gravity may shift one or more primers 224 from primer queue 108A downwards and primer channel 108C may receive a primer 224, such as in a primer shuttle controlled by lever 108B and D. A primer 224 received in primer channel 108C may be aligned with a gap below a casing, such that a primer seating component 110 may receive a primer 224 when a shuttle moves to a third position.

In at least one embodiment, system 300 includes one or more processors and/or components to place a primer in a primer pocket of a projectile casing, where the placement is indexed from the base of the projectile casing. System 300 can perform a method that includes setting a primer in a projectile casing, where the process starts by providing a projectile casing that includes a base and a primer pocket. The primer is then aligned, e.g., by a shuttle and/or primer aligner, with the primer pocket. Using a positioning mechanism (e.g., outer cylinder, inner cylinder, and/or one or more prongs as shown in the FIGS. 1A-16), the system indexes the distance from the base of the projectile casing to a specific depth within the primer pocket. For example, a positioning mechanism can include an inner cylinder that is free-floating and an outer cylinder that is secured to a projectile casing holder (e.g., by screw threads), where a projectile casing has a bottom that sits flush with the outer cylinder and the outer cylinder has a surface that is wider than at least a portion of the primer pocket. A marksman or machine can push the inner cylinder up (inside the outer cylinder) such that the primer is inserted to a particular, second depth, and the outer cylinder prevents the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, ensuring it is properly seated without going too deep. The mechanism includes a blocking component that prevents the primer from moving past this desired depth.

In at least one embodiment, system 300 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into a desired depth (e.g., distance between one or more prongs and a primer rod), as shown in FIGS. 7H-7K.

In at least one embodiment, system 300 can position, seat, locate, or otherwise move a primer into a projectile casing, indexing from a base of a casing. For example, a system 300 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the primer pocket, such as by using one or more shuttles. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 300 is, is included in, and/or otherwise includes systems illustrated in FIGS. 1A-15C that can position, locate, or otherwise move a primer into a projectile casing and/or otherwise perform operations described herein. In at least one embodiment, system 300 performs one or more processes illustrated in FIGS. 1A-17, such as process 1700 that can position, locate, or otherwise move a primer into a projectile casing and/or otherwise perform operations described herein.

Figure 4A:
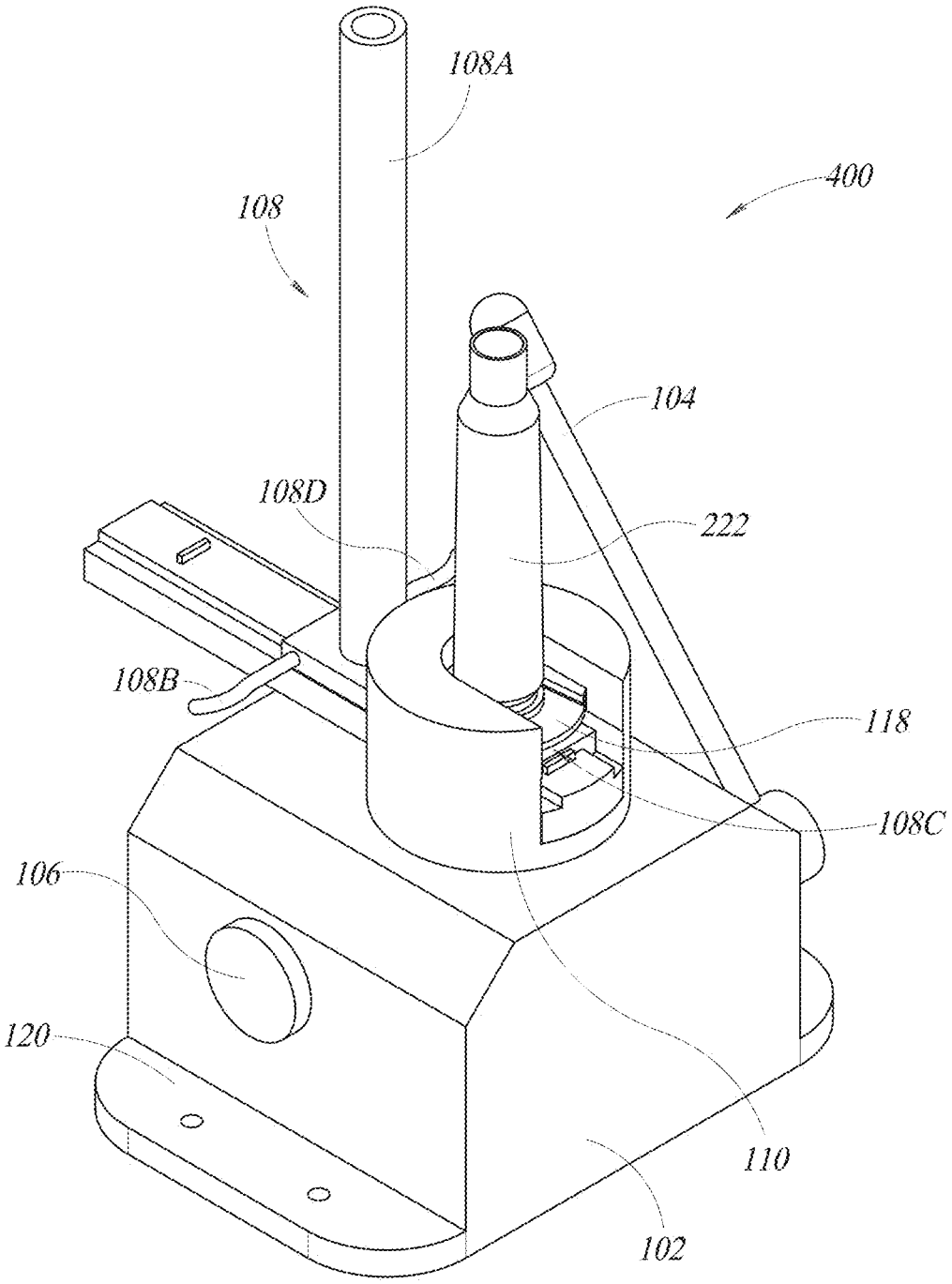
FIG. 4A illustrates a schematic of a system to align a primer with a projectile casing, in accordance with at least one embodiment.
Figure 4B:
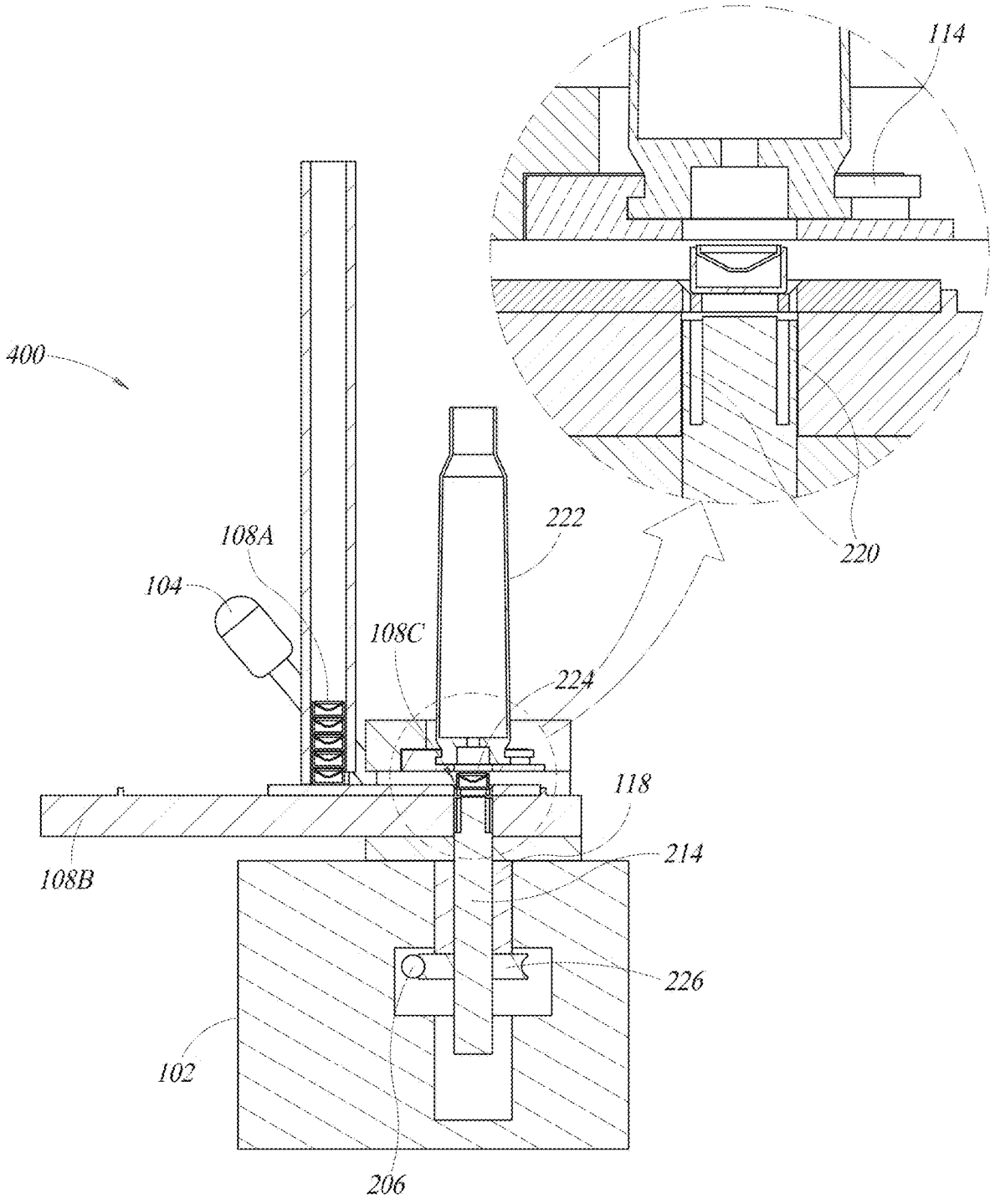
FIG. 4B illustrates a cross-sectional view of a system to align a primer with a projectile casing, in accordance with at least one embodiment.

FIGS. 4A and 4B illustrate a schematic and cross-sectional view of a system 400 to align a primer 224 with a projectile casing 222, in accordance with at least one embodiment. In at least one embodiment, system 400 includes base 102, lever 104, adjustment knob 106, primer queue component 108 (e.g., primer queue 108A, primer lever 108B and D, primer channel 108C), primer seating component 110, attachment grooves 114, inner cylinder recess, one or more prong holes 116, outer cylinder 118, one or more holes 120 to secure base, inner cylinder 214, one or more prongs 220, projectile casing 222, primer 224, stopping mechanism 226, adjustment knob mechanism 206 and/or combinations thereof.

FIG. 4A illustrates a schematic view of a system 400 to align a primer 224 with a projectile casing 222, according to at least one embodiment. As an example, a primer lever 108B and D is shifted (e.g., changed) from a second (e.g., open) position to a first (e.g., closed) position. Primer lever 108B and D may move towards a primer seating component 110 (e.g., inner cylinder 214 and outer cylinder 118), moving a primer along primer channel 108C into alignment with primer seating component 110. Primer lever 108B and D may move a distance until primer 224 is aligned with primer seating component 110, such as a primer shuttle being aligned with inner cylinder 214 (e.g., primer rod). As an example, outer cylinder 118 is of a greater diameter than an inner cylinder. In at least one embodiment, outer cylinder 118 is otherwise a three-dimensional shape (e.g., cuboid) which touches a base of a projectile casing 222 with one or more prong holes to receive one or more prongs 220 and/or primer rod of an inner cylinder 214.

FIG. 4B illustrates a cross-sectional view of a system 400 to align a primer 224 with a projectile casing 222, according to at least one embodiment. Primer lever 108B and 108D may change to a position (e.g., closed, first, and/or third position) where primer 224 is aligned with projectile casing 222, such as above inner cylinder 214. System 400 may include primer seating component 110 receiving primer 224 from primer queue component 108 (e.g., primer queue 108A, primer lever 108B and D, and primer channel 108C). In system 400, primer 224 may be aligned with projectile casing 222 and inner cylinder 214.

In at least one embodiment, system 400 includes one or more processors and/or components to align a primer with a projectile casing, such as aligning with one or more primer rods and centered between one or more prongs to index the depth from the base of the projectile casing. System 400 can perform a method that includes aligning a primer with a projectile casing, where the process may include to move a primer along a primer channel 108C using one or more shuttles. The primer is then aligned, e.g., by a shuttle and/or primer aligner, with the primer in a primer pocket moved with a lever 108B and D. Using a positioning mechanism (e.g., outer and inner cylinders as shown in the FIGS. 1A-16), the system indexes the distance from the base of the projectile casing to a specific depth within the primer pocket. For example, a positioning mechanism can include an inner cylinder that is free-floating and an outer cylinder that is secured to a projectile casing holder (e.g., by screw threads), where a projectile casing has a bottom that sits flush with the outer cylinder and the outer cylinder has a surface that is wider than at least a portion of the primer pocket. Further, one or more prongs may be fixed or free-floating to a primer rod, such that it may be indexed a depth to seat a primer from a projectile casing base. A marksman or machine can push the inner cylinder up (inside the outer cylinder) such that the primer is inserted to a particular depth, e.g., second depth, referenced using one or more prongs to come in contact with a projectile casing base. A halting mechanism stops a primer rod from proceeding from a desired depth measured from a projectile casing base, such as by the outer cylinder preventing the inner cylinder from moving further after the second depth is reached by the primer indexed from a casing base using one or more prongs. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, ensuring it is properly seated using one or more prongs, without going too deep. The mechanism includes a blocking component that prevents the primer from moving past this desired depth, such as by incorporating one or more prongs fixed to a primer rod.

In at least one embodiment, system 400 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing using one or more prongs, and then presses the primer into place to a desired depth.

In at least one embodiment, system 400 can position, locate, or otherwise move a primer into a projectile casing. For example, a system 400 can include a primer seating component that holds the projectile casing in place. This casing has a base, a neck, and a primer pocket with a specific depth, e.g., a first depth that is measured by a marksman or provided by a manufacturer. The system also includes a primer queue component, which aligns primers with a casing and primer seating component. This mechanism is equipped with a blocking component to prevent the primer from being pressed too far. Additionally, a lever is attached to the positioning mechanism to move it, ensuring that the primer is pressed in place correctly. One or more prongs may index a primer's depth, as shown in FIGS. 7H-K. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 400 is, is included in, and/or otherwise includes systems illustrated in FIGS. 1A-15C to position, locate, or otherwise move a primer into a projectile casing and/or otherwise perform operations described herein. In at least one embodiment, system 400 performs one or more processes illustrated in FIGS. 1A-17, such as process 1700 that can position, locate, or otherwise move a primer into a projectile casing and/or otherwise perform operations described herein.

Figure 5A:
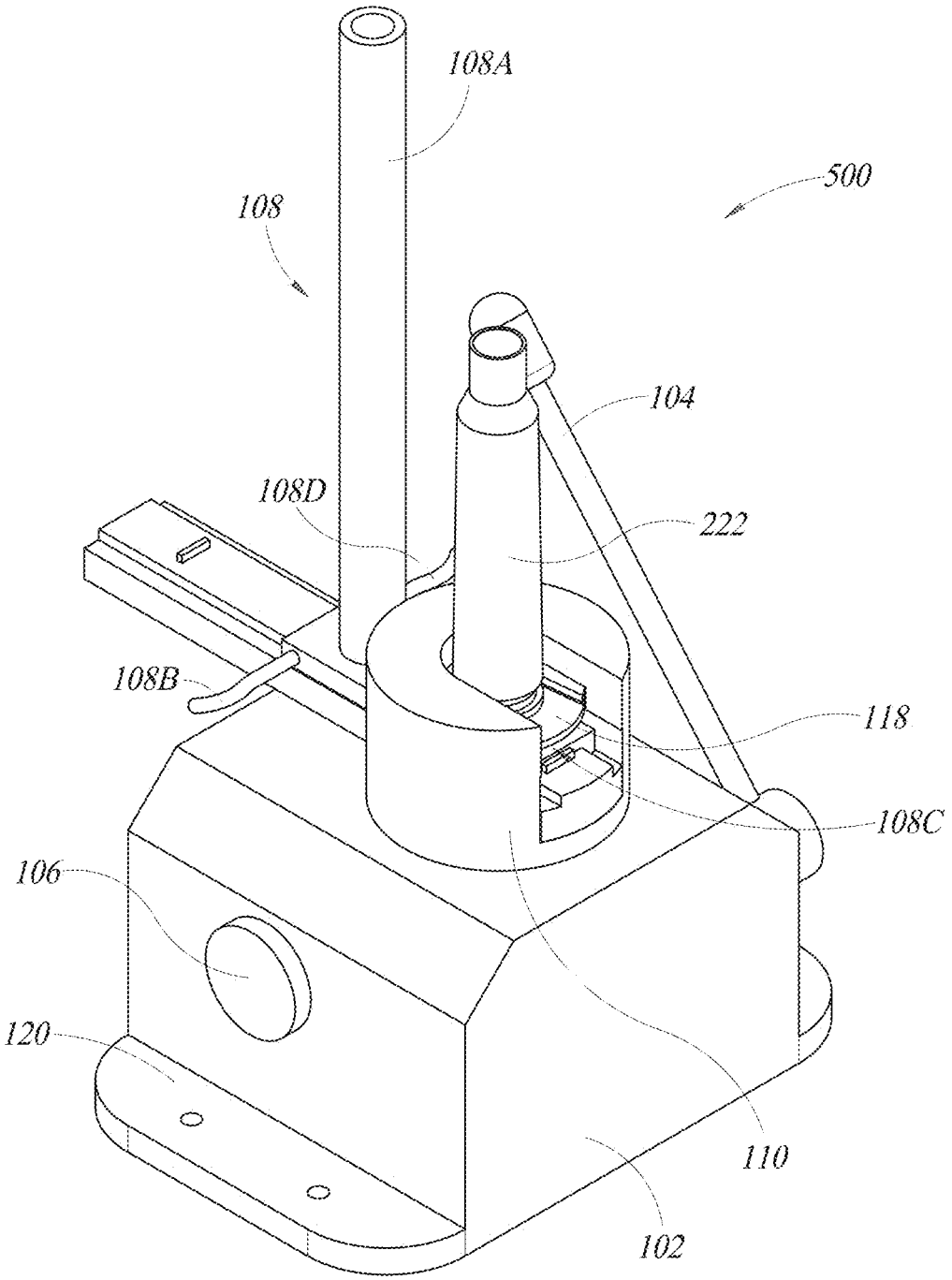
FIG. 5A illustrates a schematic view of a system to seat a primer, in accordance with at least one embodiment.
Figure 5B:
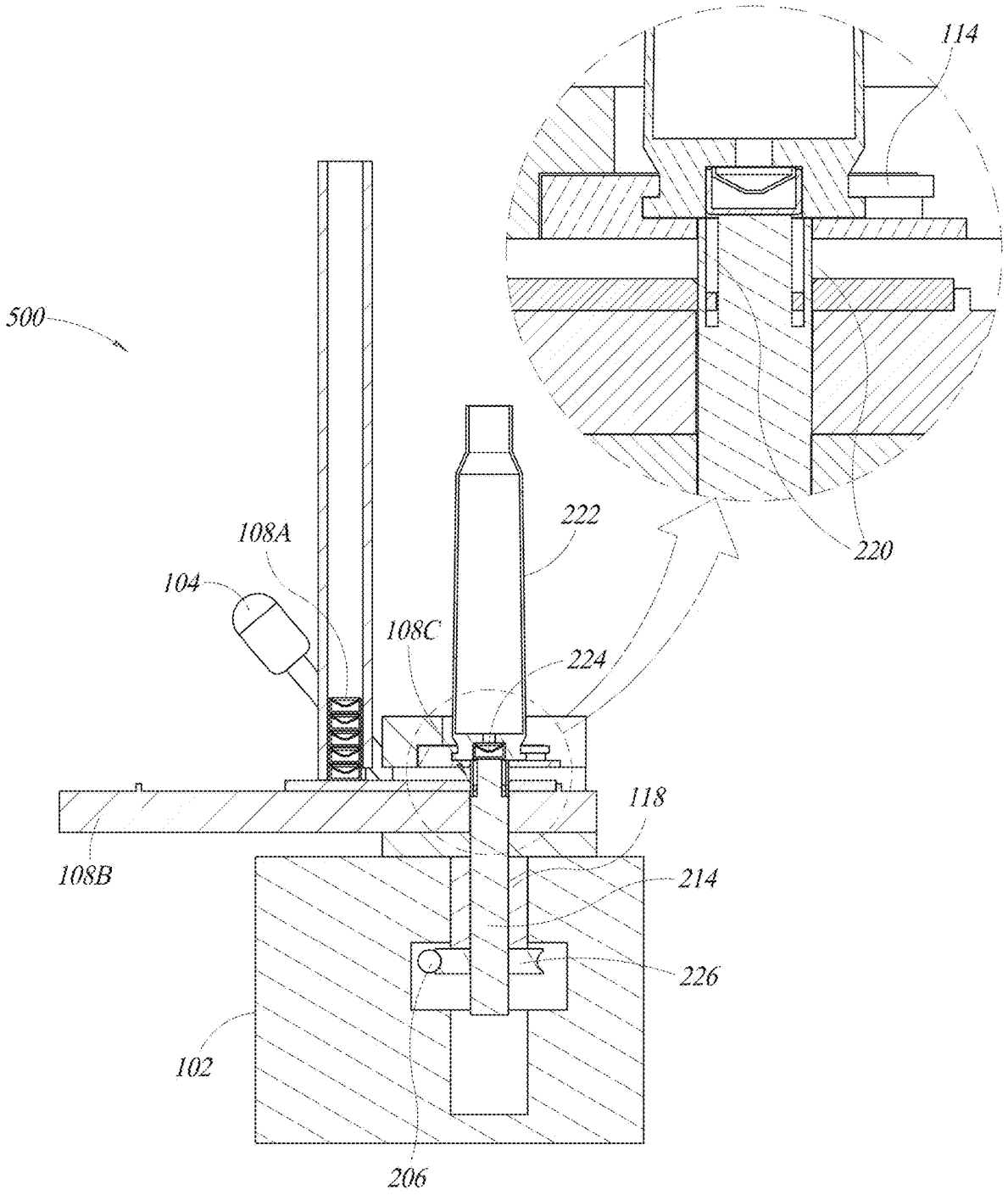
FIG. 5B illustrates a cross-sectional view of a system to seat a primer, in accordance with at least one embodiment.

FIGS. 5A and 5B illustrate a schematic and cross-sectional view of a system to seat a primer, in accordance with at least one embodiment. In at least one embodiment, system 500 includes base 102, lever 104, adjustment knob 106, primer queue component 108 (e.g., primer queue 108A, primer lever 108B and D, primer channel 108C), primer seating component 110, attachment grooves 114, inner cylinder recess, one or more prong holes 116, outer cylinder 118, one or more holes 120 to secure base, inner cylinder 214, one or more prongs 220, projectile casing 222, primer 224, stopping mechanism 226, adjustment knob mechanism 206 and/or combinations thereof.

FIG. 5A illustrates a schematic view of a system 500 to seat a primer 224, according to at least one embodiment. System 500 may include a lever 104, which was moved from a first position to a second position. A lever 104 moved to a second position may have an inner cylinder 214 (e.g., primer rod) and one or more prongs 220 protrude from an outer cylinder 118, such that a length the inner cylinder 214 extends beyond one or more prongs corresponds to a depth to seat a primer (e.g., a prong is shorter than a central portion or central primer rod that is used to place the primer).

FIG. 5B illustrates a cross-sectional view of a system 500 to seat a primer 224, according to at least one embodiment. As an example, inner cylinder 214 seats primer 224 at a depth corresponding to an adjustment knob 106 by adjustment knob mechanism 206 adjusting stopping mechanism's 226 placement along an inner cylinder 214 (e.g., moving towards or away from a projectile casing 222). Primer 224 may be seated in projectile casing 222 (e.g., in primer pocket), when lever 104 is in a second position. System 500 may include a primer 224 seated in projectile casing 222 by an inner cylinder 214 protruding beyond one or more prongs 220 from an outer cylinder 118, the difference in length between the primer rod and one or more prongs corresponding to a depth selected using adjustment knob 106.

In at least one embodiment, system 500 includes one or more processors and/or components to place a primer in a primer pocket of a projectile casing, where the placement is indexed from the base of the projectile casing. System 500 can perform a method that includes setting a primer in a projectile casing, where the process starts by providing a projectile casing that includes a base and a primer pocket. The primer is then aligned, e.g., by a primer aligner, with the primer pocket. Using a positioning mechanism (e.g., outer and inner cylinders as shown in the FIGS. 1A-16), the system indexes the distance from the base of the projectile casing to a specific depth within the primer pocket using one or more prongs. For example, a positioning mechanism can include an inner cylinder (e.g., primer rod) that is free-floating and an outer cylinder that is secured to a projectile casing holder (e.g., by screw threads), where a projectile casing has a bottom that sits flush with the outer cylinder and the outer cylinder has a surface that is wider than at least a portion of the primer pocket. A marksman or machine can push the inner cylinder up (inside the outer cylinder) such that the primer is inserted to a particular, second depth, and the outer cylinder prevents the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, ensuring it is properly seated without going too deep. The mechanism includes a blocking component that prevents the primer from moving past this desired depth.

In at least one embodiment, system 500 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 500 can position, locate, or otherwise move a primer into a projectile casing. For example, a system 500 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the projectile casing. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 500 is, is included in, and/or otherwise includes systems illustrated in FIGS. 1A-16B to position, locate, or otherwise move a primer into a projectile casing by indexing from the base of the projectile casing and/or otherwise perform operations described herein. In at least one embodiment, system 500 performs one or more processes illustrated in FIGS. 1A-17, such as process 1700 to position, locate, or otherwise move a primer into a projectile casing by indexing from the base of the projectile casing and/or otherwise perform operations described herein.

Figure 6A:
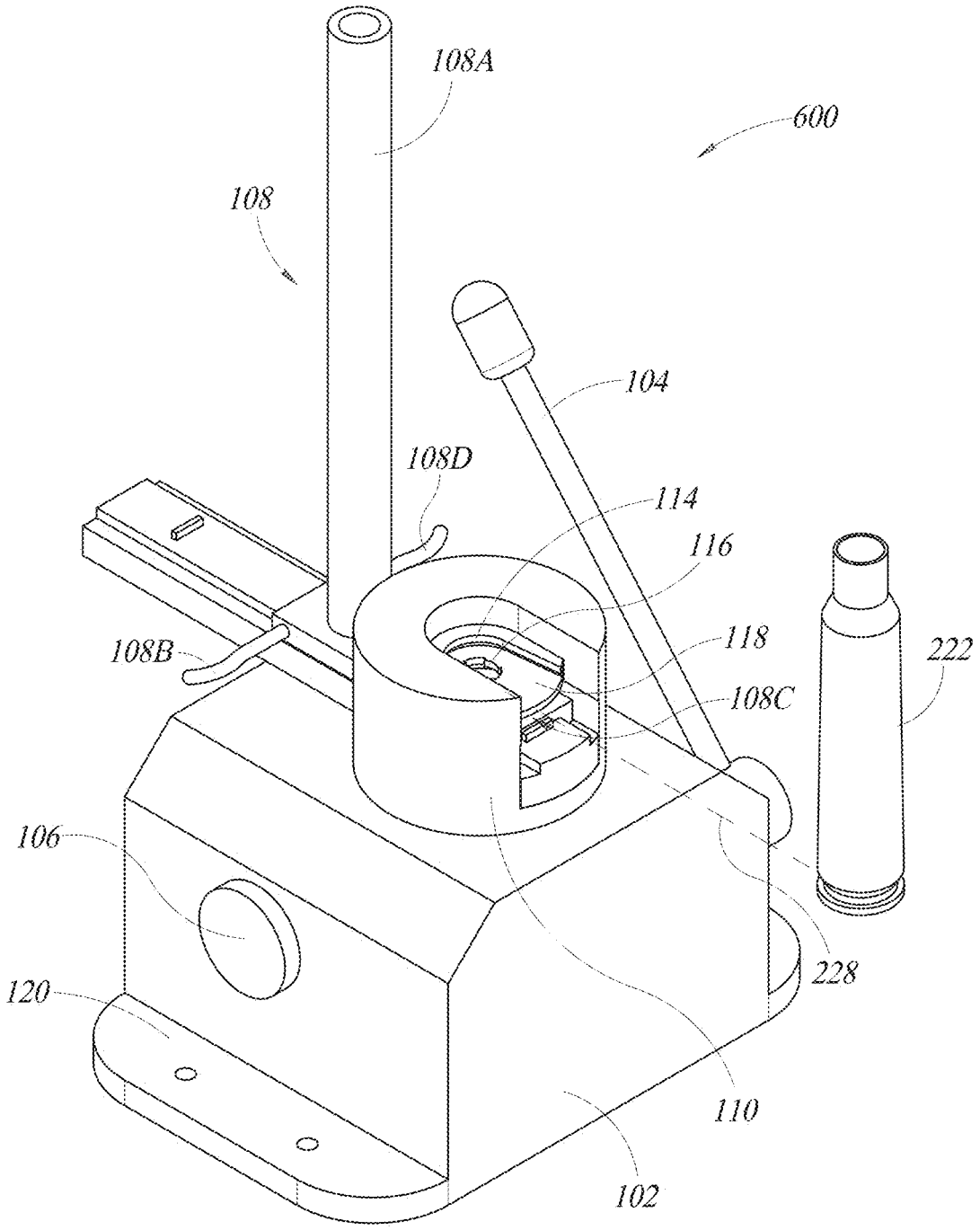
FIG. 6A illustrates a schematic view of a system to remove a projectile casing with primer seated according to a length corresponding to a base of a projectile casing, in accordance with at least one embodiment.
Figure 6B:
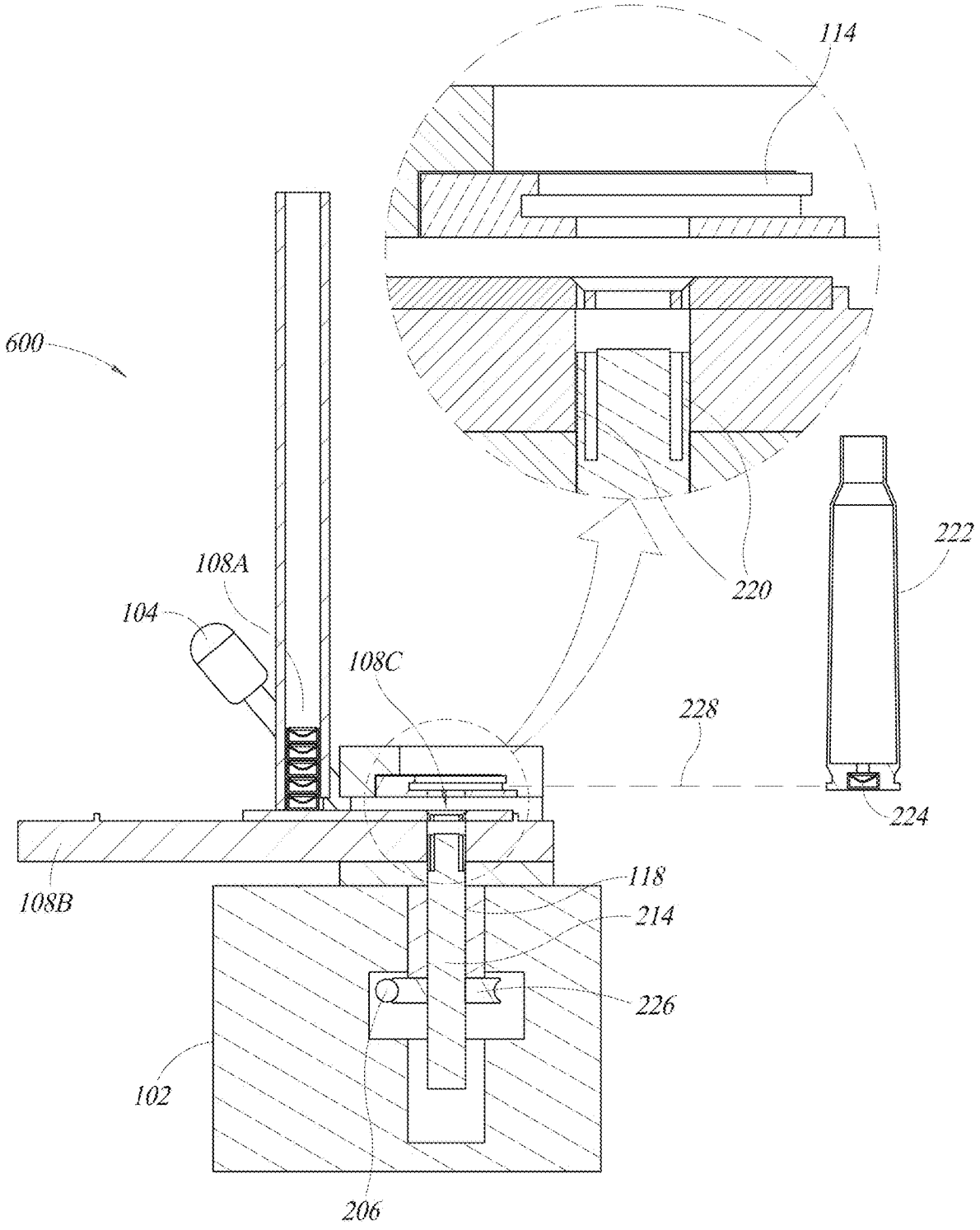
FIG. 6B illustrates a cross-sectional view of a system to remove a projectile casing with primer seated according to a length corresponding to a base of a projectile casing, in accordance with at least one embodiment.

FIGS. 6A and 6B illustrate a schematic and cross-sectional view of a system to remove a projectile casing with primer seated according to a length corresponding to a base of a projectile casing, in accordance with at least one embodiment. In at least one embodiment, system 600 includes base 102, lever 104, adjustment knob 106, primer queue component 108 (e.g., primer queue 108A, primer lever 108B and D, primer channel 108C), primer seating component 110, attachment grooves 114, inner cylinder recess, one or more prong holes 116, outer cylinder 118, one or more holes 120 to secure base, inner cylinder 214, one or more prongs 220, projectile casing 222, primer 224, stopping mechanism 226, adjustment knob mechanism 206, and/or combinations thereof.

FIG. 6A illustrates a schematic view of a system 600 to remove 228 a projectile casing with primer seated according to a length measured from a base of a projectile casing, according to at least one embodiment. System 600 may include lever 104 in a position where the top of an inner cylinder 214 is below the top of an outer cylinder 118 (e.g., first or third position). As an example, the top of an outer cylinder may be facing where a projectile casing is received (e.g., towards grooves 114). Projectile casing 222 is otherwise illustrated in FIG. 10F as a projectile casing 1022 with a seated primer 1024. Projectile casing 222 may be removed 228 (e.g., extracted) from system 600 by removing 228 projectile casing 222 from grooves 114.

FIG. 6B illustrates a cross-sectional view of a system 600 to remove 228 a projectile casing with primer seated according to a depth indexed from a base of a projectile casing, according to at least one embodiment. Removed 228 projectile casing 222 may include primer 224 seated at a depth selected by knob 106, such that a difference in the protruding length of one or more prongs and a primer rod corresponds to a depth of a seated primer (see FIGS. 7H-7K). System 600 may include a primer lever 108B in a closed position (e.g., first or third) and lever 104 in a position where a top of an inner cylinder 214 is below the top of an outer cylinder 118, such as below primer channel 108C. A system 100 may then repeat a process illustrated by systems 200, 300, 400, 500, and 600. As an example, system 100 may transition from a system 600 to a system illustrated in system 200 by removing projectile casing 222 with seated primer 224 and inserting a next projectile casing into system 100.

In at least one embodiment, system 600 includes one or more processors and/or components to seat a primer in a primer pocket of a projectile casing, where the placement is indexed from the base of the projectile casing. System 600 can perform a method that includes setting a primer in a projectile casing, where the process starts by providing a projectile casing that includes a base and a primer pocket. The primer is then aligned, e.g., by a primer aligner, with the primer pocket. Using a positioning mechanism (e.g., outer and inner cylinders as shown in the FIGS. 1A-16) and/or one or more prongs, the system indexes the distance from the base of the projectile casing to a specific depth within the primer pocket. For example, a positioning mechanism (e.g., primer seating component 110) can include an inner cylinder that is free-floating, one or more prongs, and an outer cylinder that is secured to a projectile casing holder (e.g., by screw threads), where a projectile casing has a bottom that sits flush with the outer cylinder and the outer cylinder has a surface that is wider than at least a portion of the primer pocket with one or more prong holes. A marksman or machine can push the inner cylinder up (inside the outer cylinder) such that the primer is inserted to a particular, second depth, and the outer cylinder prevents the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, using one or more prongs, ensuring it is properly seated without going too deep. The mechanism includes a blocking component that prevents the primer from moving past this desired depth.

In at least one embodiment, system 600 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 600 can position, locate, or otherwise move a primer into a projectile casing by indexing a depth using one or more prongs. For example, a system 600 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the projectile casing. This mechanism is equipped with a blocking component to prevent the primer from being pressed too far. Additionally, a lever is attached to the positioning mechanism to move it, ensuring that the primer is pressed in place correctly using one or more prongs. After the primer is set, a casing extractor removes 228 the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 600 is, included in, and/or otherwise includes systems illustrated in FIGS. 1A-15C to position, locate, or otherwise move a primer into a projectile casing by indexing from the projectile casing's base and/or otherwise perform operations described herein. In at least one embodiment, system 600 performs one or more processes illustrated in FIGS. 1A-17, such as process 1700 that can position, locate, or otherwise move a primer into a projectile casing based, at least in part, on indexing from the projectile casing base using one or more prongs and/or otherwise perform operations described herein.

FIGS. 7A-7K illustrate schematic and cross-sectional views of a system 700 to index depth of a primer from a casing 222, in accordance with at least one embodiment. In at least one embodiment, system 700 includes primer queue component 108 (e.g., primer queue 108A, primer lever 108B and D, primer channel 108C), primer seating component 110, one or more components to secure a casing 222 (e.g., attachment grooves 114), inner cylinder recess, one or more prong holes 116, outer cylinder 118 (e.g., a cylinder with one or more prongs 734), inner cylinder 214 (e.g., one or more primer rods 732), one or more prongs 220, projectile casing 222, primer 224, stopping mechanism 226 (e.g., when prongs make contact with casing), shuttle 708, rail component 730 (e.g., rail 730A, forward stop 730B, and/or rear stop 730C), primer rod 732, one or more prongs 734, a primer rod base 736 (e.g., outer cylinder 118 with one or more prongs 734 attached) and/or combinations thereof.

Figure 7A:
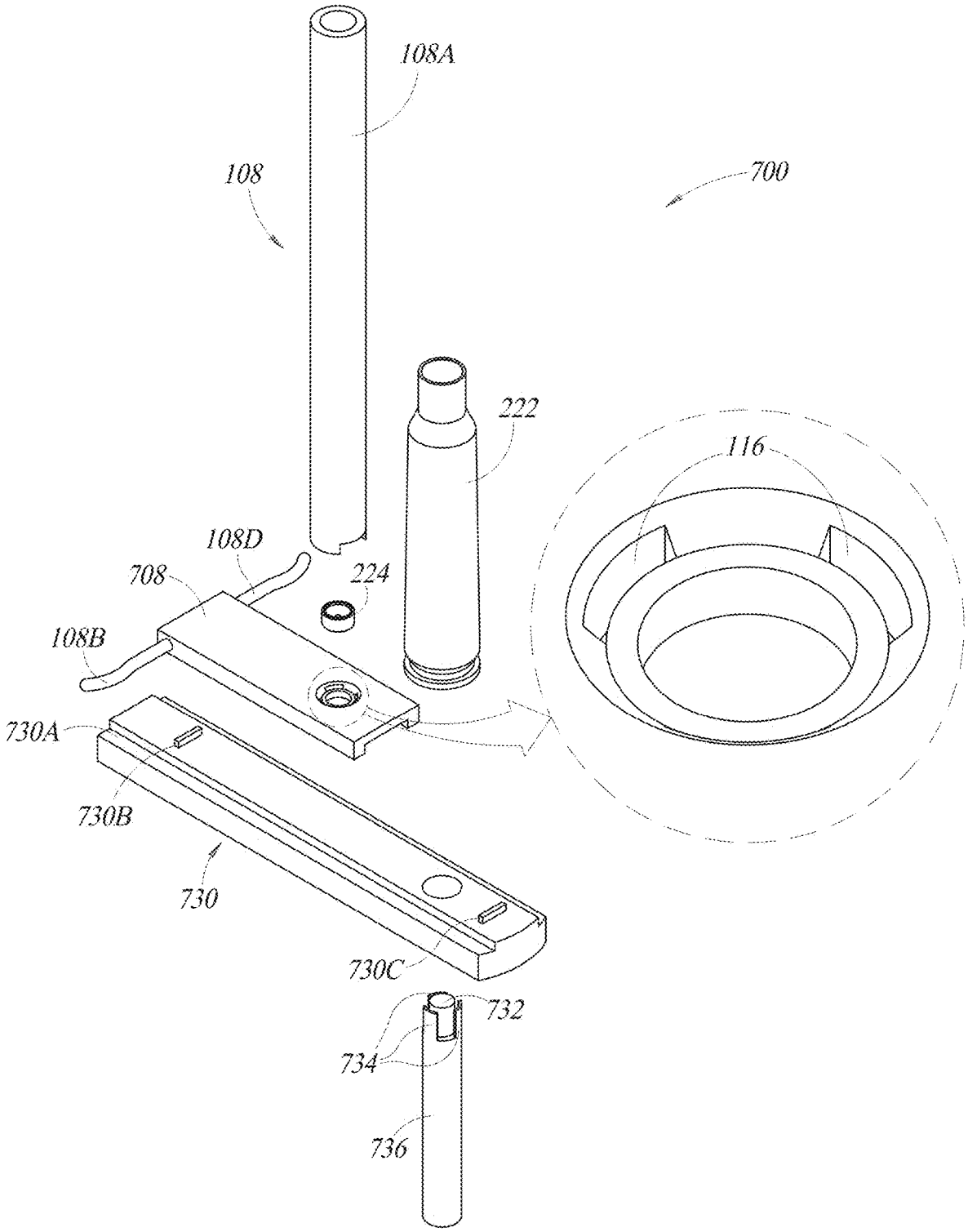
FIGS. 7A-7K illustrate schematic and cross-sectional views of a system to index depth of a primer from a casing, in accordance with at least one embodiment.

FIG. 7A illustrates a schematic view of a system 700 to index depth of a primer from a casing, according to at least one embodiment. For example, system 700 may include a primer queue component 108, primer seating component 110, and rail component 730. A primer queue component 108 may include a shuttle 708, primer queue 108A, primer lever 108B and D, primer channel 108C, or combinations thereof. As an example, a shuttle 708 includes a recess which may receive one or more primers 224, one or more prongs 734, and/or one or more primer rods 732. A shuttle 708 may receive (e.g., using gravity) a primer 224 when a lever 108B and D is moved into a second position. Once a primer is received in a shuttle 708, lever 108B and D may be moved to a first or third position such that a primer is centered between a casing 222 and a primer rod 732, such as by using rail component 730. A shuttle 708 may move between one or more stops (e.g., forward stop 730B and rear stop 730C) along a rail component 730. As an example, when a shuttle 708 is in a first or third position, a shuttle 708 makes contact with a rear stop 730C and is aligned with a primer pocket of casing 222 and/or a primer rod 732 (e.g., after a primer was previously loaded). As an example, when a shuttle 708 is in a second position, a shuttle 708 makes contact with a forward stop 730B and a basket is aligned with a primer queue 108A such that it may receive a primer 224. Then, a primer shuttle 708 once loaded with a primer may be returned to a first or third position in contact with a rear stop 730C and aligned with a casing 222 and primer rod 732.

Once a primer queue component 108 aligns a primer with a casing 222 and a primer rod 732, a primer seating component 110 may seat a primer 224. As an example, a primer seating component 110 may include primer rod 732, one or more prongs 734, and/or a primer rod base 736. As an example, herein an inner cylinder 214 may refer to a primer rod 732. As an example, herein an outer cylinder 118 may refer to a primer rod base 736 fixed to one or more prongs 734. A rail component 730 may include a recess such that a primer seating component may pass through. In at least one embodiment, system 700 includes one or more components to secure a casing, such as those illustrated herein. In at least one embodiment, adhesive or threading may be used to connect and/or adjust a primer rod 732 with respect to one or more prongs 734 and/or a primer rod base 736.

FIGS. 7B-7G illustrate cross-sectional views of a system 700 to index depth of a primer from a casing 222, in accordance with at least one embodiment. In at least one embodiment, system 700 includes one or more processors and/or components to place a primer in a primer pocket of a projectile casing, where the placement is indexed from the base of the projectile casing. System 700 can perform a method that includes setting a primer in a projectile casing, where the process starts by providing a projectile casing that includes a base and a primer pocket. The primer is then aligned, e.g., using a shuttle 708, with the primer pocket of a casing 222. Using a positioning mechanism (e.g., outer and inner cylinders as shown in the FIGS. 1A-16), the system indexes the distance from the base of the projectile casing to a specific depth within the primer pocket using one or more prongs. For example, a positioning mechanism can include an inner cylinder (e.g., primer rod) that is free-floating and an outer cylinder that is secured to a projectile casing holder (e.g., by screw threads), where a projectile casing has a bottom that sits flush with the outer cylinder and the outer cylinder has a surface that is wider than at least a portion of the primer pocket. A marksman or machine can push the inner cylinder up (inside the outer cylinder) such that the primer is inserted to a particular, second depth, and the outer cylinder prevents the inner cylinder from moving further after the second depth is reached by the primer. This depth is referred to as the second depth, which can be shallower than the first depth (e.g., to provide some primer crush or crunch). In another embodiment, a first and second depth can be equal such that the primer sits flush with the projectile casing. The positioning mechanism presses the primer into the primer pocket until it reaches this second depth, ensuring it is properly seated without going too deep. The mechanism includes a blocking component that prevents the primer from moving past this desired depth.

Figure 7B:
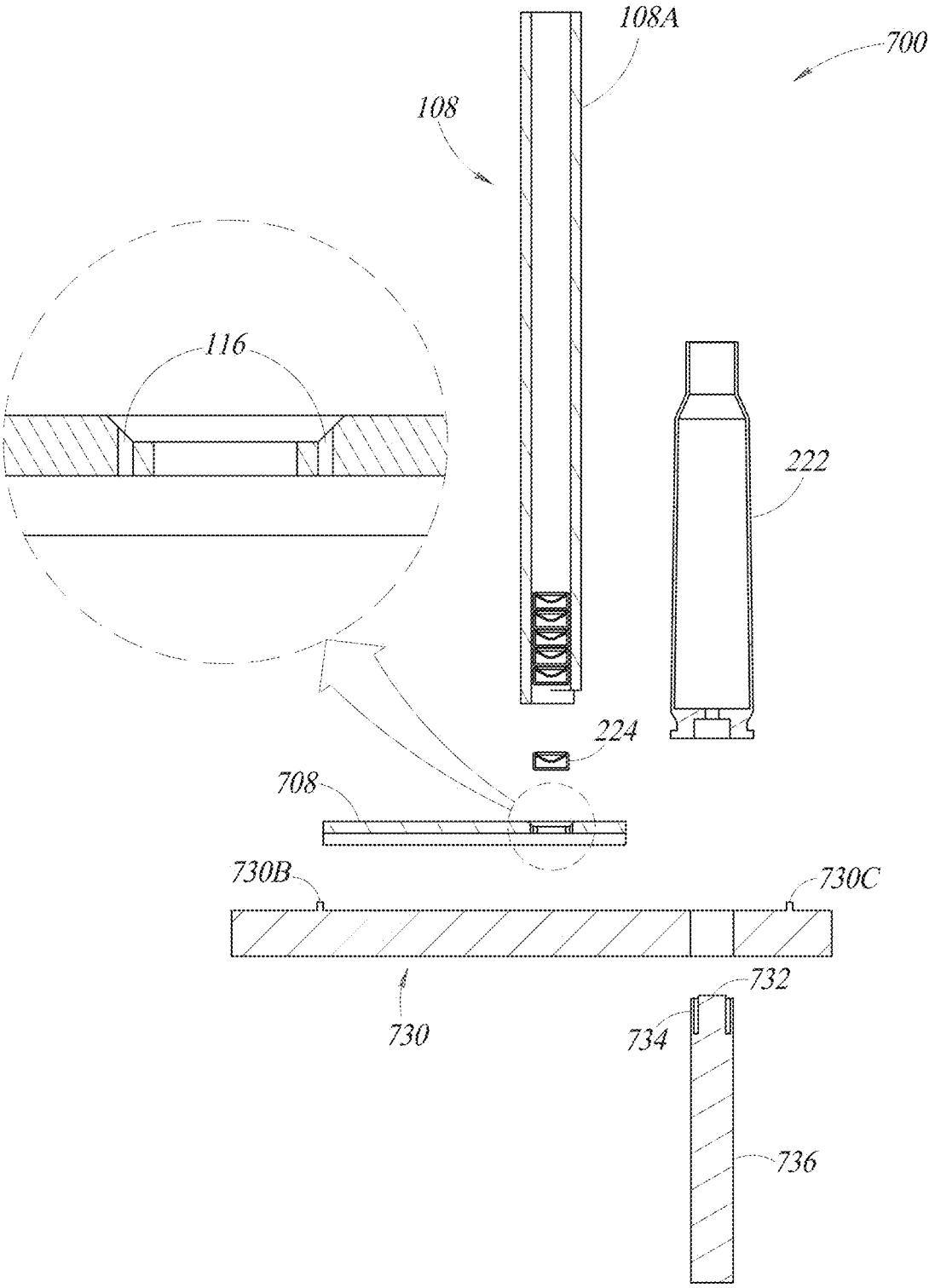

As shown in FIG. 7B, the shuttle can include beveled or chamfered edges surrounding a central receiving hole. These beveled edges guide the primer into the hole for alignment but prevent it from falling through, as the hole is narrower than the outer flange of the primer. Once positioned in the shuttle, the primer can be pushed upward into the primer pocket by a central primer rod extending through the hole. For example, the primer may have a flange diameter of approximately 0.175 inches, while the shuttle hole may have a top bevel leading to a cylindrical bore of about 0.165 inches, allowing the primer to seat stably in the shuttle while enabling the central rod to pass through and drive the primer into place.

Figure 7C:
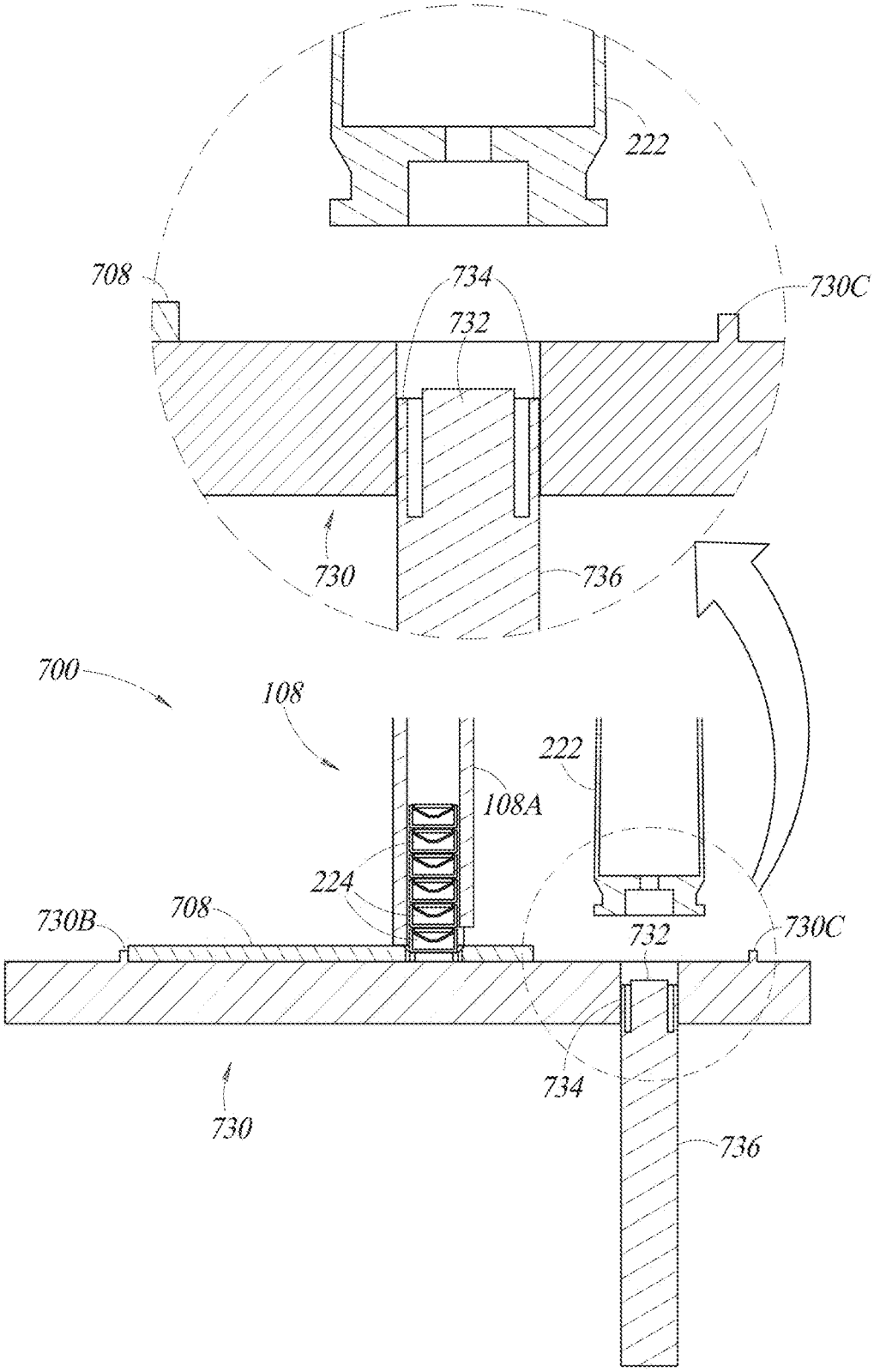
Figure 7D:
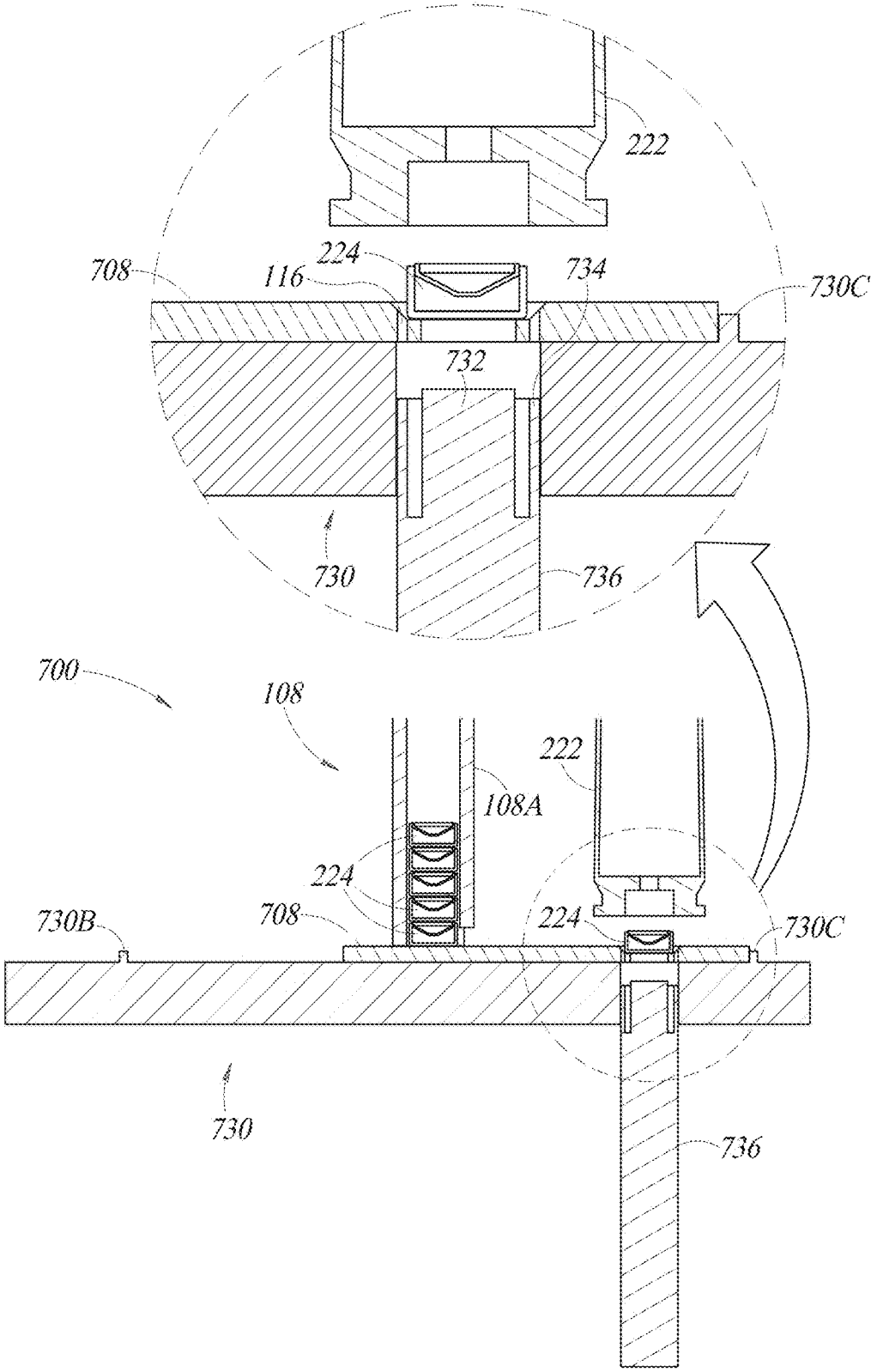
Figure 7E:
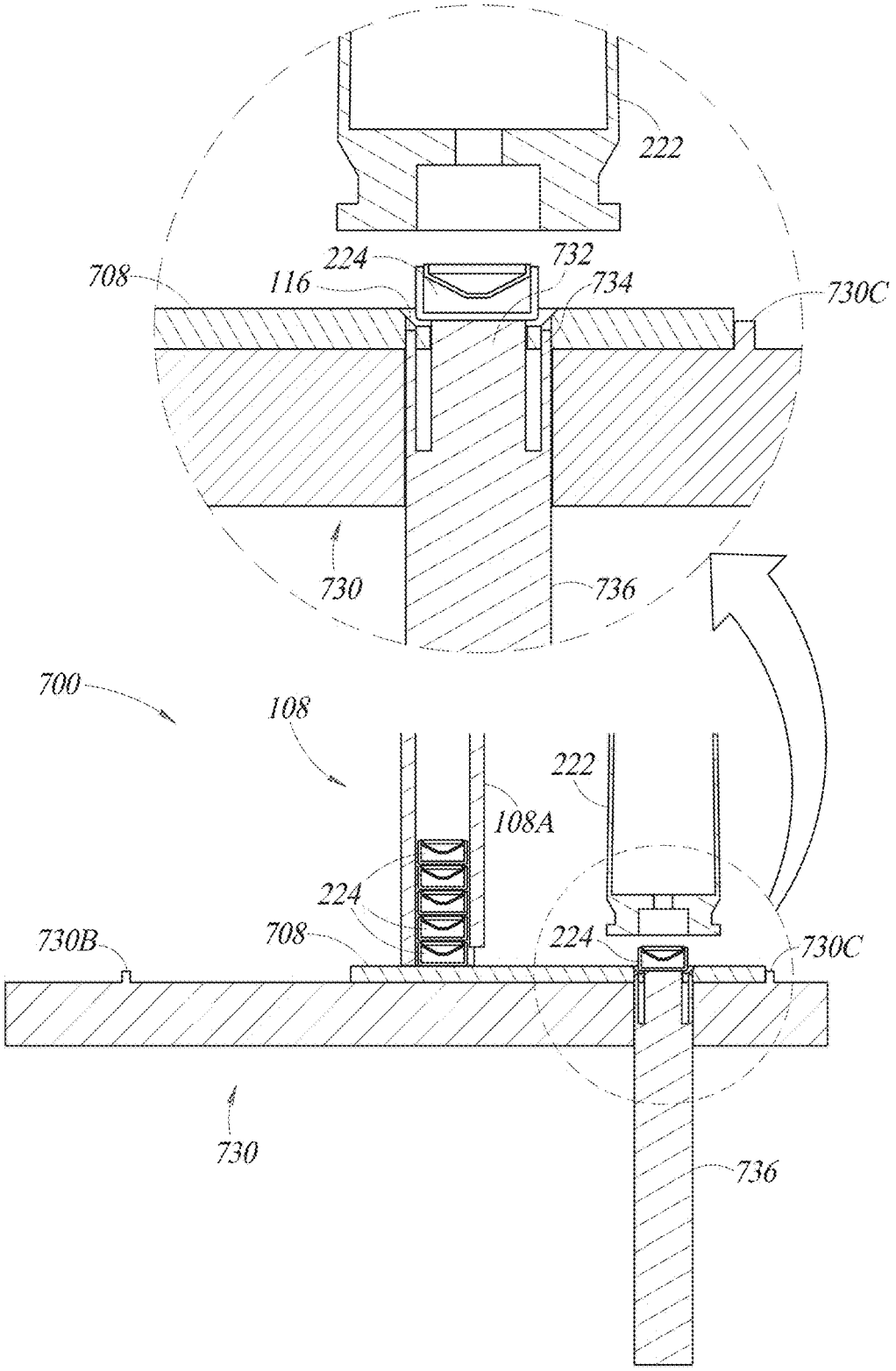
Figure 7F:
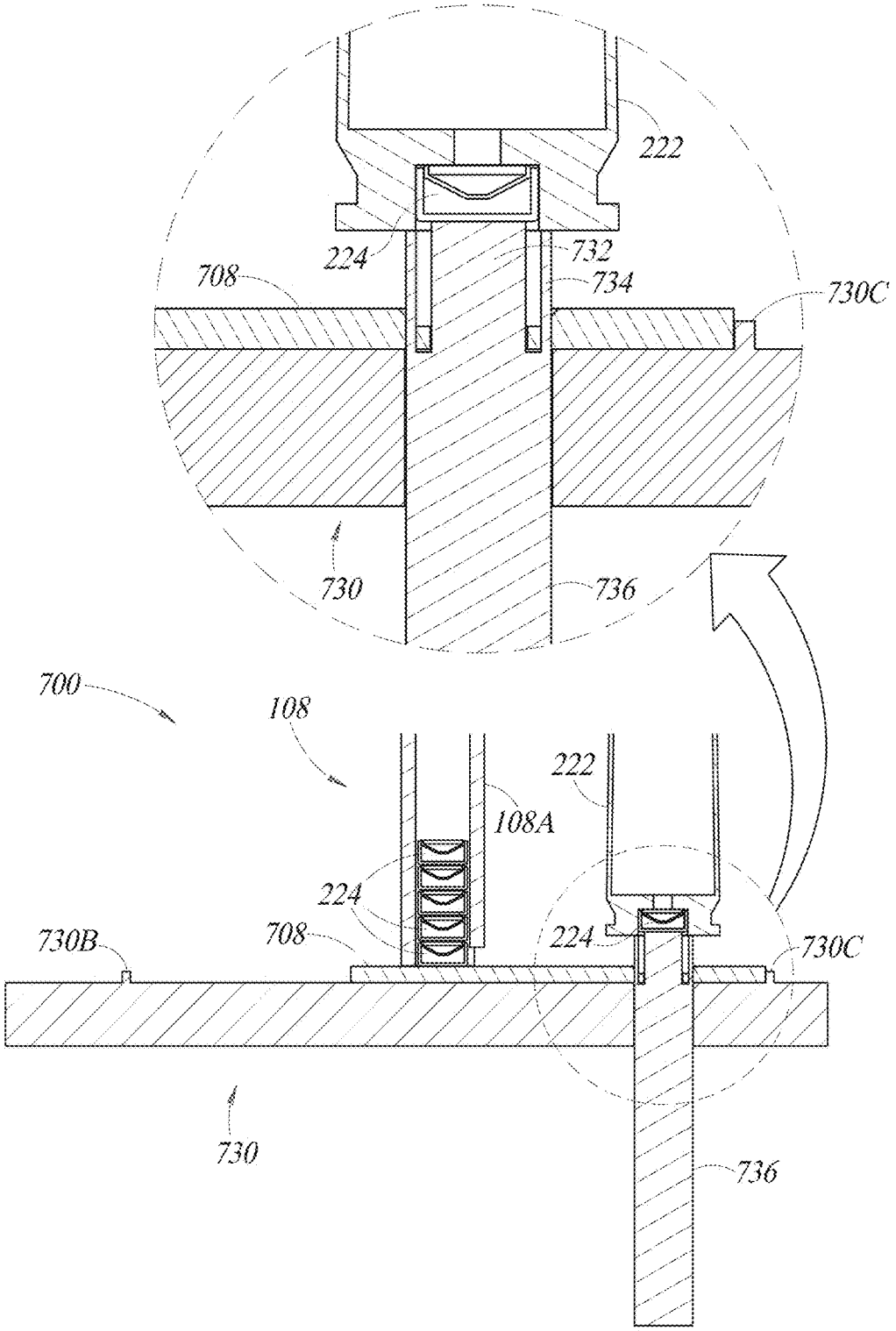
Figure 7G:
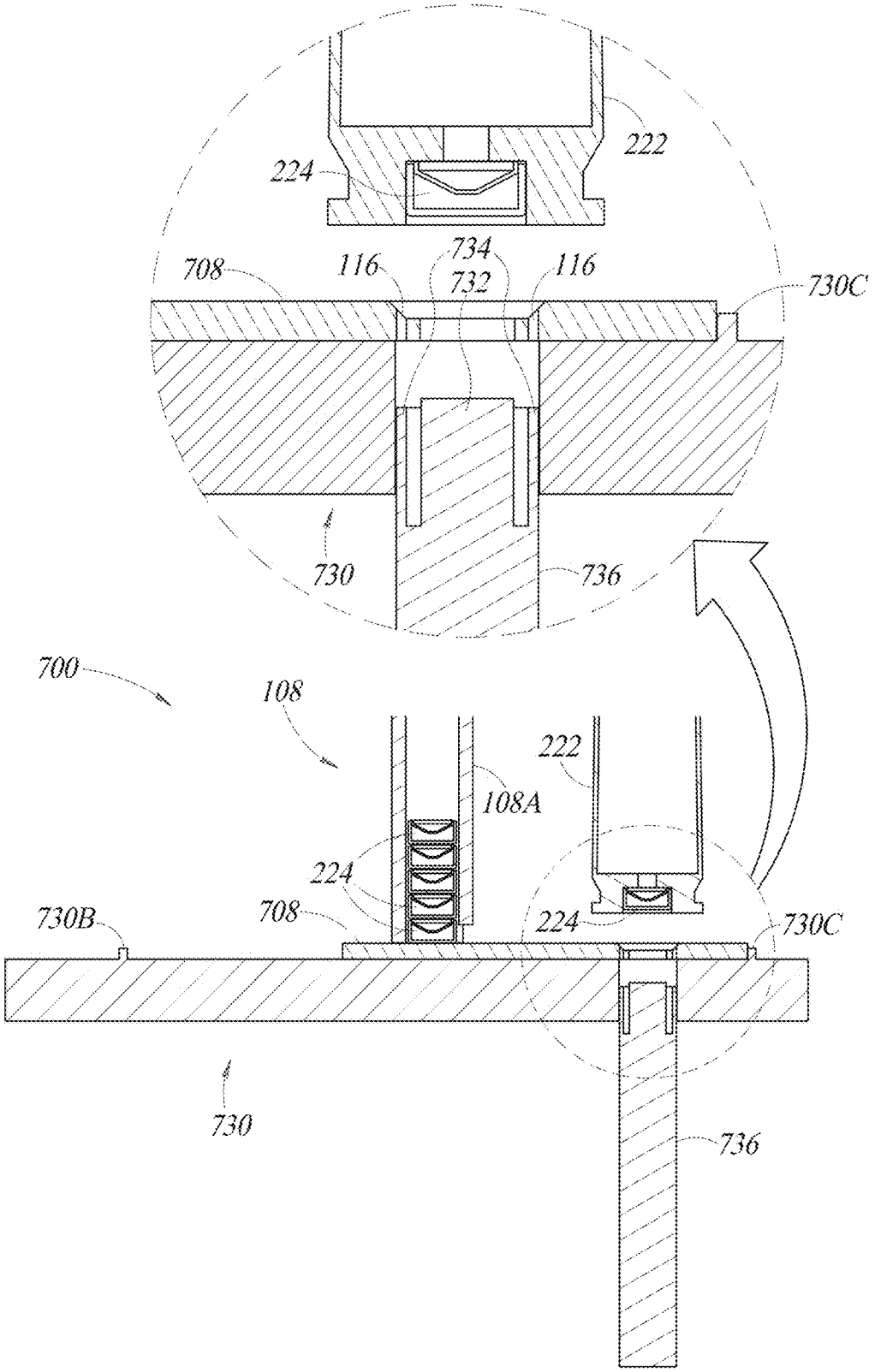

As an example, FIG. 7C illustrates to receive a primer 224 from primer queue 108A, such as when a shuttle 708 is in a second position. As an example, FIGS. 7D-7G illustrates using a shuttle 708 to align a primer 224 with primer seating component 110 and casing 222, such as when a shuttle 708 is returned to a first position or placed a third position.

In at least one embodiment, system 700 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 700 can position, locate, or otherwise move a primer into a projectile casing. For example, a system 700 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the projectile casing. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 700 is, is included in, and/or otherwise includes systems illustrated in FIGS. 1A-16B to position, locate, or otherwise move a primer into a projectile casing by indexing from the base of the projectile casing and/or otherwise perform operations described herein. In at least one embodiment, system 700 performs one or more processes illustrated in FIGS. 1A-17, such as process 1700 to position, locate, or otherwise move a primer into a projectile casing by indexing from the base of the projectile casing and/or otherwise perform operations described herein.

Figure 7H:
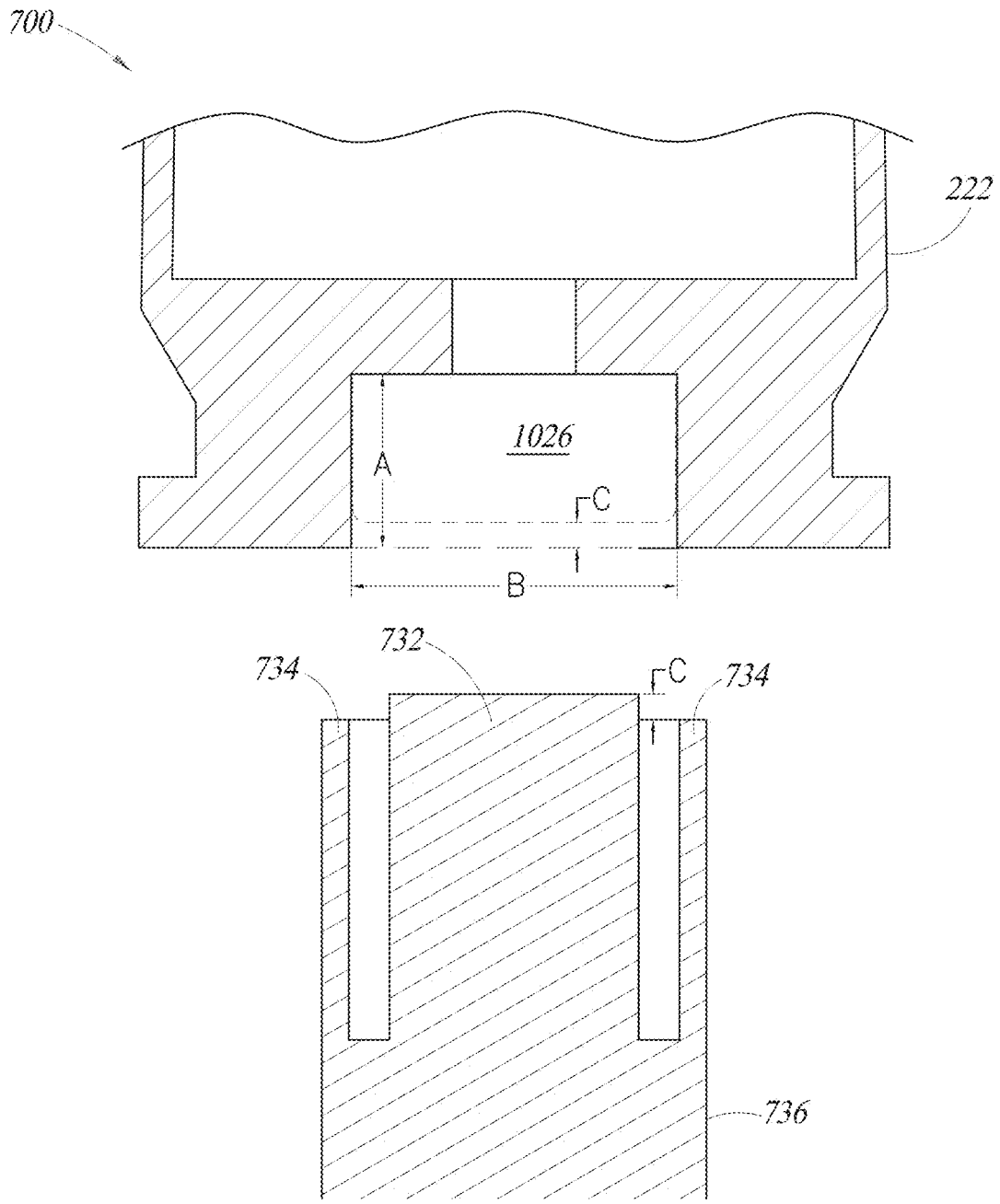

FIG. 7H may illustrate a primer pocket 1026 of a casing 222 and primer seating component 110. As an example, primer seating component 110 includes a primer rod 732, one or more prongs 734, and a base 736 (e.g., outer cylinder). System 700 may include projectile casing 222, where projectile casing includes a primer pocket 1026. Primer pocket 1026 includes one or more dimensions, such as diameter (e.g., "B") and depth (e.g., "A"). A desired depth to seat a primer (e.g., user preference in manufacturer recommended range) may be illustrated by the distance between "B" and "C." As an example, an outside of a seated primer would be pushed until aligned with "C."

Figure 7I:
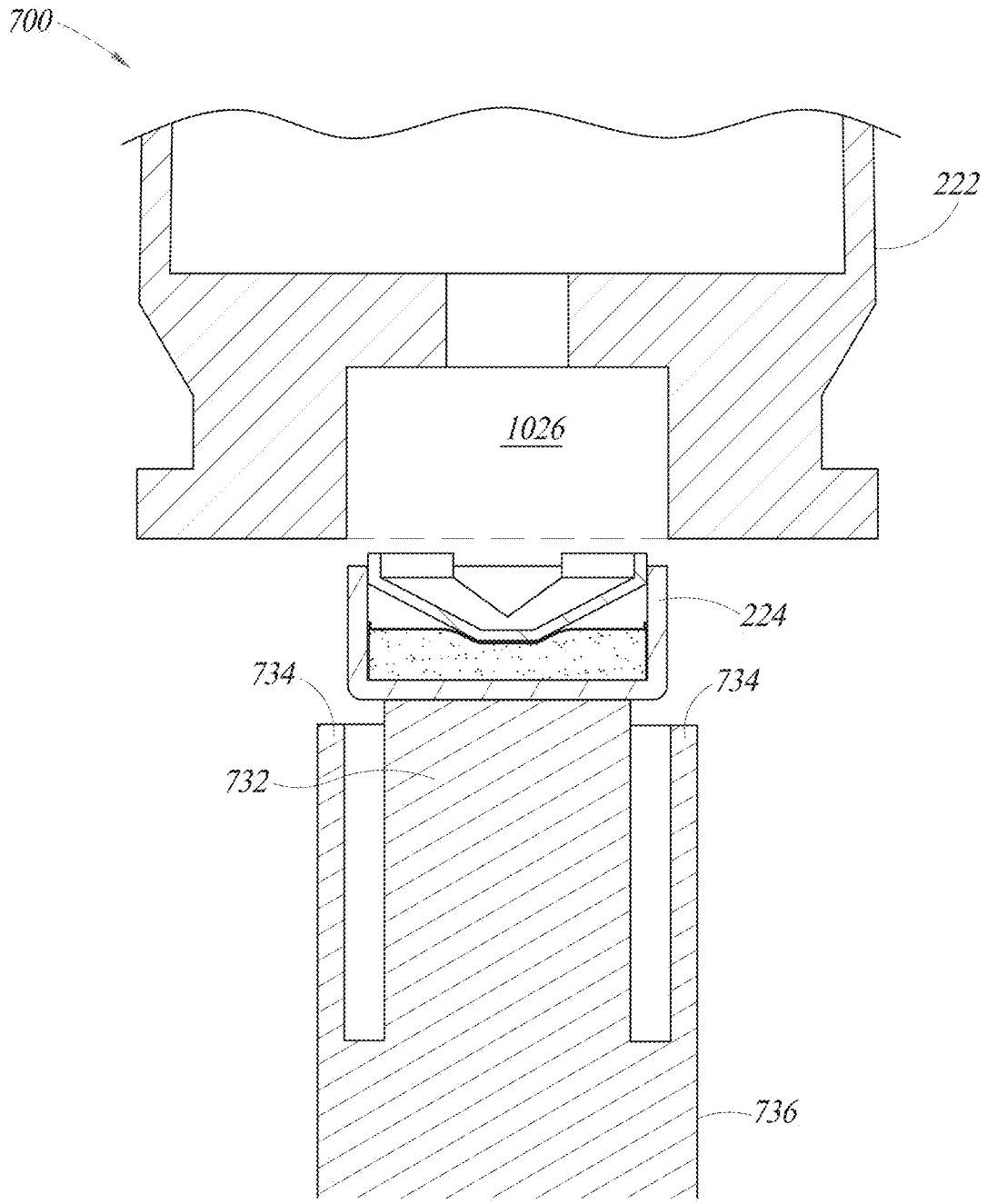

FIG. 7I may illustrate a primer 224, primer pocket 1026 of a casing 222, and primer seating component 110. As an example, primer seating component 110 includes a primer rod 732, one or more prongs 734, and a base 736 (e.g., outer cylinder). System 700 may include projectile casing 222, primer pocket 1026 (e.g., primer recess), and primer 224. Primer 224 may be aligned with a primer pocket 1026, such as by using one or more primer seating components illustrated in FIGS. 1A-6B.

Figure 7J:
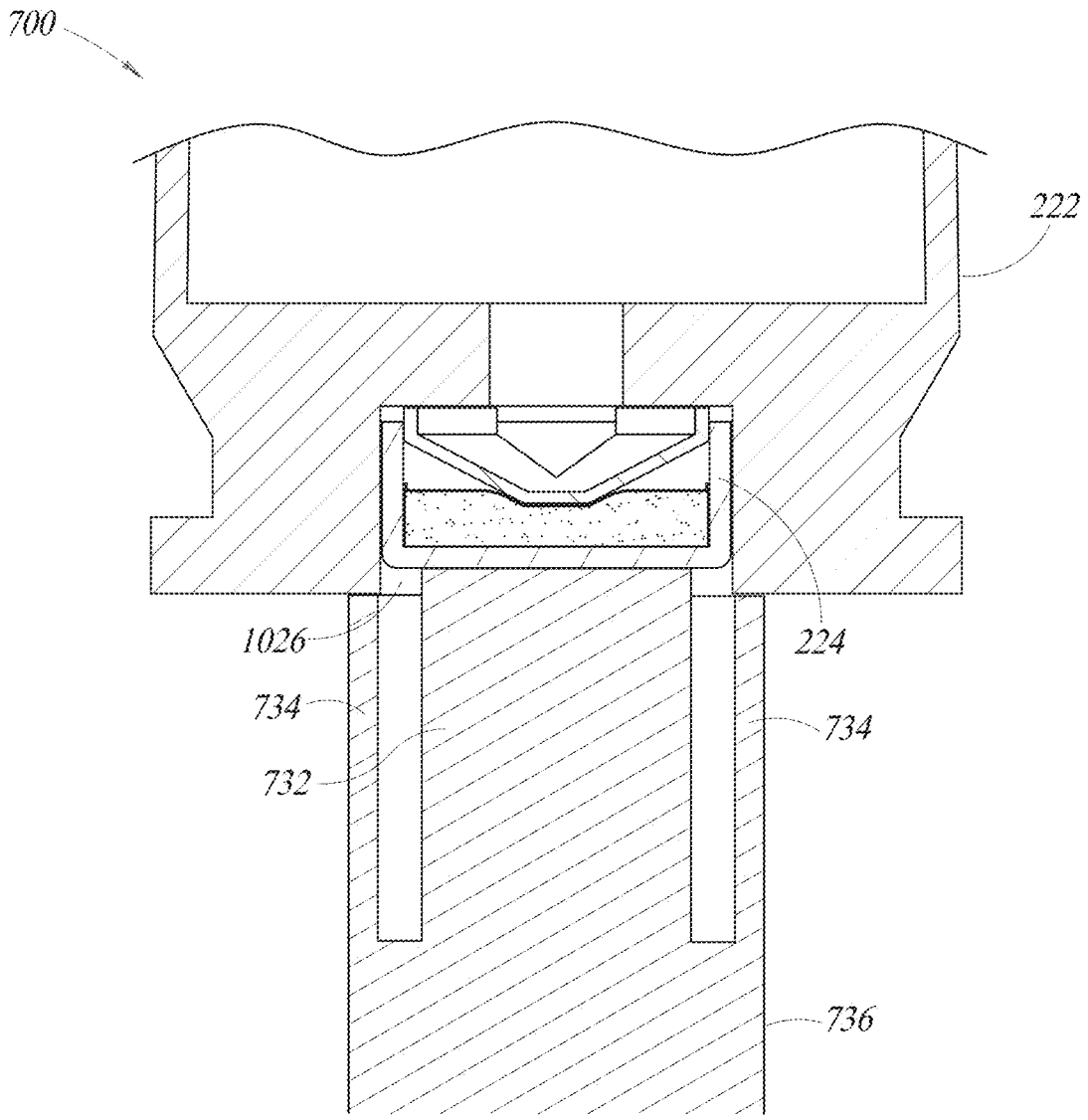

FIG. 7J may illustrate to seat a primer 224 using one or more prongs 734 of a primer seating component 110. System 700 may include projectile casing 222, primer pocket 1026

(e.g., primer recess), and primer 1024. System 700 may illustrate a primer prior to setting (e.g., crushing) anvils 1030 to seat a primer. As an example, primer may be in a projectile casing, but not yet at a desire depth due to anvils 1030 not yet being set (e.g., crushed and/or pressed). As another example, a desired amount of setting anvils may be within a range, such that a user (e.g., marksman) may set a depth to vary between a level of crush illustrated in 1004 and 1006.

Figure 7K:
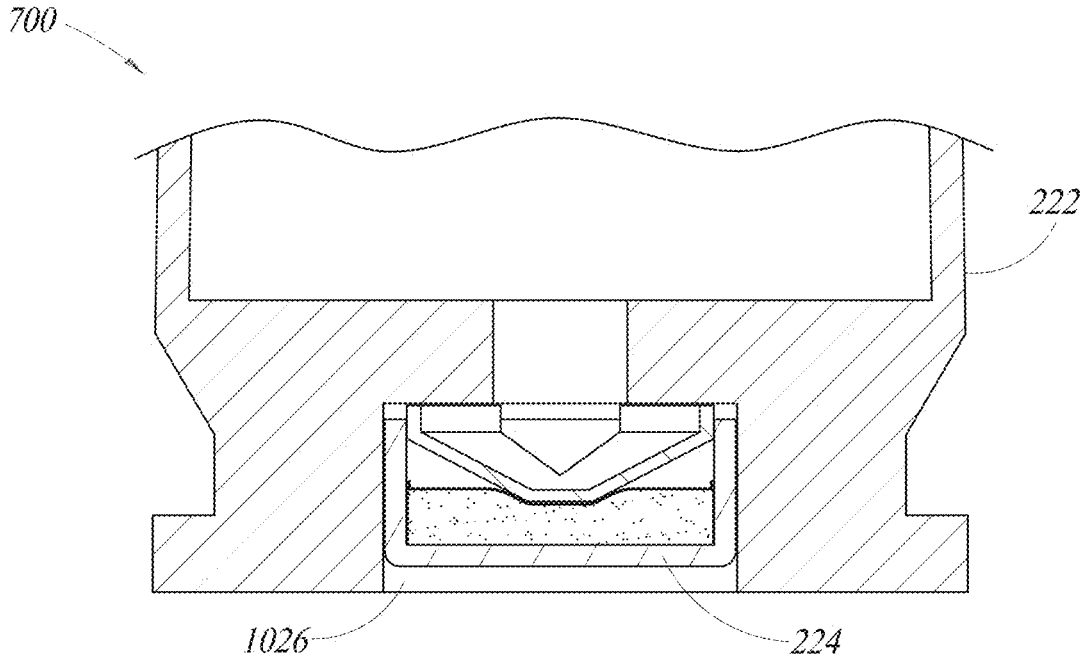
Figure 7K:
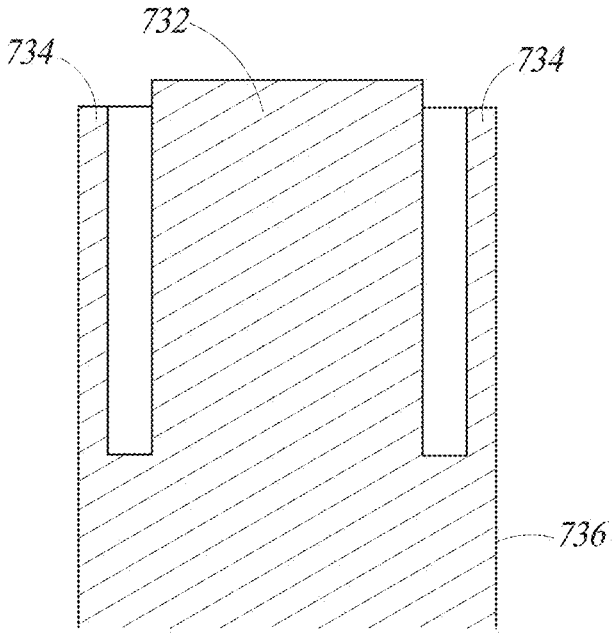
Figure 8A:
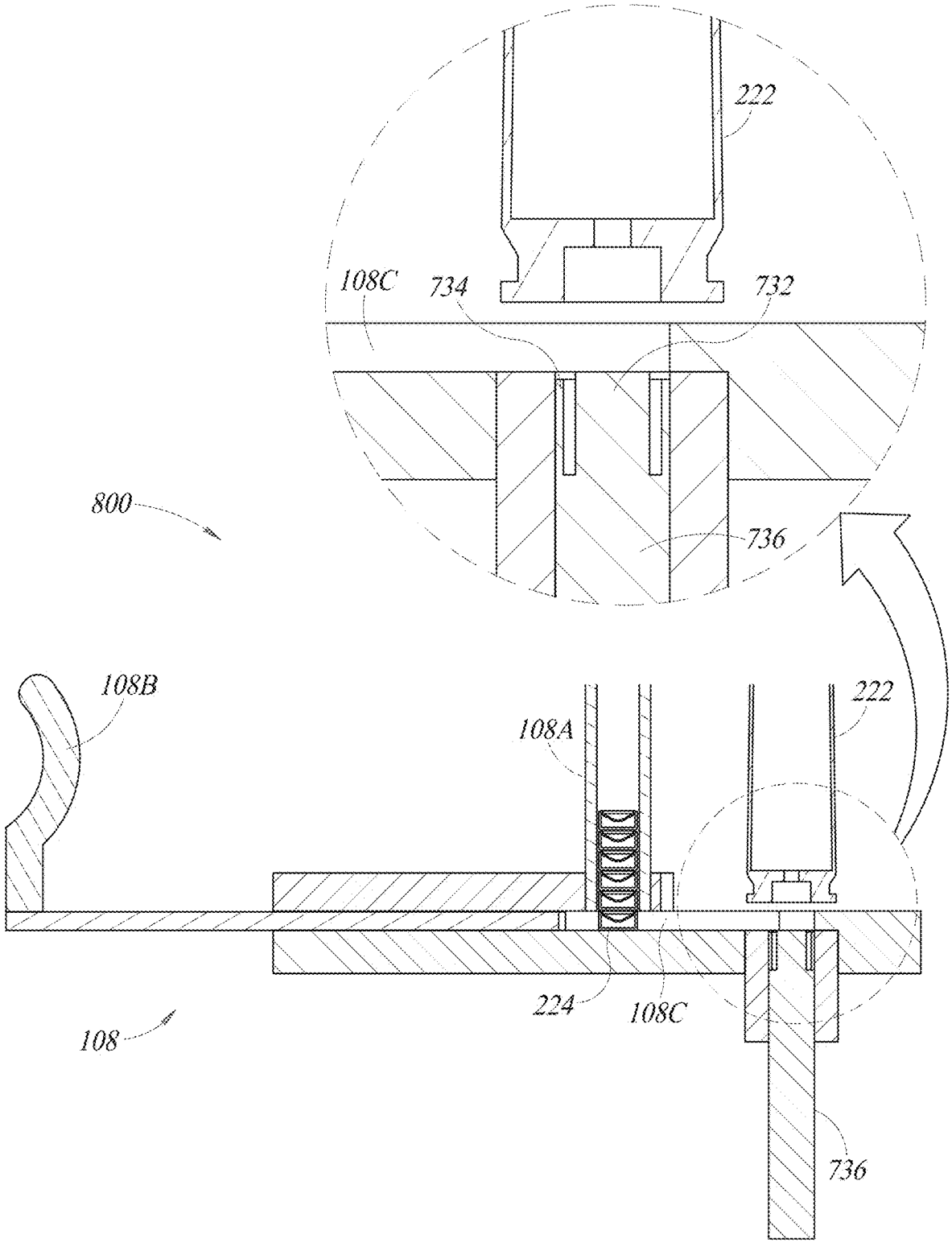
FIGS. 8A-8E illustrate cross-sectional views of a system to align a primer and set a primer by indexing depth from a casing, in accordance with at least one embodiment.
Figure 8B:
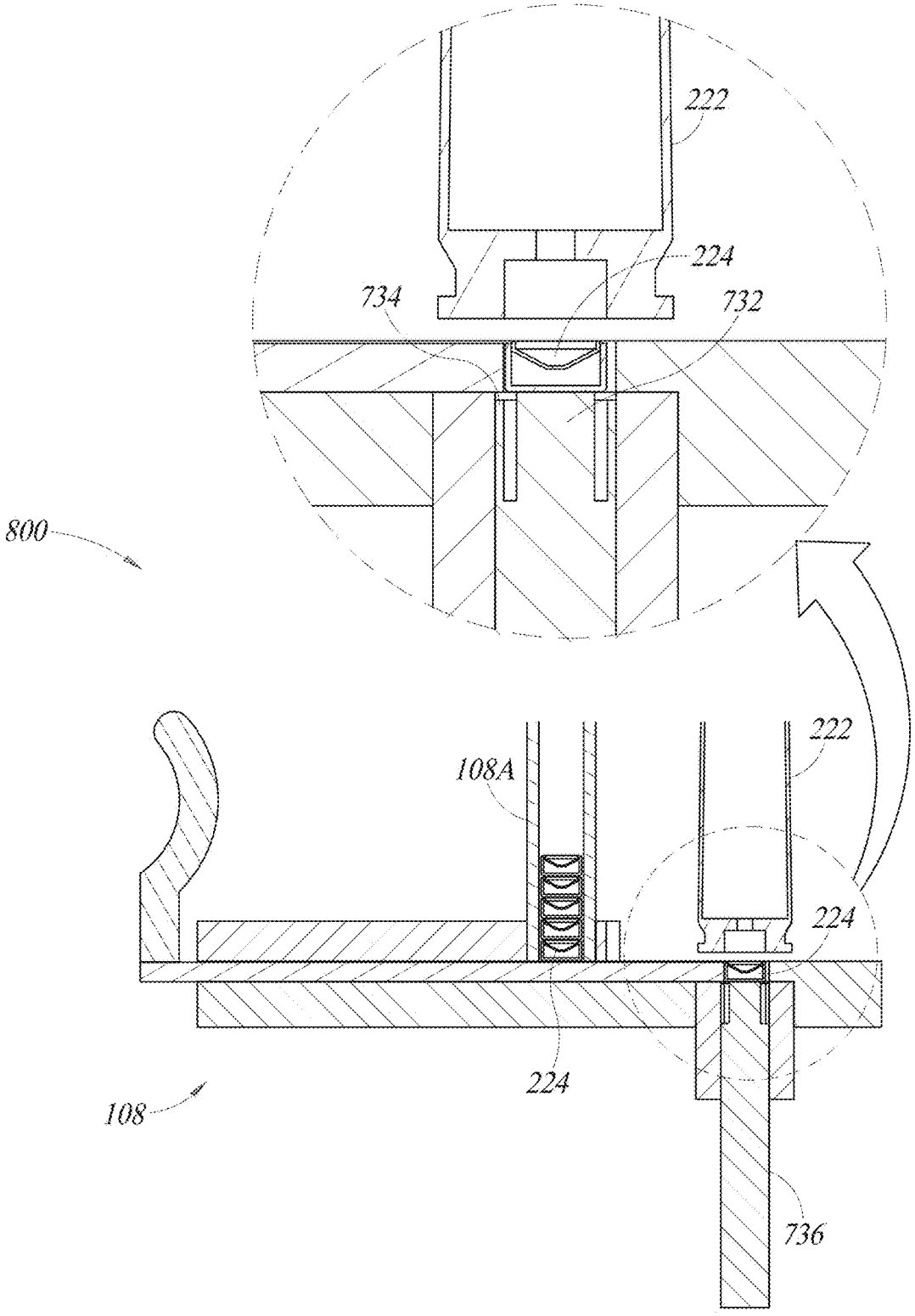
Figure 8C:
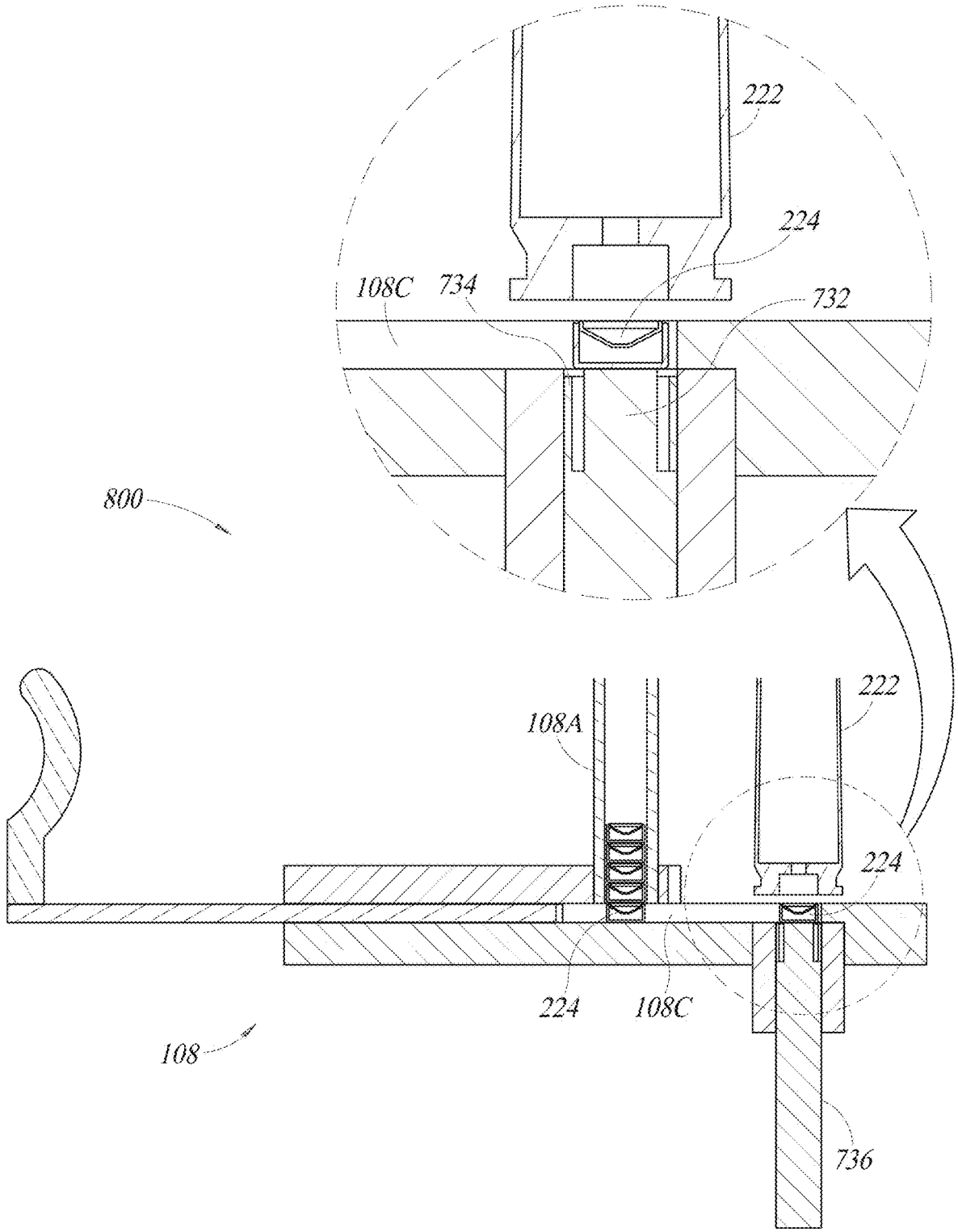
Figure 8D:
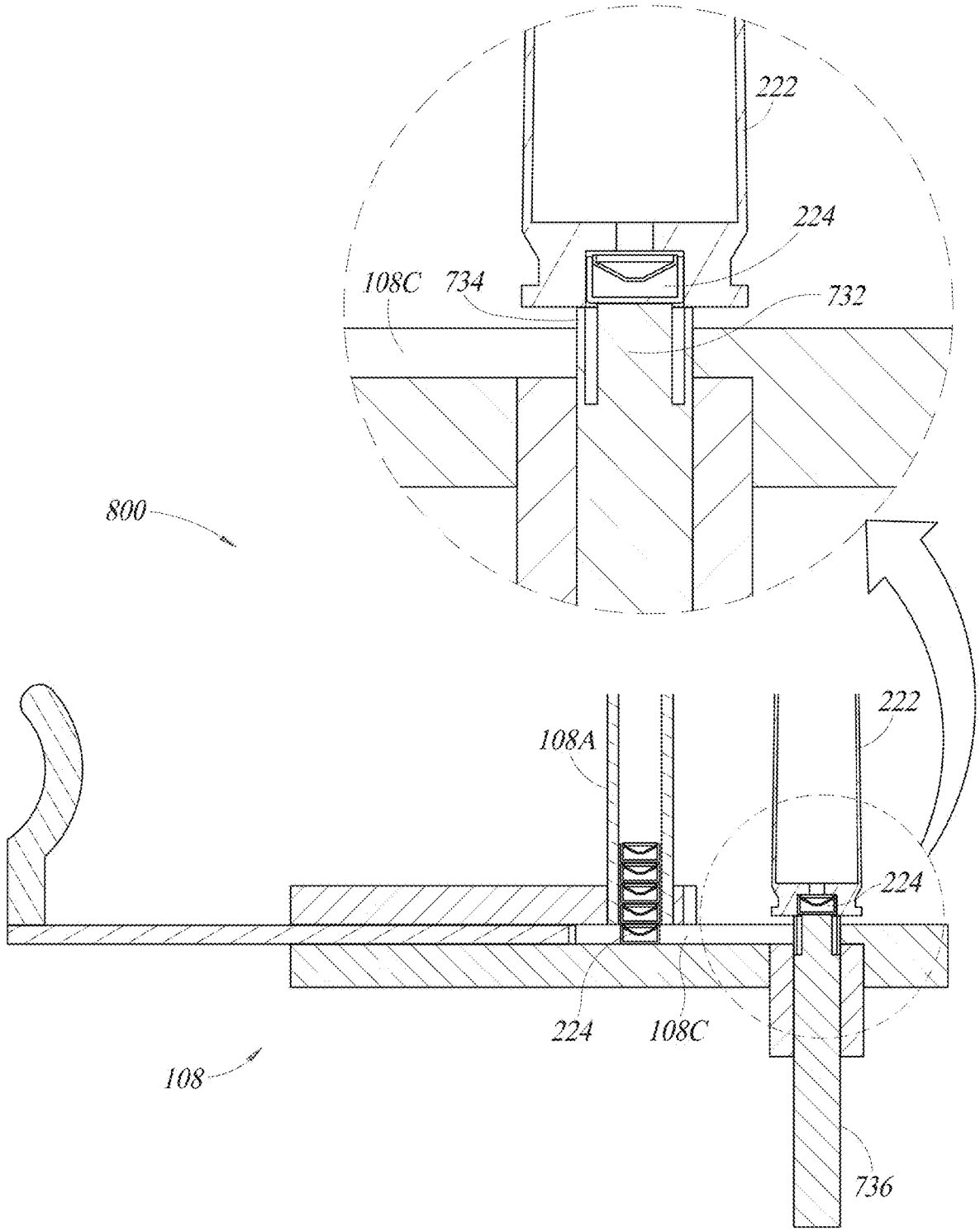
Figure 8E:
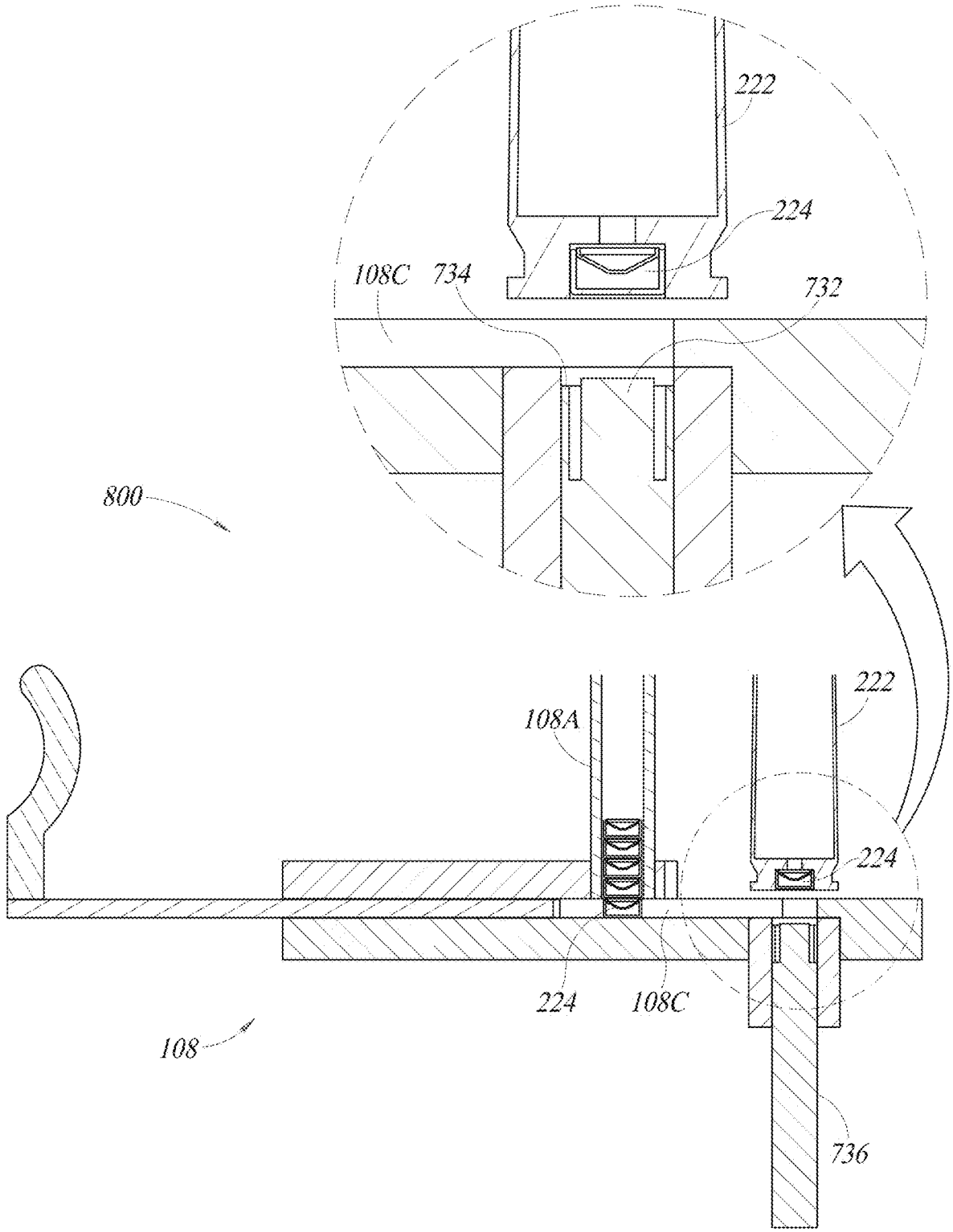

FIG. 7K may illustrate a primer 224 seated in a casing 222 using one or more prongs 734 of a primer seating component 110. System 700 may include projectile casing 222, primer pocket 1026 (e.g., primer recess), and primer 1024. System 700 also may illustrate a primer seating component 110 (as illustrated in FIGS. 9A-E) seating primer according to a depth, such as to align with "C." Anvils 1030 illustrated in system 700 may illustrate a desired amount of setting of a primer 1024. In some embodiments, the prongs can extend laterally beyond the outer diameter of the primer pocket to ensure that the prongs contact the base of the casing rather than entering the pocket, thereby preventing over-insertion of the primer, e.g., the central portion of the primer rod. For example, the width spanned by the prongs can be between 1% and 20% greater than the outer diameter of the primer pocket, depending on geometry.

In some embodiments, the prongs can be shaped and dimensioned to extend partially into the primer pocket while also including a contact surface that engages the base of the projectile casing to limit insertion depth. For example, a prong may have a tapered profile with a distal tip that extends 0.030 inches into a primer pocket having a depth of 0.120 inches, while a shoulder portion of the prong contacts the base of the casing when the central rod advances to seat the primer. The shoulder may be positioned 0.090 inches from the distal tip of the central rod, thereby controlling the seating depth of the primer to 0.090 inches from the base of the casing.

A difference in longitudinal length between the central rod and the prongs can be selected to produce a desired primer seating depth. For example, if the central rod extends 0.005 inches beyond the prongs, the primer can be seated approximately 0.005 inches below the base plane of the casing, assuming contact is made when the prongs abut the casing base. This depth can correspond to a desired primer crush.

FIGS. 8A-8E illustrates cross-sectional views of a system 800 to align a primer and set a primer by indexing depth from a casing, in accordance with at least one embodiment. In at least one embodiment, system 800 includes primer queue component 108 (e.g., primer queue 108A, primer lever 108B and/or D, primer channel 108C), primer seating component 110, one or more components to secure a casing 222 (e.g., attachment grooves 114), inner cylinder recess, one or more prong holes 116, outer cylinder 118 (e.g., a cylinder with one or more prongs 734), inner cylinder 214 (e.g., one or more primer rods 732), one or more prongs 220, projectile casing 222, primer 224, stopping mechanism 226 (e.g., one or more prongs contacting with a casing), primer rod 732, one or more prongs 734, a primer rod base 736 (e.g., outer cylinder 118 with one or more prongs 734 attached) and/or combinations thereof.

For example, system 800 may include a primer queue component 108, primer seating component 110, and rail component 730. A primer queue component 108 may include a primer queue 108A, primer lever 108B and D, primer channel 108C, or combinations thereof. A primer channel 108C may receive (e.g., using gravity) a primer 224 when a lever 108B and/or D is moved into a second position. Once a primer is received in a primer channel 108C, lever 108B and D may be moved to a first or third position such that a primer is aligned between a casing 222 and a primer rod 732, such as by using a primer rod in a lowered position that a primer is received in a recess (e.g., basket). A lever 108B and D may move between one or more stops (e.g., forward stop 730B and rear stop 730C) along a primer channel 108C. As an example, when a shuttle 708 is in a first or third position, a shuttle 708 makes contact with a rear stop 730C and aligns a primer with a primer pocket of casing 222 and/or a primer rod 732 (e.g., after a primer was previously loaded). As an example, when a lever 108B and D is in a second position, a lever 108B and D allows space to receive a primer 224 (e.g., using gravity). Then once a primer is loaded within a primer channel 108C, a lever 108B and D may be returned to a first or third position (e.g., in contact with a rear stop 730C) to align a primer 224 with a casing 222 and primer rod 732.

Once a primer queue component 108 aligns a primer with a casing 222 and a primer rod 732, a primer seating component 110 may seat a primer 224. As an example, a primer seating component 110 may include primer rod 732, one or more prongs 734, and/or a primer rod base 736. As an example, herein an inner cylinder 214 may refer to a primer rod 732. As an example, herein an outer cylinder 118 may refer to a primer rod base 736 fixed to one or more prongs 734. In at least one embodiment, system 700 includes one or more components to secure a casing, such as those illustrated herein. In at least one embodiment, adhesive or threading may be used to connect and/or adjust a primer rod 732 with respect to one or more prongs 734 and/or a primer rod base 736. As an example, FIG. 8B may illustrate a lever 108B and D in a first and/or third position. As an example, FIGS. 8A and 8C-8E may illustrate a lever 108B and D in a second position.

In at least one embodiment, system 800 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 800 can position, locate, or otherwise move a primer into a projectile casing. For example, a system 800 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the projectile casing. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 800 is, is included in, and/or otherwise includes systems illustrated in FIGS. 1A-16B to position, locate, or otherwise move a primer into a projectile casing by indexing from the base of the projectile casing and/or otherwise perform operations described herein. In at least one embodiment, system 800 performs one or more processes illustrated in FIGS. 1A-17, such as process 1700 to position, locate, or otherwise move a primer into a projectile casing by indexing from the base of the projectile casing and/or otherwise perform operations described herein.

FIGS. 9A-9L illustrate schematic and cross-sectional views of a system, including a spring component, to index depth of a primer from a casing, in accordance with at least one embodiment. In at least one embodiment, system 900 includes a spring component (e.g., spring 906 and washer 904, which can also be referred to as a collar), primer queue component 108 (primer queue 108A, primer rod and/or lever 108B, primer channel 108C), primer seating components (e.g., outer cylinder 902, one or more prongs 734, spring component(s), one or more prong holes 116, one or more stop components 908, and/or primer rod 732), casing 222, and/or primer 224 and/or one or more parts described herein.

Figure 9A:
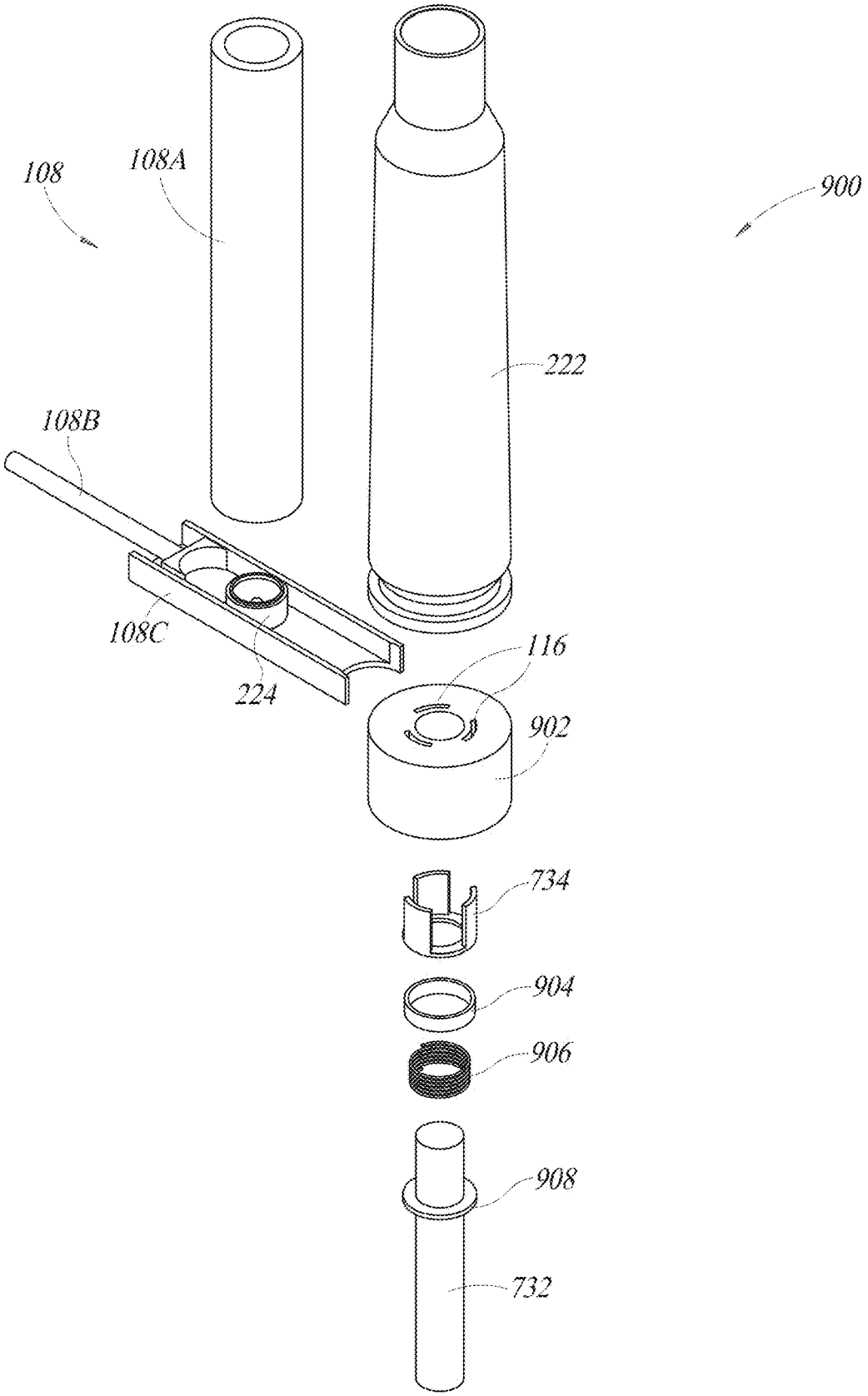
FIGS. 9A-9L illustrate schematic and cross-sectional views of a system, including a spring component, to index depth of a primer from a casing, in accordance with at least one embodiment.
Figure 9B:
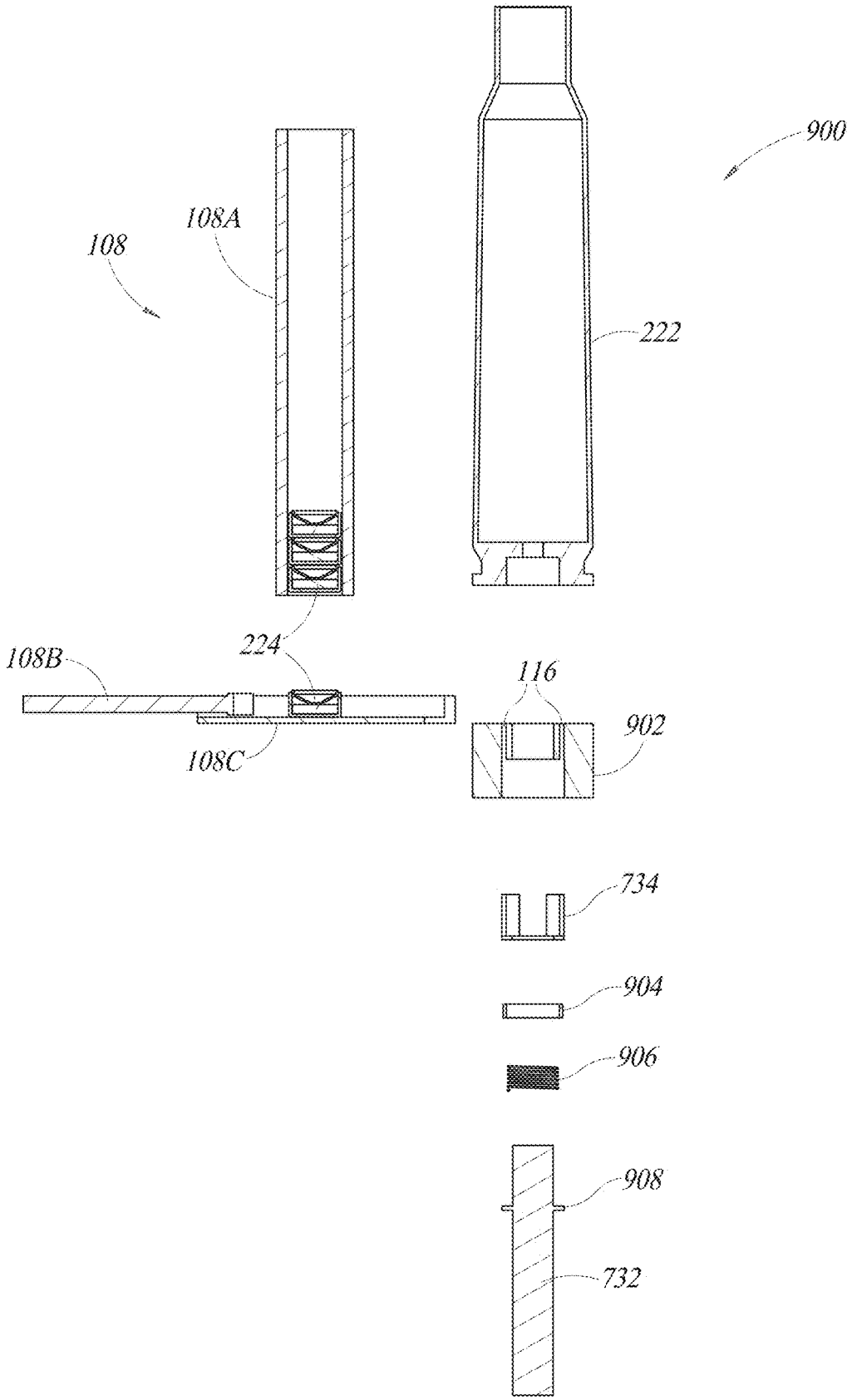
Figure 9C:
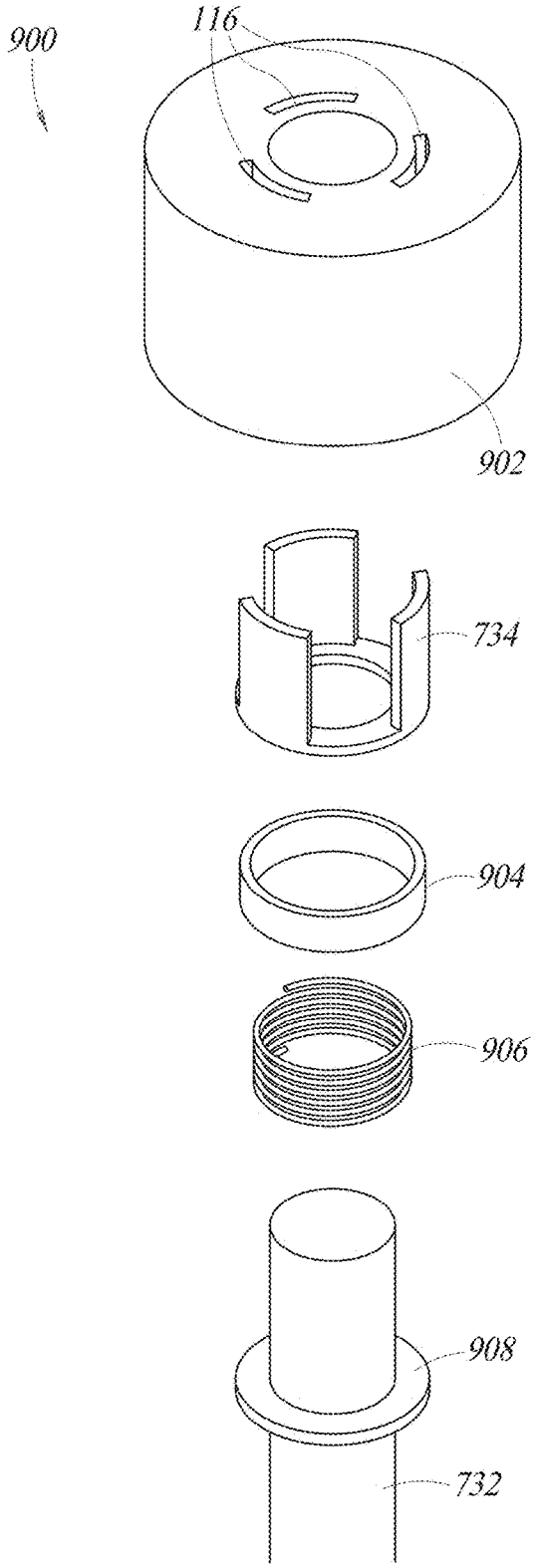

FIGS. 9A and 9C illustrate a schematic view of system 900 which includes a spring component, according to at least one embodiment. System 900 may include a spring component to assist with positioning a primer rod 732 to seat a primer 224, which may improve fluidity of movements and/or alignment of primer. System 900 may use a primer rod attached (e.g., using adhesive and/or threading) to a stop 908, such that a primer rod may be interchangeable with using one or more prongs 734. As an example, a spring when compressed causes one or more prongs to be full pressed into outer cylinder 902, such that prongs extend beyond an outer cylinder to make contact with casing and a primer rod 732 seats a primer at a preferred depth. A lever and/or other mechanism may control primer rod 732, moving it upward into position when a primer 224 is aligned. System 900 may include shuttling a primer 224 into a position, such as by using one or more primer queue components 108 illustrated herein.

FIG. 9B illustrates a cross-sectional view of system 900 which includes a spring component, according to at least one embodiment. System 900 may include a spring component to assist with positioning a primer rod 732 to seat a primer 224, which may improve fluidity of movements and/or alignment of primer.

Figure 9D:
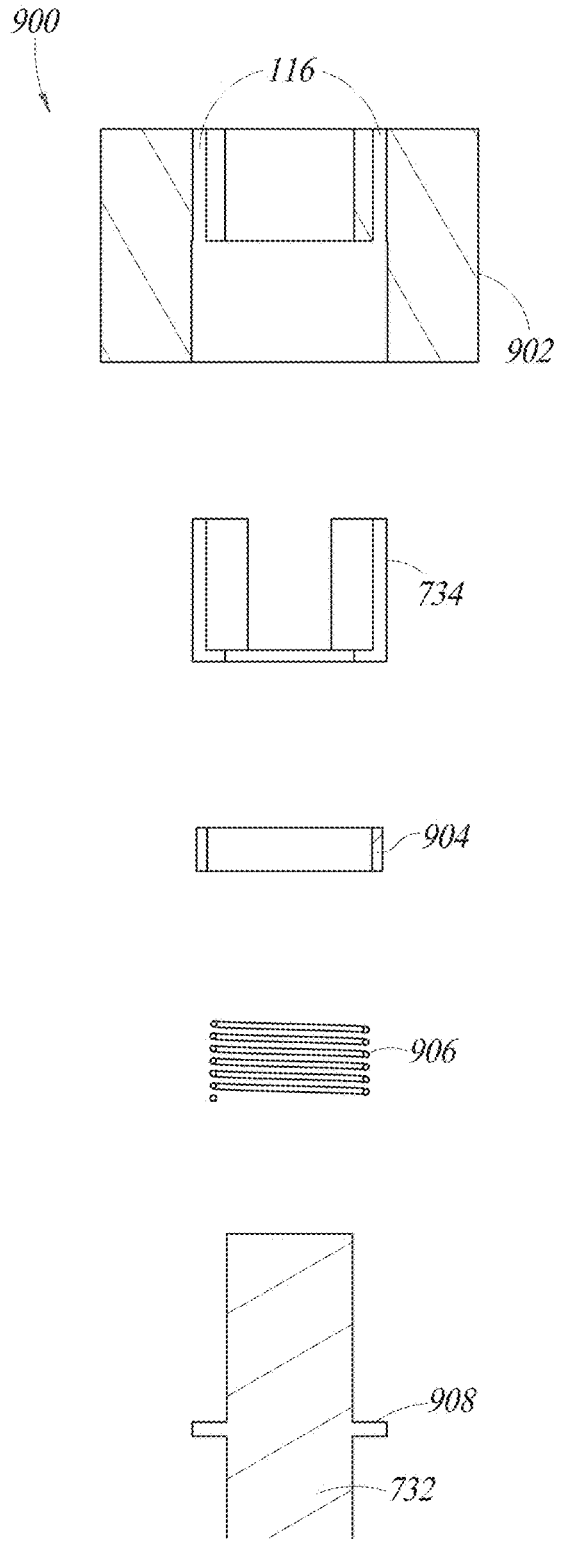

FIGS. 9C and 9D illustrate a schematic and cross-sectional view of system 900 which includes a primer seating component 110 to index a depth to seat a primer from a base of a casing, according to at least one embodiment. As an example, prong holes 116 may have a height less than the height of prongs 734.

Figure 9E:
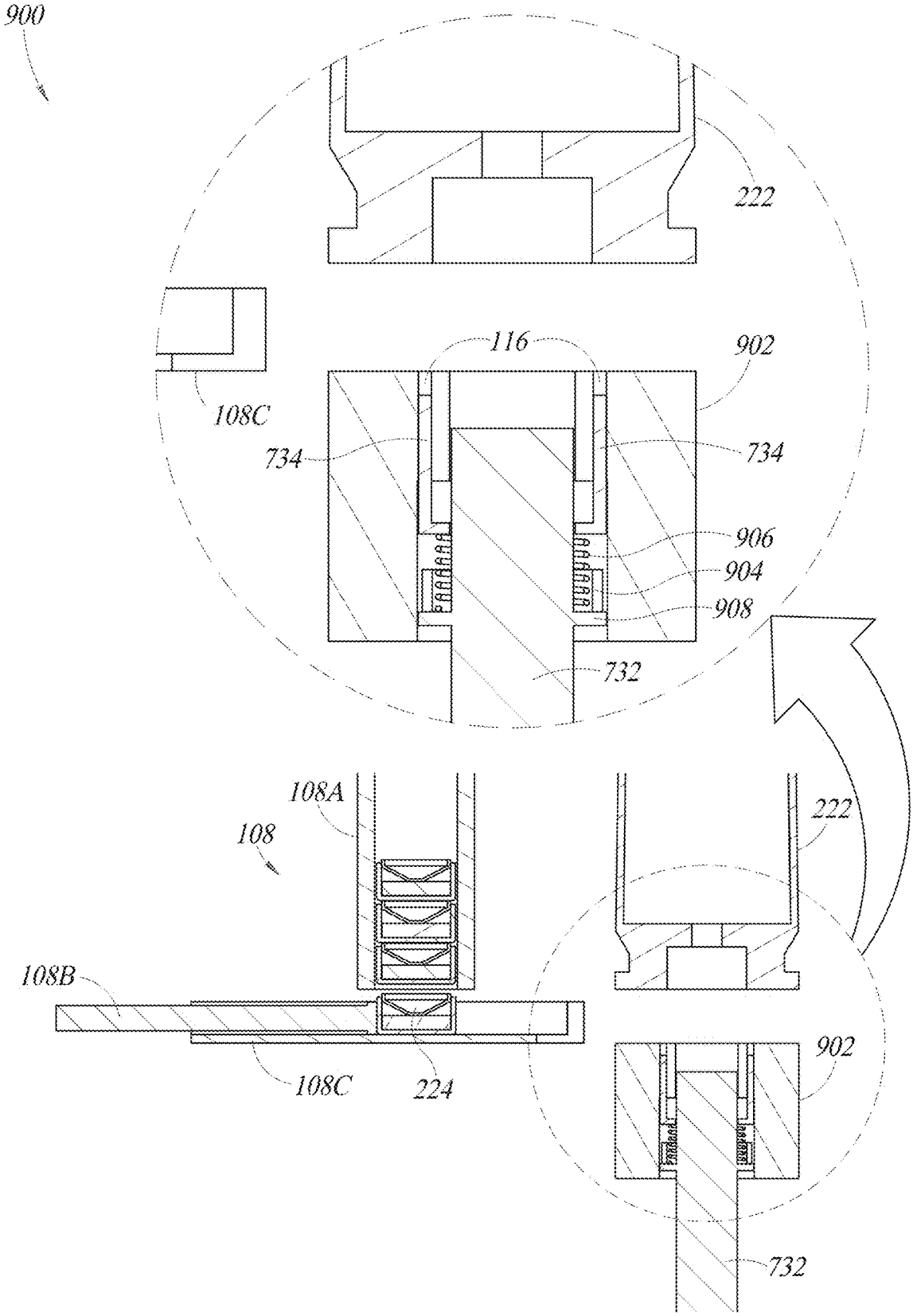

FIG. 9E illustrates a cross-sectional view of a system, including a spring component, to index depth of a primer from a casing, in accordance with at least one embodiment. As an example, FIG. 9E may illustrate a primer queue component 108 lever 108B being in a second position. System 900 includes a securing mechanism of a casing, such as those described herein (e.g., attachment grooves 114, see FIG. 1).

Figure 9F:
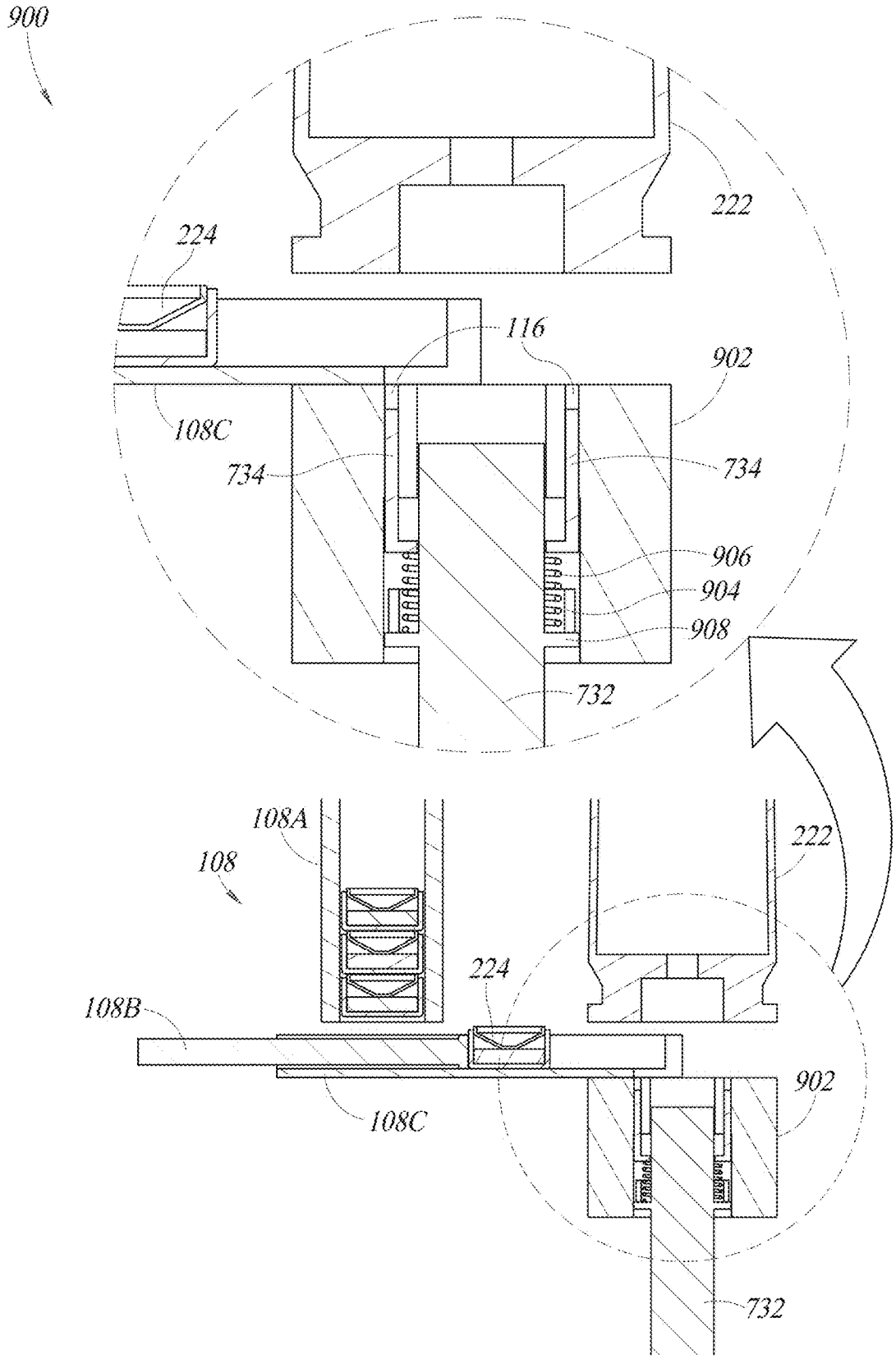
Figure 9G:
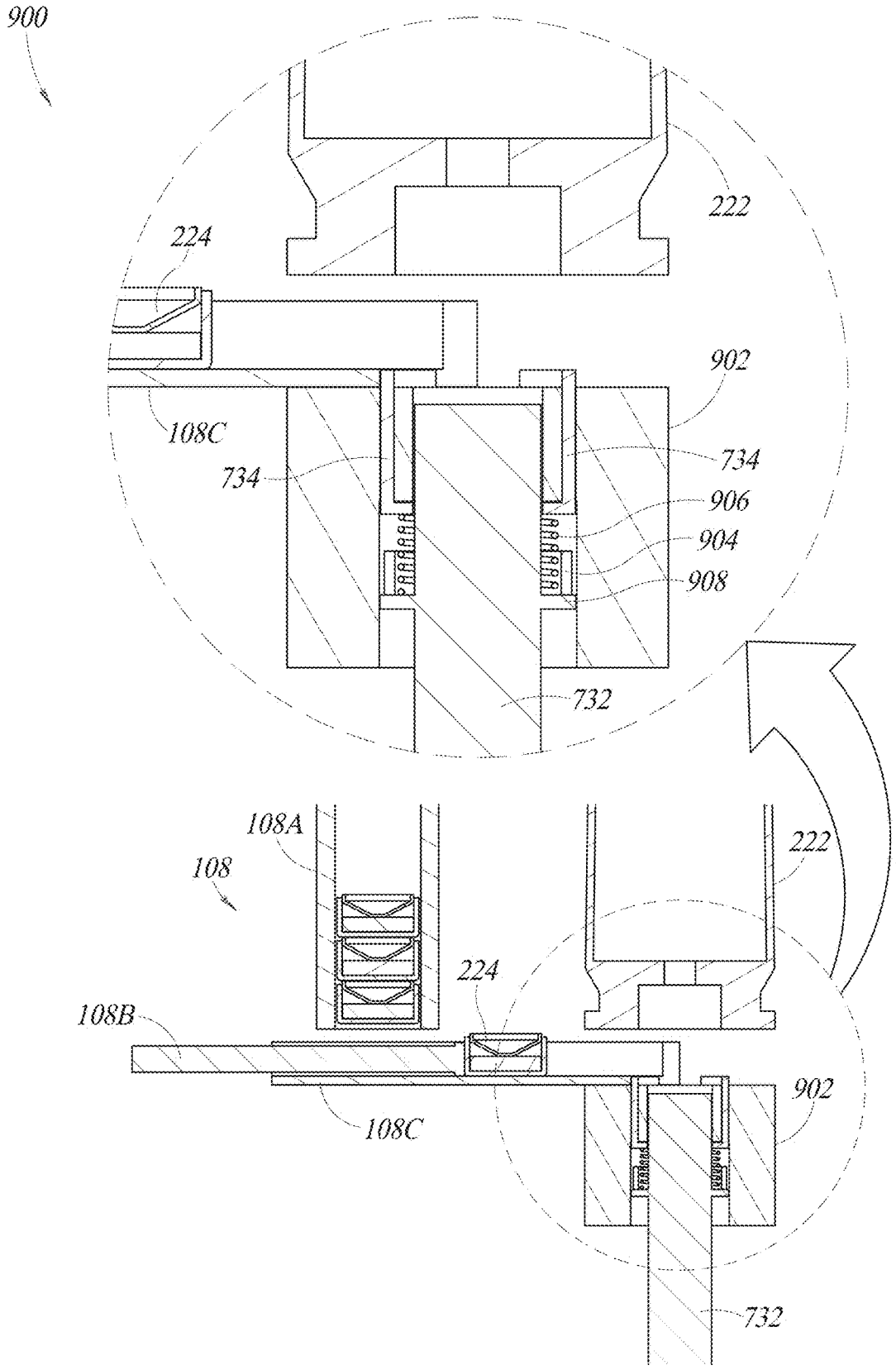

FIGS. 9F and 9G illustrate cross-sectional views of a system, including a spring component, to index depth of a primer from a casing, in accordance with at least one embodiment. As an example, FIG. 9F may illustrate a primer 224 being aligned with a primer seating component 110. As an example, FIG. 9G may illustrate moving a primer rod prior to engaging one or more spring components. Aligning a primer may include a primer queue component 108 moving a primer 224 between a first, second, and/or third position. System 900 includes a securing mechanism of a casing, such as those described herein (e.g., attachment grooves 114, see FIG. 1).

Figure 9H:
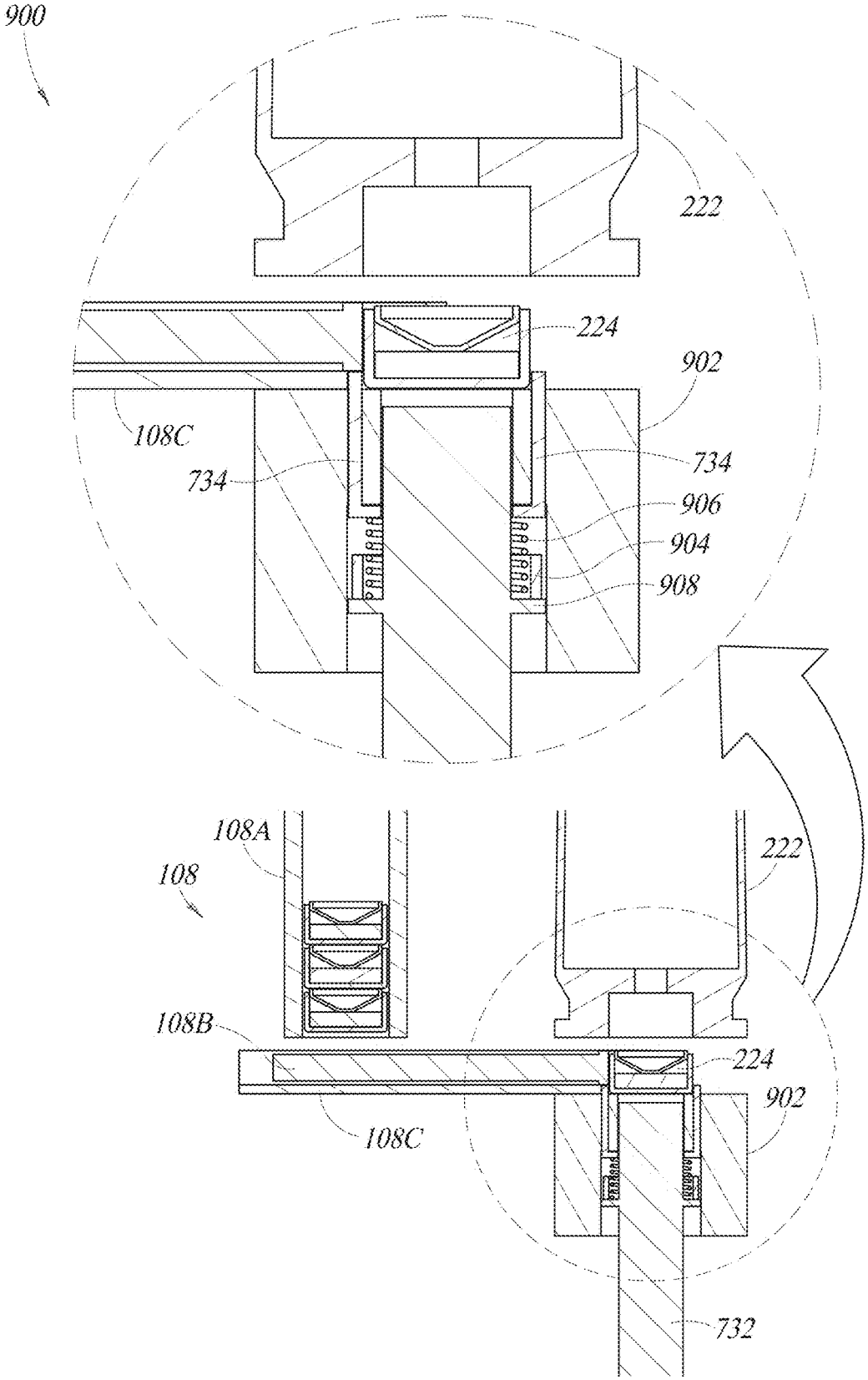

FIG. 9H illustrates a cross-sectional view of a system, including a spring component, to index depth of a primer from a casing, in accordance with at least one embodiment. As an example, FIG. 9H may illustrate a primer 224 aligned with a primer seating component 110. Aligning a primer may include a primer queue component 108 moving a primer 224 between a first, second, and/or third position. System 900 includes a securing mechanism of a casing, such as those described herein (e.g., attachment grooves 114, see FIG. 1).

Figure 9I:
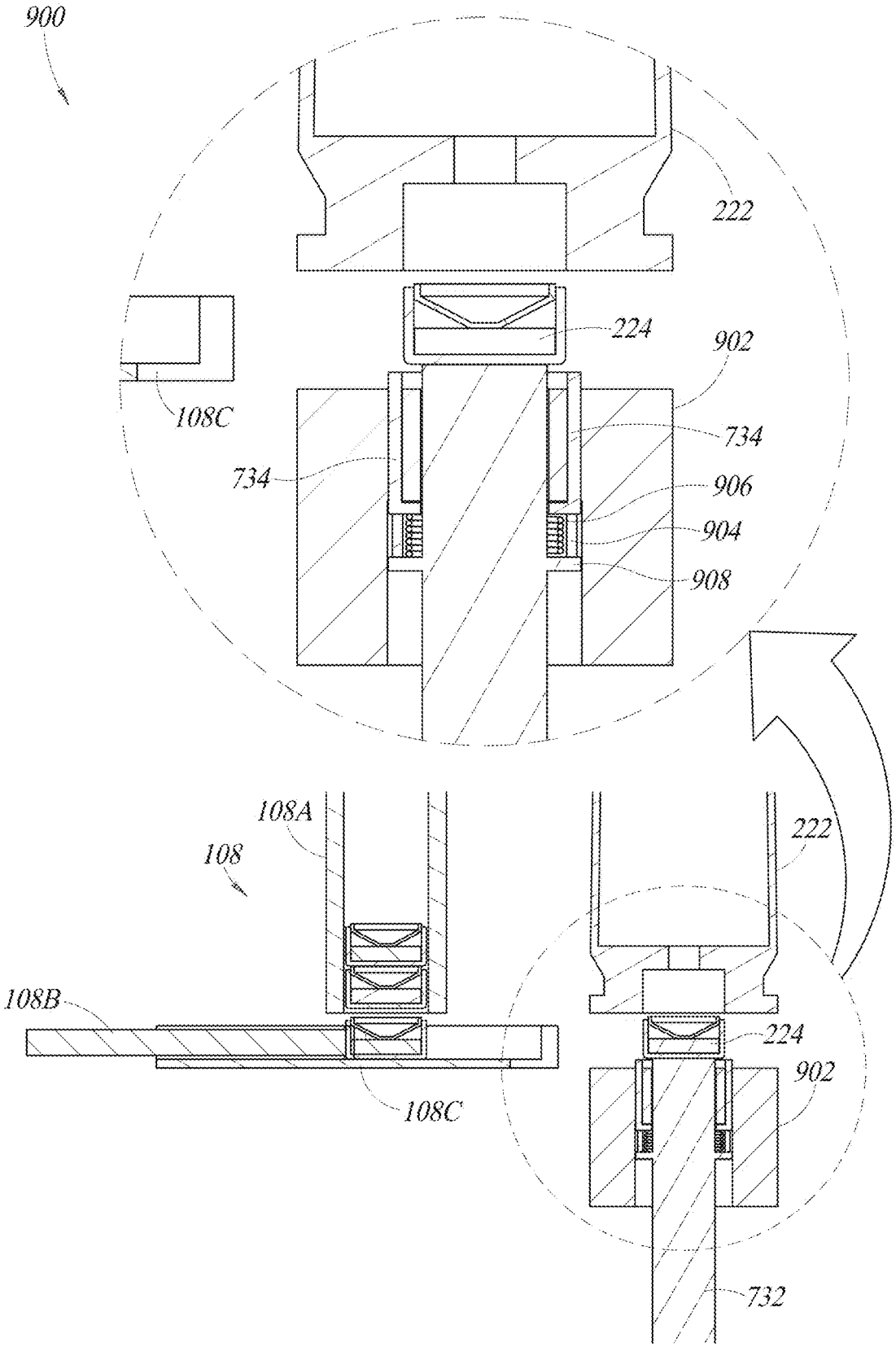
Figure 9J:
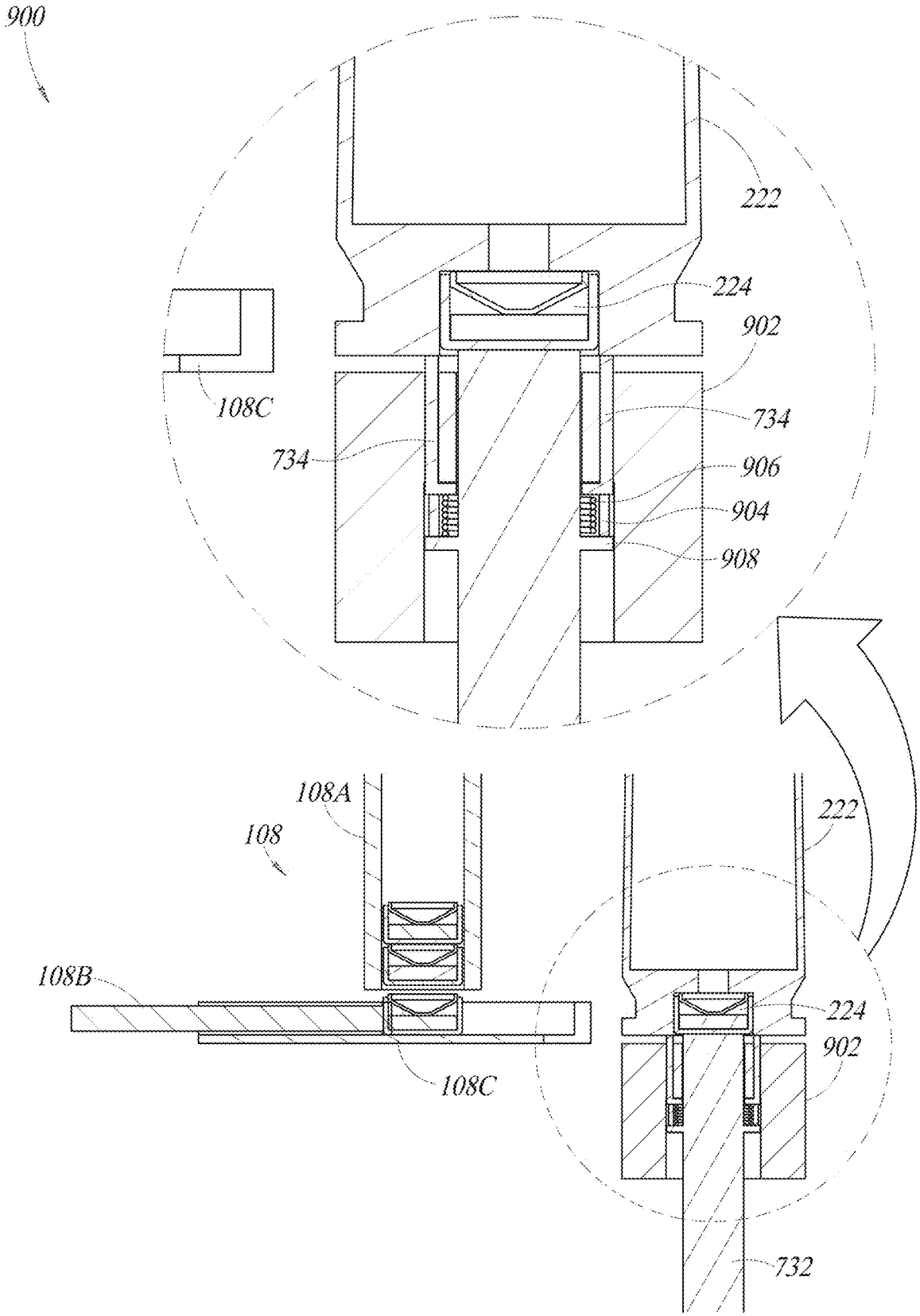

FIGS. 9I and 9J illustrate cross-sectional views of a system, including a spring component, to index depth of a primer from a casing, in accordance with at least one embodiment. As an example, system 900 seats a primer 224 with a primer seating component 110 and moves a primer queue component 108 between a first position and a second position to load a primer. System 900 includes a securing mechanism of a casing, such as those described herein (e.g., attachment grooves 114, see FIG. 1).

Figure 9K:
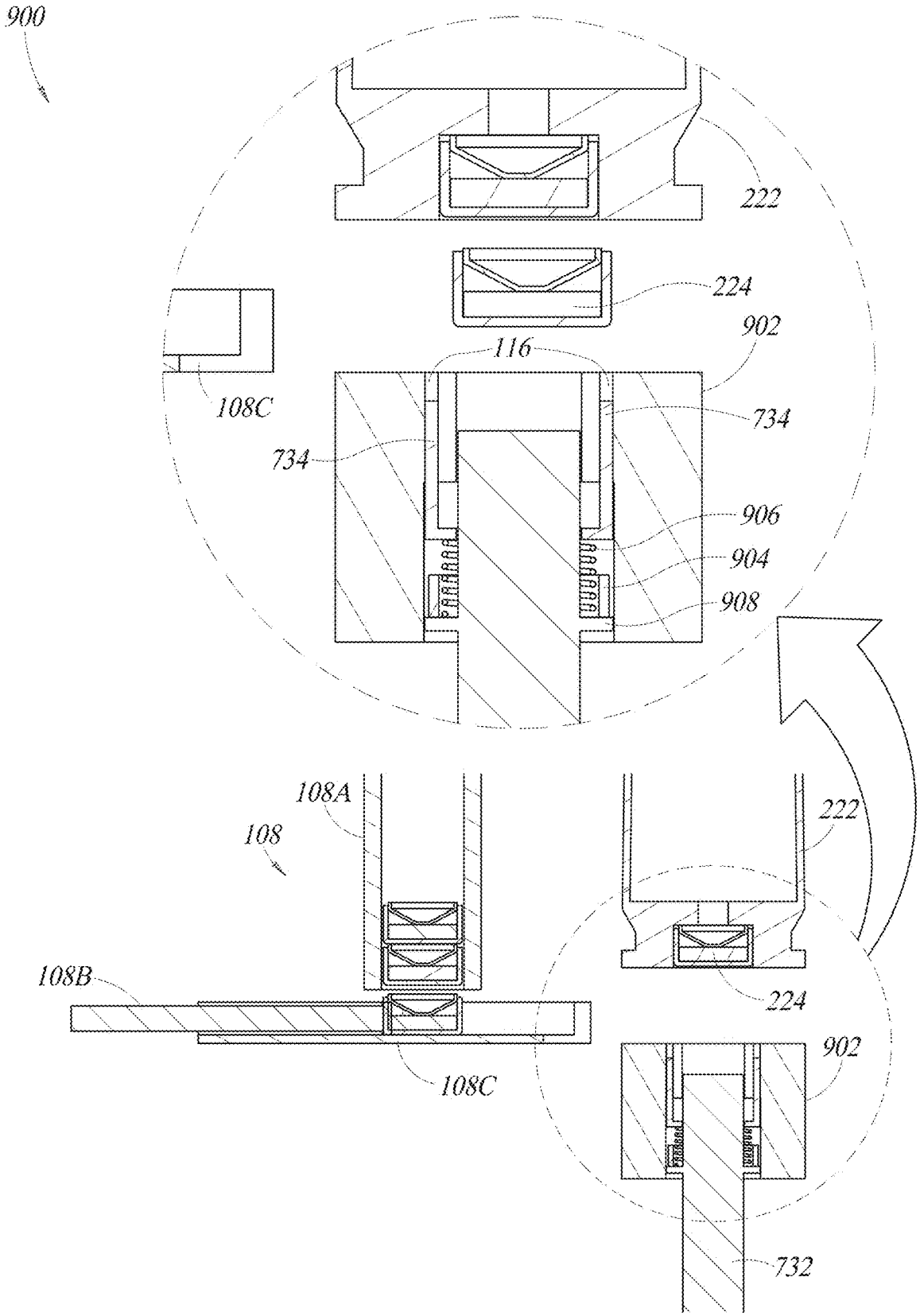

FIG. 9K illustrates a cross-sectional view of a system, including a spring component, to index depth of a primer from a casing, in accordance with at least one embodiment. As an example, system 900 seated a primer according to a depth indexed from a base of a casing. System 900 includes a securing mechanism of a casing, such as those described herein (e.g., attachment grooves 114, see FIG. 1).

Figure 9L:
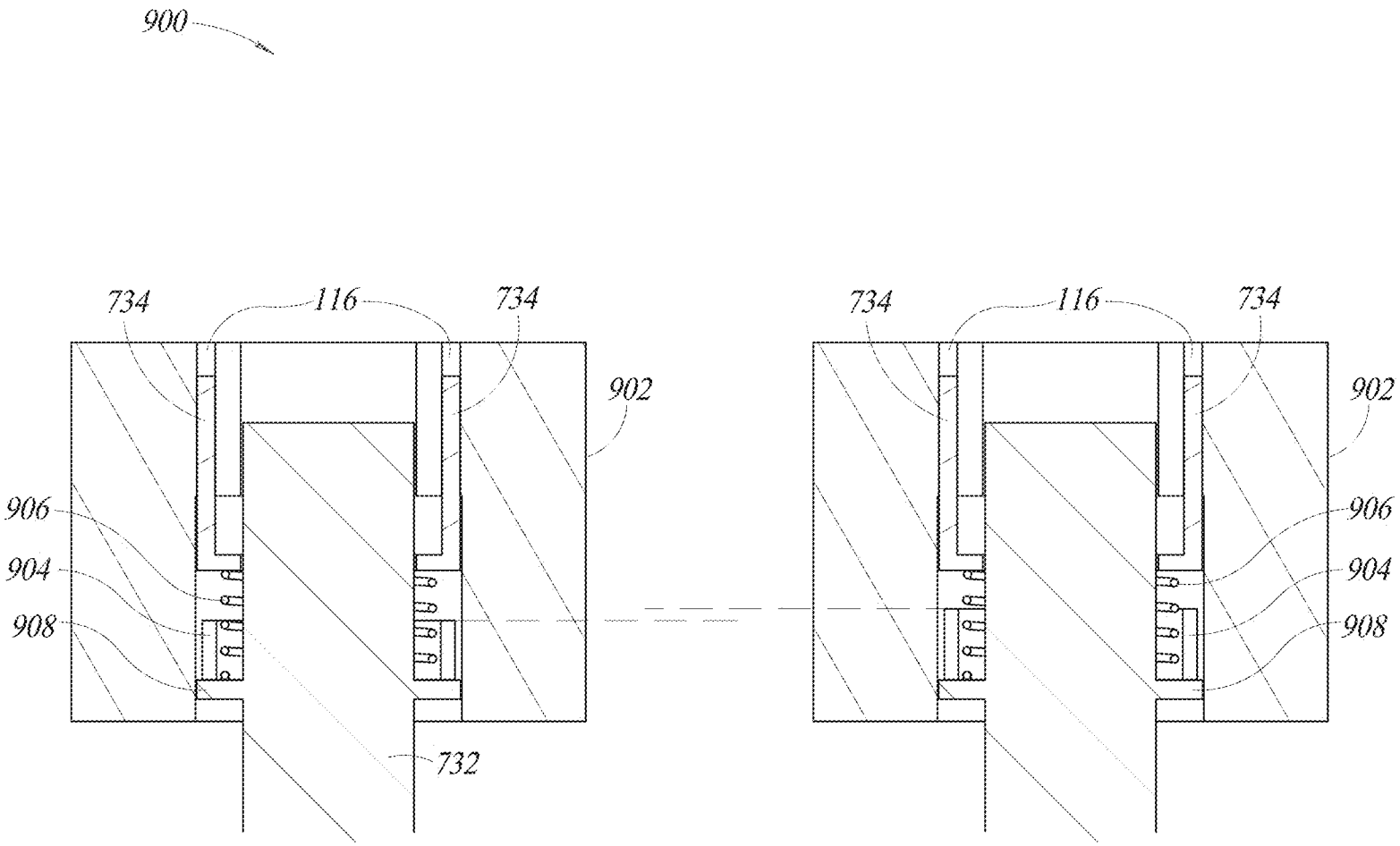
Figure 10A:
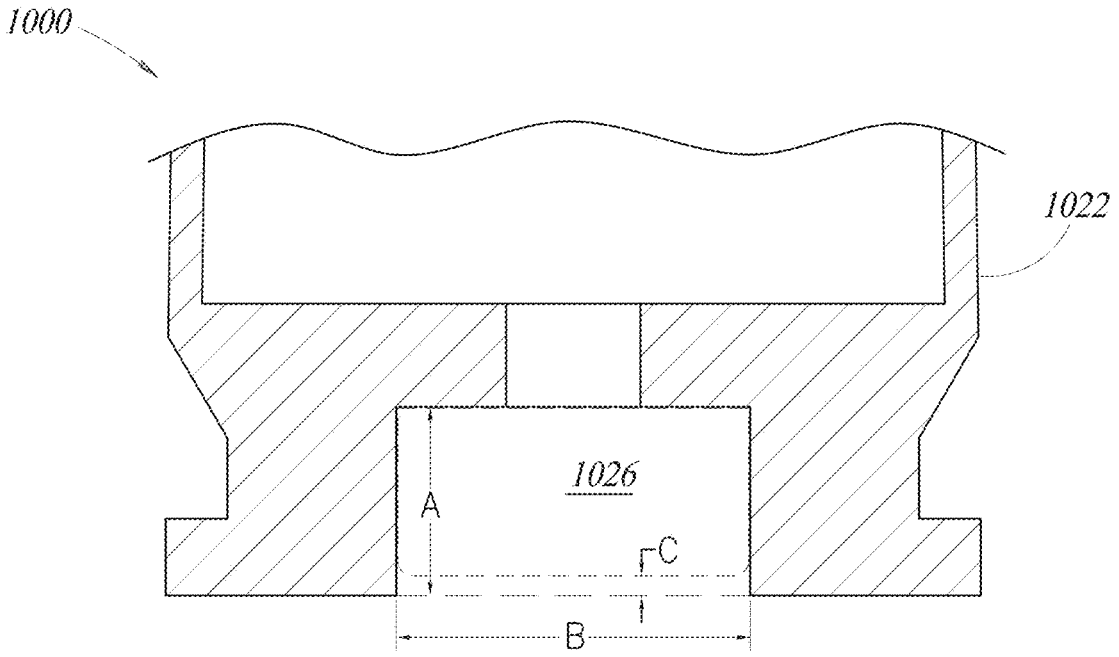
FIGS. 10A-10H illustrate a cross-sectional view of a system including a projectile casing and primer, in accordance with at least one embodiment.
Figure 10B:
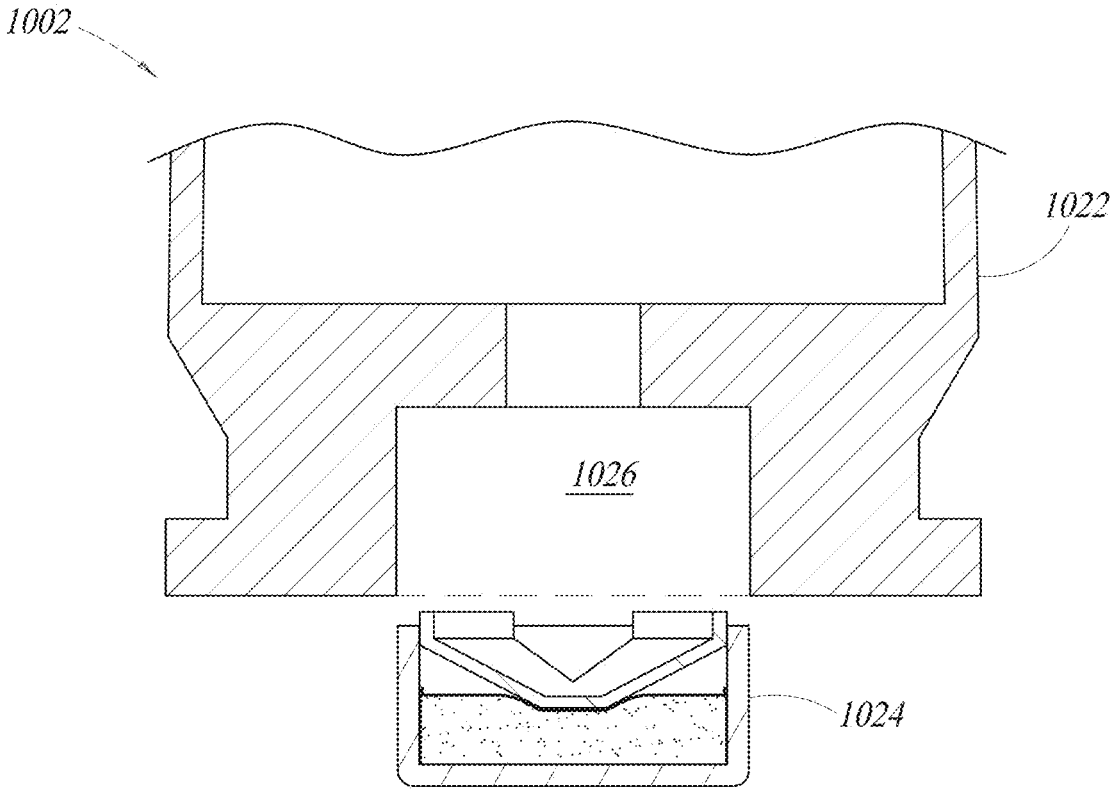
Figure 10C:
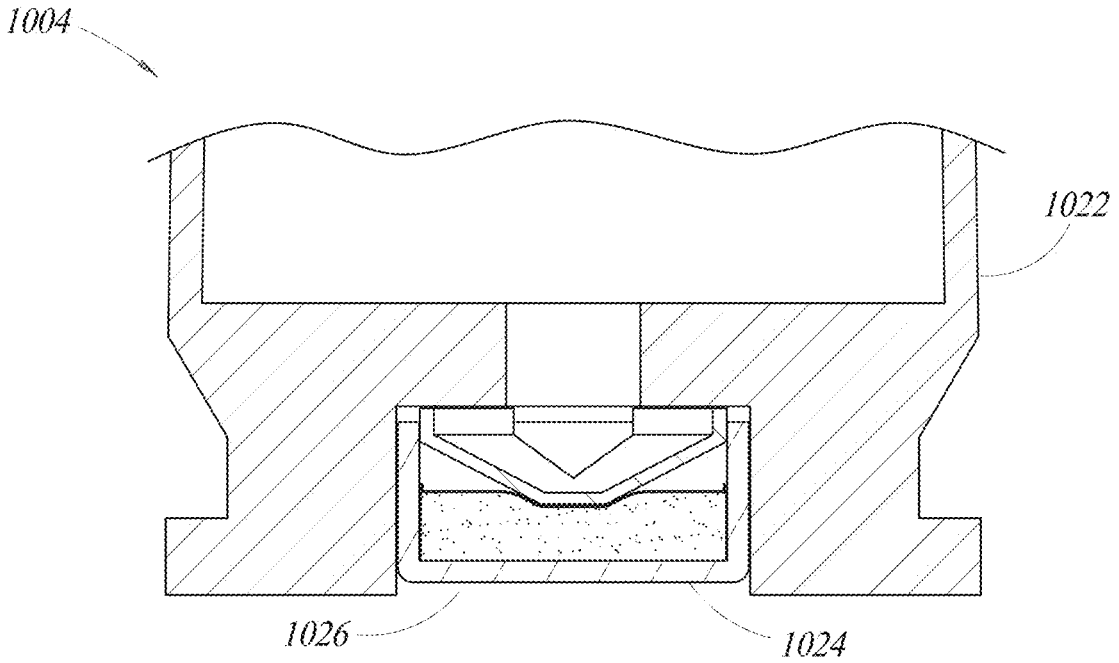
Figure 10D:
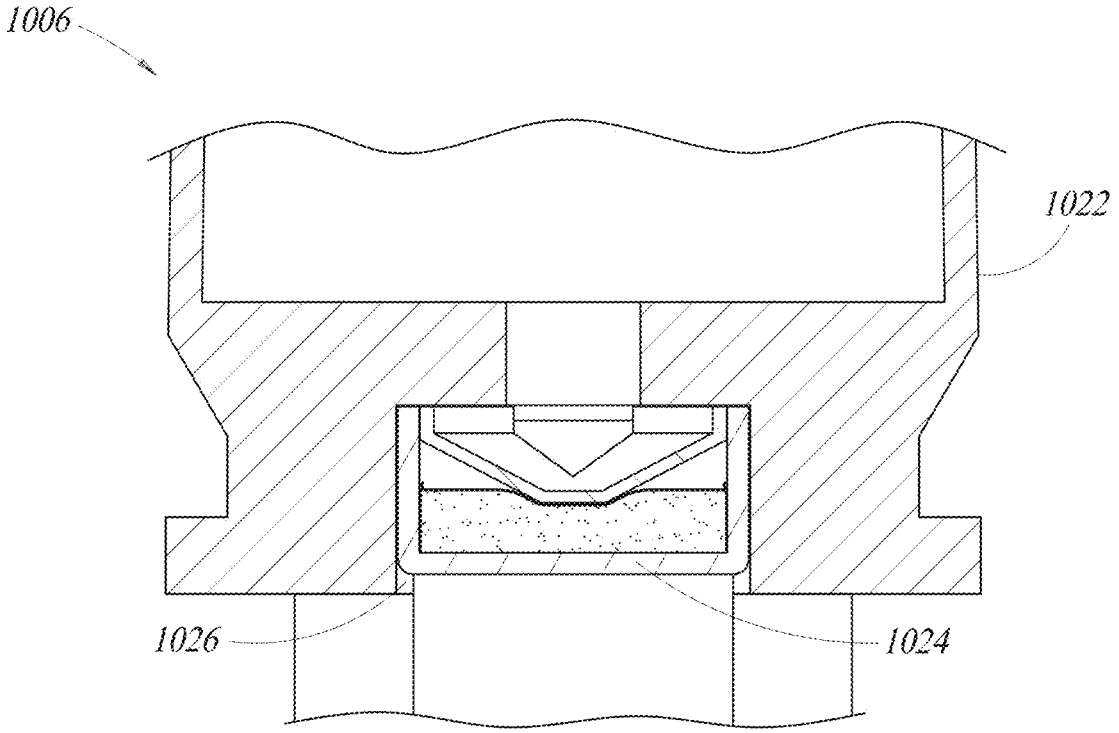
Figure 10E:
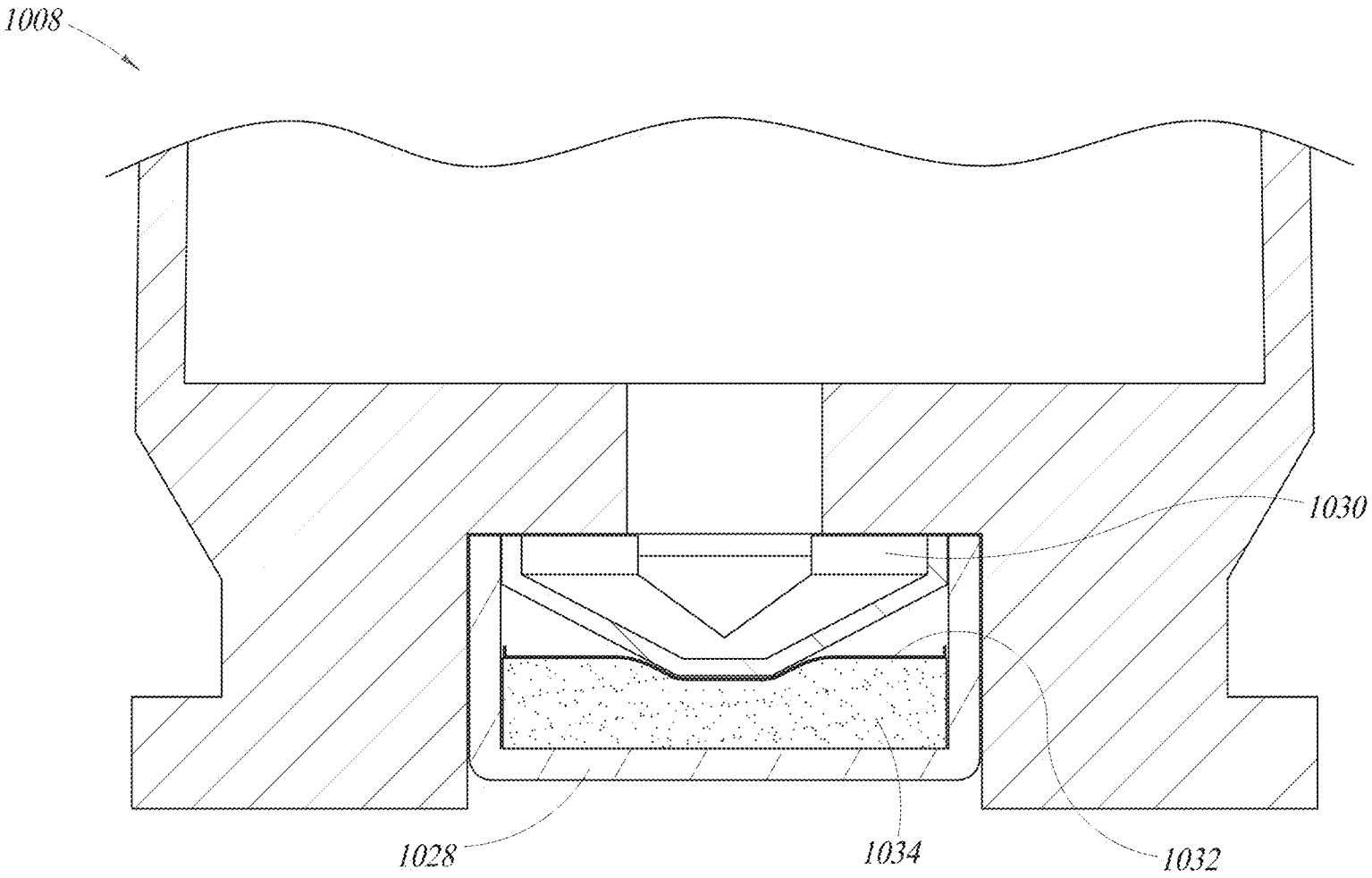
Figure 10F:
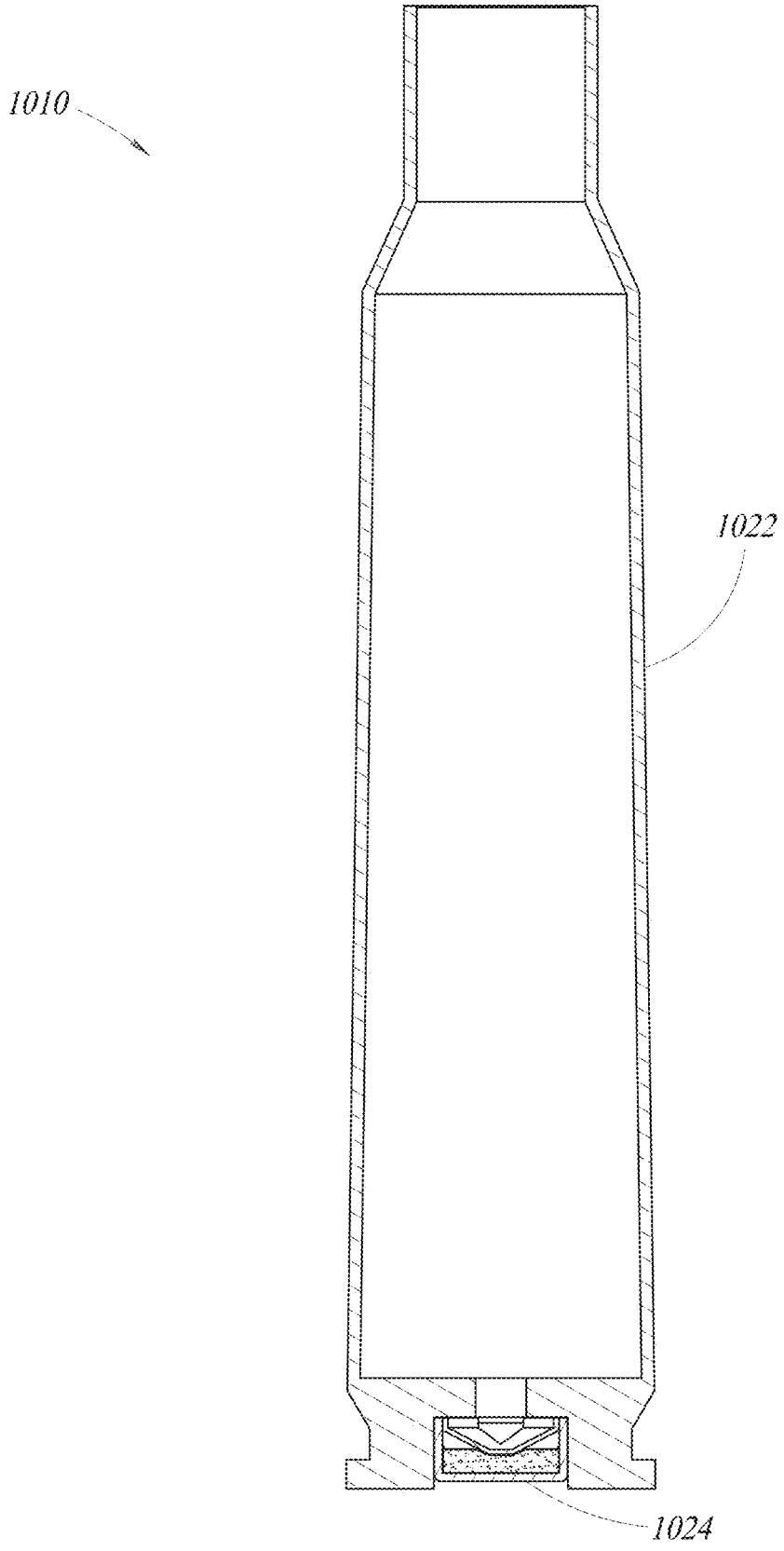
Figure 10G:
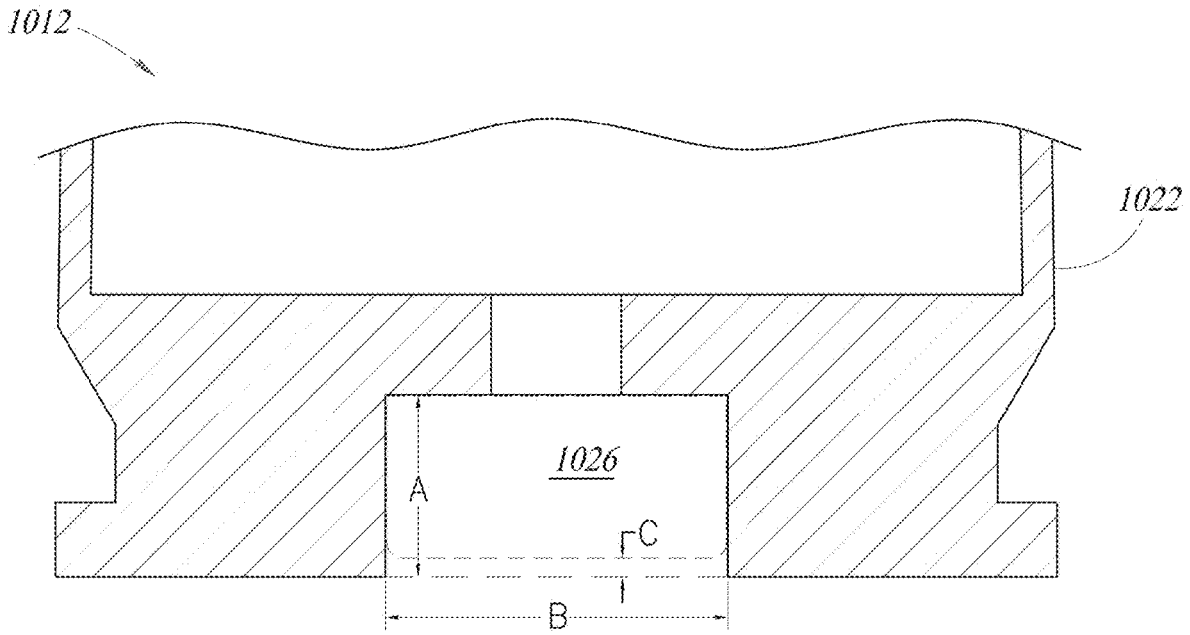
Figure 10H:
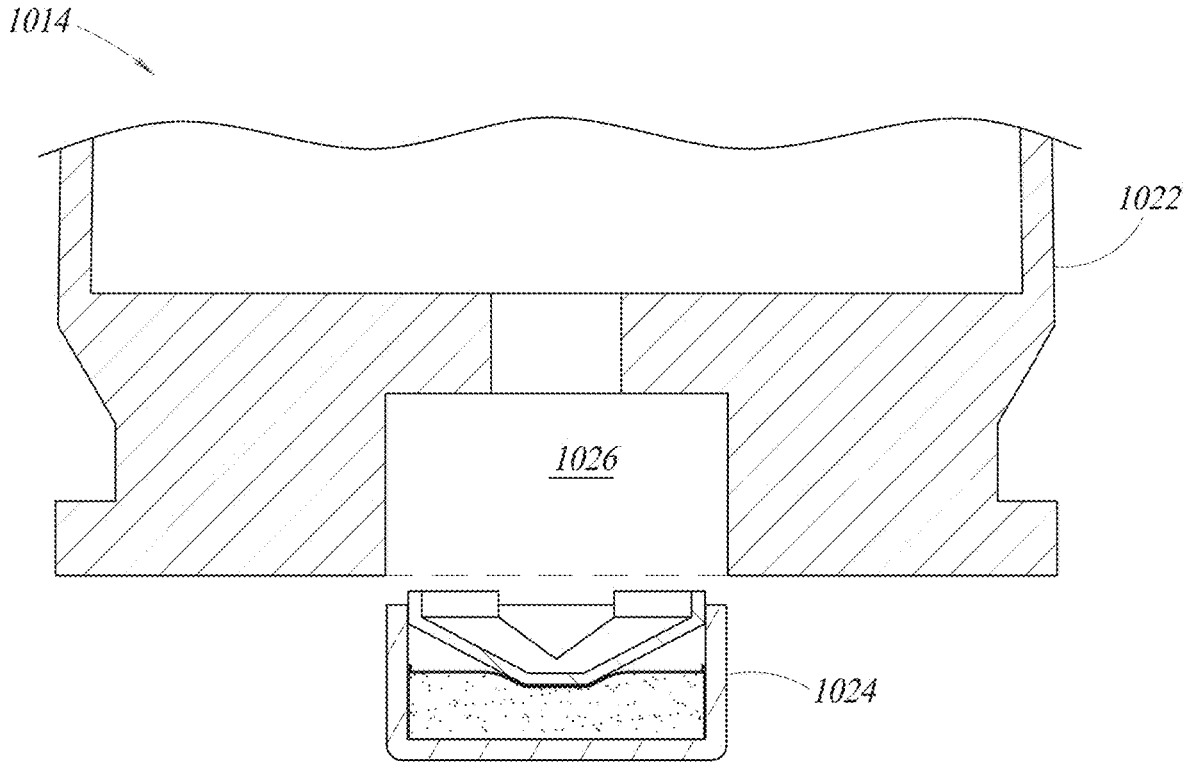

FIG. 9L illustrates a cross-sectional view of a system, including a spring component, to index depth of a primer from a casing, in accordance with at least one embodiment. As an example, system 900 includes a spring component which may be used to engage one or more prongs when seating a primer. Further, when retracted, a primer may be moved into a recess (e.g., basket) above a primer rod 732.

In at least one embodiment, system 900 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 900 can position, locate, or otherwise move a primer into a projectile casing. For example, a system 900 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the projectile casing. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 900 is, is included in, and/or otherwise includes systems illustrated in FIGS. 1A-16B to position, locate, or otherwise move a primer into a projectile casing by indexing from the base of the projectile casing and/or otherwise perform operations described herein. In at least one embodiment, system 900 performs one or more processes illustrated in FIGS. 1A-17, such as process 1700 to position, locate, or otherwise move a primer into a projectile casing by indexing from the base of the projectile casing and/or otherwise perform operations described herein.

FIGS. 10A-10H illustrate a cross-sectional view of a system (e.g., system 1000, 1002, 1004, 1006, 1008, 1010, 1012, and 1014) including a projectile casing (e.g., projectile casing 1022) and primer (e.g., 1024 and/or 1028), in accordance with at least one embodiment.

System 1000 may include projectile casing 1022, where projectile casing includes a primer pocket 1026. Primer pocket 1026 includes one or more dimensions, such as diameter (e.g., "B") and depth (e.g., "A"). A desired depth to seat a primer (e.g., user preference in manufacturer recommended range) may be illustrated by the distance between "B" and "C." As an example, an outside of a seated primer would be pushed until aligned with "C."

System 1002 may include projectile casing 1022, primer pocket 1026 (e.g., primer recess), and primer 1024. Primer 1024 may be aligned with a primer pocket 1026, such as by using one or more primer seating components illustrated in FIGS. 9A-9E.

System 1004 may include projectile casing 1022, primer pocket 1026 (e.g., primer recess), and primer 1024. System 1004 may illustrate a primer prior to setting (e.g., crushing) anvils 1030 to seat a primer. As an example, primer may be in a projectile casing, but not yet at a desire depth due to anvils 1030 not yet being set (e.g., crushed and/or pressed). As another example, a desired amount of setting anvils may be within a range, such that a user (e.g., marksman) may set a depth to vary between a level of crush illustrated in 1004 and 1006.

System 1006 may include projectile casing 1022, primer pocket 1026 (e.g., primer recess), and primer 1024. System 1006 also may illustrate a primer seating component (as illustrated in FIGS. 9A-E) seating primer according to a depth, such as to align with "C." Anvils 1030 illustrated in system 1006 may illustrate a desired amount of setting of a primer 1024.

System 1008 may illustrate a projectile casing with a seated (e.g., set, placed, and/or inserted) primer. As an example, primer is seated to a desired depth and primer seating component has been extracted. A primer (e.g., primer 1024 and/or seated primer 1028) may include one or more anvils 1030, foil 1032, and/or primer mixture 1034. A seated primer 1028 may have anvils compressed (e.g., crushed) between projectile casing and primer mixture, causing an outward pressure to seat a primer 1024. Seated primer 1028 may be aligned with flashing hole within a primer pocket. A primer may also include staked securing of a primer.

System 1010 may include projectile casing 1022 and/or primer 1024. System 1010 may illustrate a projectile casing 1022 with a primer 1024 seated, such as to a depth measured at least in part from a projectile casing base (e.g., using primer seating component).

System 1012 may include projectile casing 1022 and primer pocket 1026. Primer pocket 1026 includes one or more dimensions, such as diameter (e.g., "B") and depth (e.g., "A"). A desired depth to seat a primer (e.g., user preference in manufacturer recommended range) may be illustrated by the distance between "B" and "C." As an example, an outside of a seated primer would be pushed until aligned with "C."

System 1014 may include projectile casing 1022, primer 1024, and primer pocket 1026. System 1010 may illustrate a projectile casing 1022 with a primer 1024 aligned with primer pocket 1026.

In at least one embodiment, a system includes one or more systems (e.g., system 1000, 1002, 1004, 1006, 1008, 1010, 1012 and/or 1014), processors, and/or components to index depth of a primer from a base of a projectile casing and/or otherwise perform operations described herein. In at least one embodiment, a system (e.g., system 1000, 1002, 1004, 1006, 1008, 1010, 1012 and/or 1014) is, is included in, and/or otherwise includes systems illustrated in FIGS. 1A-16B to index depth of a primer from a base of a projectile casing and/or otherwise perform operations described herein. In at least one embodiment, a system (e.g., system 1000, 1002, 1004, 1006, 1008, 1010, 1012 and/or 1014) is used, at least in part, to perform one or more processes illustrated in FIGS. 1A-17, such as process 1700 to index depth to seat a primer from a base of a projectile casing and/or otherwise perform operations described herein.

FIGS. 11A-11D illustrate a schematic diagram of a system 1100 automating seating a primer in a projectile casing using depth measured from a projectile casing base, in accordance with at least one embodiment. In at least one embodiment, system 1100 includes projectile casing placement component 1102, primer seating component 1104, projectile casing extractor 1106, primer queue component 1108, projectile casing conveyer 1110, control(s) 1112 (e.g., control display 1112A, component control(s) 1112B-J, knobs, buttons, switches, levers and/or dials), projectile casing 1122, projectile casing rotator 1120, hydraulics 1174 (e.g., 1174A-C), a base, and/or combinations thereof. In at least one embodiment, projectile casing rotator 1120 includes one or more components which may be rotated between one or more functions or operations of a device, such as rotation component 1120A at projectile casing placement component 1102, rotation component 1120B at primer seating component 1104, rotation component 1120C at projectile casing extractor 1106, and staging rotation component 1120D (e.g., staging to rotate to projectile casing placement component 1102). System 1100 can include other components not shown in FIGS. 11A-11D such as a compressed air tube (e.g., pipe) and debris tube (e.g., pipe) for cleaning. Ordering of these components may be done clockwise, counterclockwise, lineal, and/or cyclical.

System 1100 includes components that can perform one or more functions, such as primer extractions, placement of a projectile casing, projectile casing cleaning, projectile casing extraction, primer placement, projectile casing reshaping, and/or one or more functions described herein. System 1100 can include means of seating a primer and/or performing one or more components 1120 (e.g., hydraulic pump, electronic motor, stepper motor, lever, pulley, or other mechanical, electrical or hydraulic system that raises, moves, or increases a height of a base, claw, clip, engagement element, or other mechanical, electrical or hydraulic system that pulls, lifts, moves, rotates, or slides one or more projectile casings 1122 and/or components). Controls 1112 may also include settings that allow for components to be performed automatically (e.g., cyclically and/or in repetition with subsequent projectile casings).

Figure 11A:
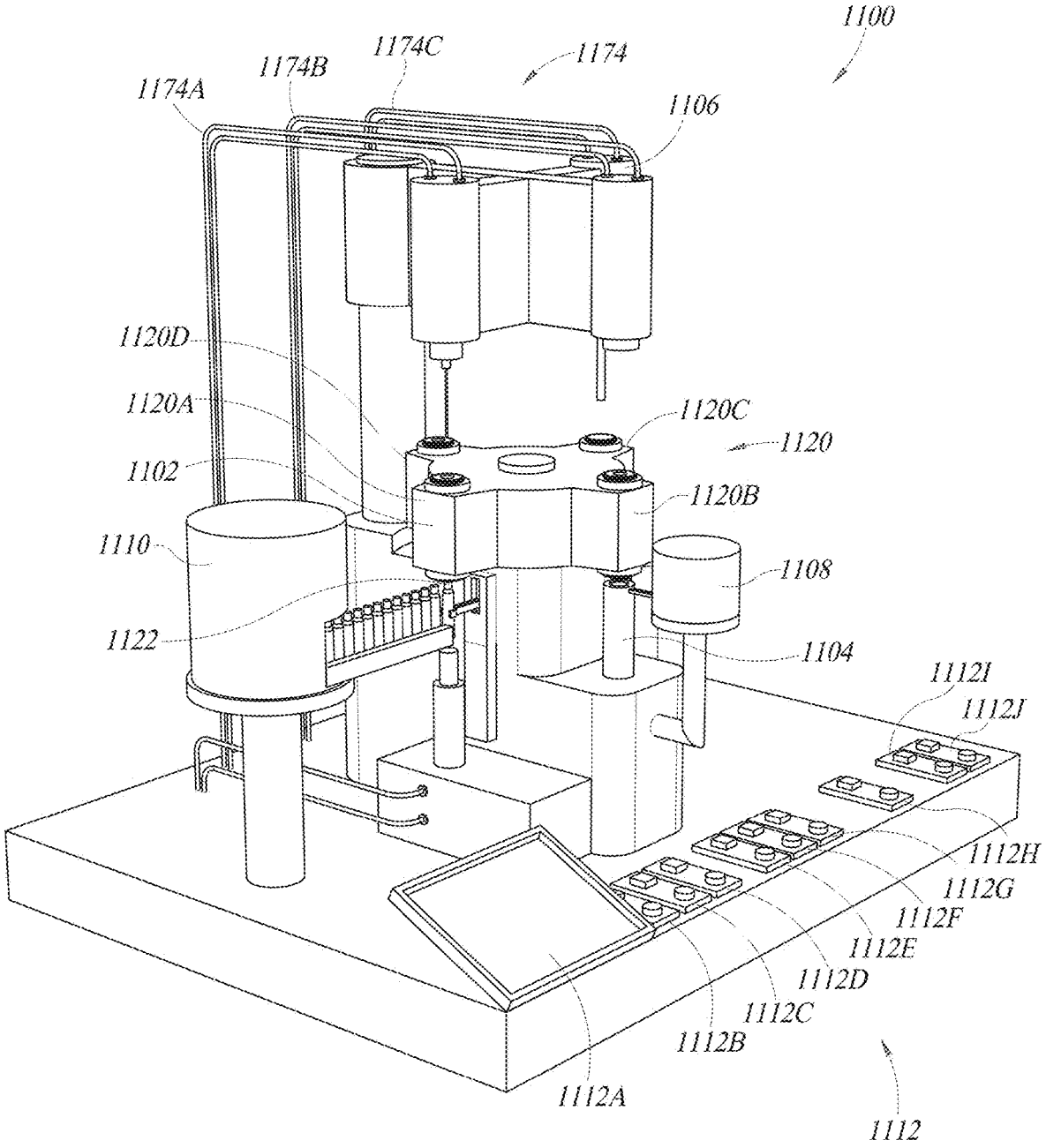
FIGS. 11A-11D illustrate a schematic view of a system to automatically seat a primer in a projectile casing using depth measured from a projectile casing base, in accordance with at least one embodiment.

The schematic diagram in FIG. 11A includes an illustration of a front view for a projectile casing cleaning system 1100. System 1100 may include at least one component to insert a projectile casing 1122 rotator 1120 (e.g., projectile casing placement component 1102). Projectile casing placement component 1102 may receive one or more projectile casings, such as by one or more projectile casings 1122 in a series of projectile casings along a conveyer 1110. Controls 1112C can move projectile casing along conveyer 1110 and/or insert projectile casing 1122 into rotation component 1120A. As an example, controls 1112A may rotate projectile casing rotator 1120 so one or more components 1120A-D are transitioned into previous or subsequent function (e.g., projectile casing placement component 1102, primer seating component 1104, projectile casing extractor 1106, or staging). Projectile casings 1122 to be received may also be held in a clip and/or magazine, such that they are fed into one or more components of system 1100. In at least one embodiment, projectile casing placement component 1102 receives one or more projectile casings 1122 and removes (e.g., extracts) one or more primers (e.g., primer holder and/or primer cartridge) from the one or more projectile casings. As an example, projectile casing placement component 1102 may include control display 1112A and/or controls 1112D (e.g., moving primer extraction rod) to use hydraulics 1174A to place a projectile casing within a system 1100 and/or extract a primer while projectile casing is fixed in rotation component 1120A, such as by using a primer extraction rod. There may also be a method of controls 1112 to perform placement of a projectile casing (e.g., projectile casing placement component 1102) automatically, manually, or bypass primer extraction to move component to a different function. Projectile casing placement component 1102 may otherwise include one or more systems illustrated in FIGS. 11A-15C.

Figure 11B:
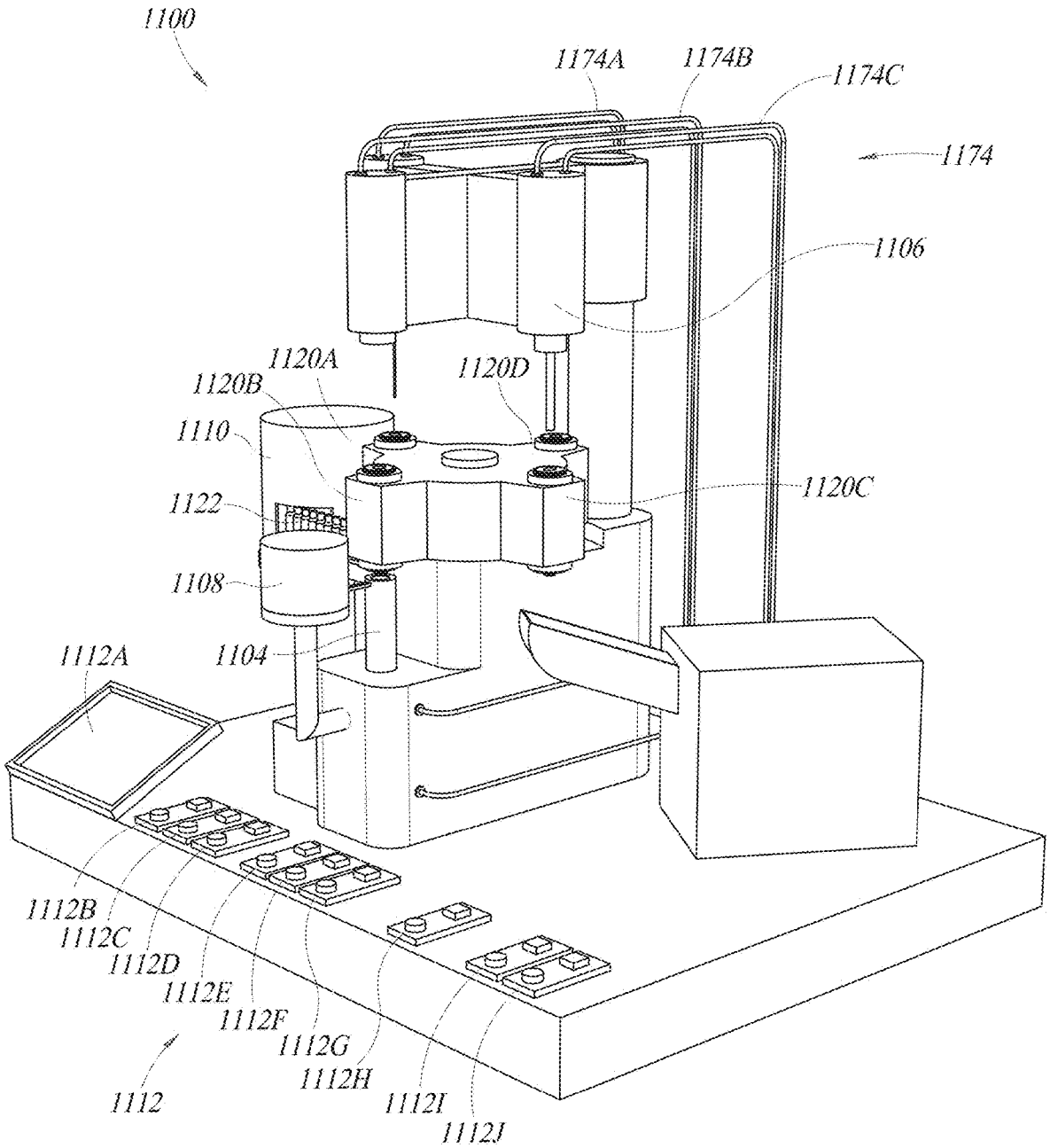

The schematic diagram in FIG. 11B includes an illustration of a front view of primer seating system 1100 from a different perspective compared to FIG. 11A. System 1100 uses one or more controls 1112 to transition a projectile casing 1122 in a rotating component 1120A from projectile casing placement component 1102 to primer seating component 1104. In at least one embodiment, system 1100 includes one or more controls 1112.

As an example, one or more controls 1112 when used may perform one or more operations illustrated by controls 1112A-J. Display control 1112A may adjust a depth with which to seat a primer in a projectile casing. One or more controls 1112B may position a projectile casing rotator 1120, such as to position one or more projectile casings to a component performing one or more functions function (e.g., projectile casing placement component 1102, primer seating component 1104, projectile casing extractor 1106, and/or staging). A control 1112B may rotate a projectile casing rotator 1120 clockwise and/or counterclockwise. One or more controls 1112C may position one or more projectile casings, such as to insert projectile casing 1122 into one or more components 1120A-D.

One or more controls 1112D may stage a primer in a primer queue component. One or more controls 1112E may insert a primer from primer queue component into primer seating component, such as aligned with projectile casing 1122 and inner cylinder 1432. One or more controls 1112F may position (e.g., lower and/or raise) an outer cylinder 1430 to touch a projectile casing base. One or more controls 1112G may position (e.g., lower and/or raise) inner cylinder 1432 (see FIG. 14), such as to insert primer at a depth according to a projectile casing's base and/or extract inner cylinder.

One or more controls 1112G and/or H may include controlling one or more settings of a primer seating component, such as changing (e.g., increasing and/or decreasing) depth to seat a primer within a factory range and/or providing an indication of a type of projectile casing. As an example, primer seating component 1104 receives a primer from primer queue component 1108 and seats a primer at a depth indicated by one or more settings (e.g., selected depth within factory recommendation range). One or more controls 11121 and J may include positioning a projectile casing extraction rod 1538, such as to extract a projectile casing or removing projectile casing extraction rod 1538 from rotation component 1120C.

A projectile casing 1122, inserted into rotation component 1120A at projectile casing placement component 1102, may be transitioned to primer seating component 1104. A projectile casing 1122 in rotation component 1120B at primer seating component may seat a primer according to a depth measured from a projectile casing base.

As an example, primer queue component 1108 includes one or more primers staged to be seated. Primer queue component 1108 may stage primers in a channel, pushing primers through an outer cylinder 1430 until aligned with an inner cylinder. A primer may be staged in an outer cylinder, staged on primer conveyer 1110, or otherwise may be staged in primer queue component. A primer conveyer 1110 may otherwise be a channel for one or more primers, including a mechanism to push primers into primer seating component 1104.

Primer seating component 1104 may include an inner cylinder 1432 and outer cylinder 1430. In at least one embodiment, primer seating component includes an inner cylinder 1432 moving independently of an outer cylinder until reaching stopping mechanism 1436. In at least one embodiment, inner cylinder 1432 is threaded into outer cylinder 1434A such that they both are moved in conjunction to seat a primer. In at least one embodiment, inner cylinder includes threading along at least a portion of said inner cylinder to connect with a stopping mechanism 1436. In at least one embodiment, primer seating component 1104 may include primer seating components illustrated in FIGS. 1A-9E (e.g., primer seating component 110 and/or systems 900-908). A primer seating component 1104 can also include one or more systems, or portions thereof, illustrated in FIGS. 1A-9E.

A primer may be positioned in a primer seating component 1104 illustrated in system 1100. As an example, a primer seating component 1104 illustrated in system 1100 is a positioning mechanism, such as to position a primer in a projectile casing. A primer seating component 1104 illustrated in system 1100 may seat a primer based, at least in part, on indexing from a bottom (e.g., base) of a projectile casing. Indexing of a primer seating component 1104 (e.g., position mechanism) may include an outer cylinder 1430 making contact with a projectile casing and an inner cylinder 1432 inserting a primer into a primer pocket until stopping mechanism such as prongs or a stopping mechanism that prevents exceeding a depth of insertion.

Figure 11C:
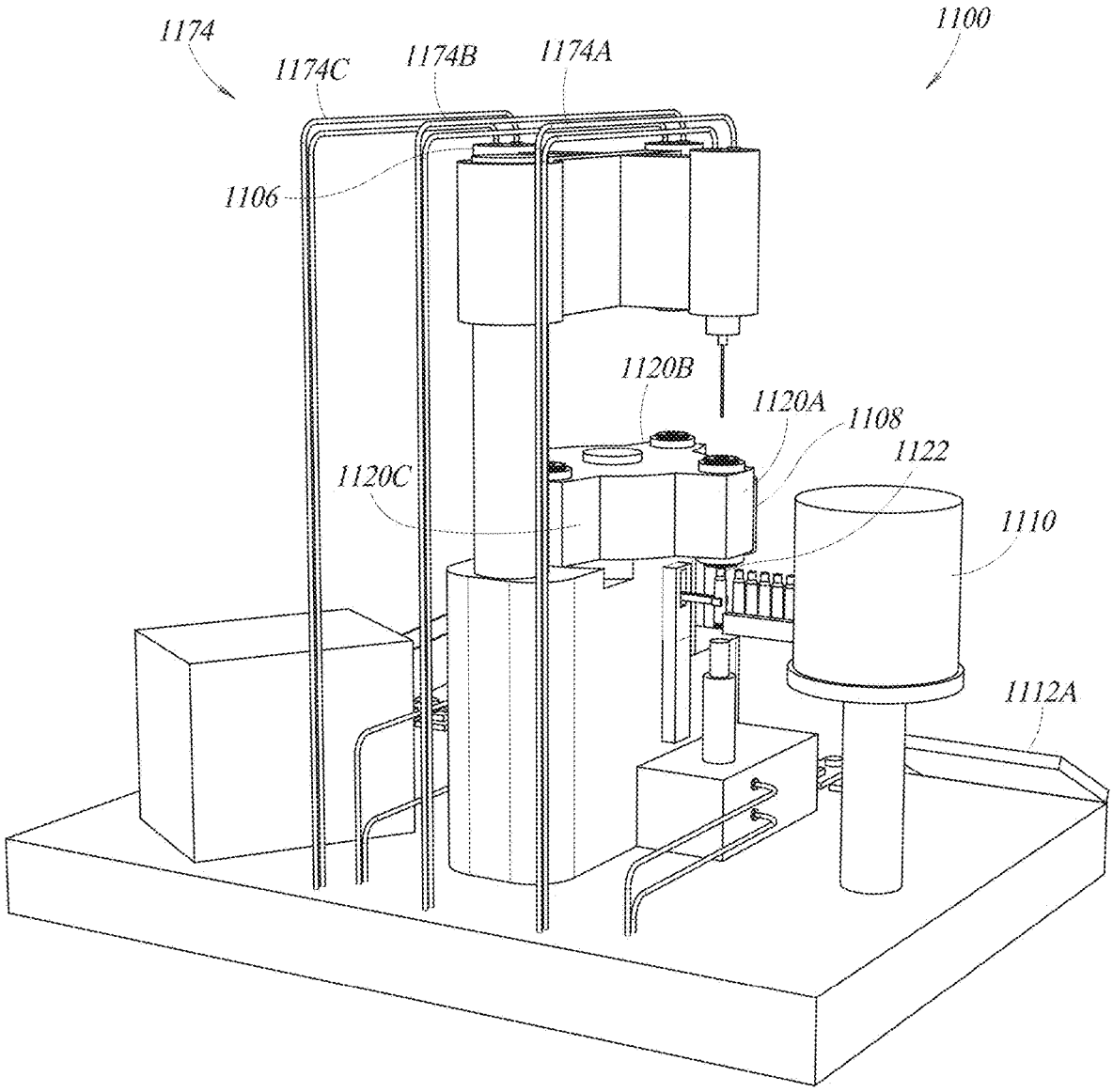

The schematic diagram in FIG. 11C includes an illustration of a projectile casing cleaning system 1100 from a different perspective compared to FIGS. 11A and 11B. System 1100 can use one or more controls 1112 to transition a projectile casing 1122 in a rotating component 1120B from primer seating component 1104 to the projectile casing extractor 1106. In at least one embodiment, projectile casing extractor 1106 includes a projectile casing extractor rod, a chute to catch 1540 one or more expelled projectile casings, and/or one or more expelled projectile casing bins.

Figure 11D:
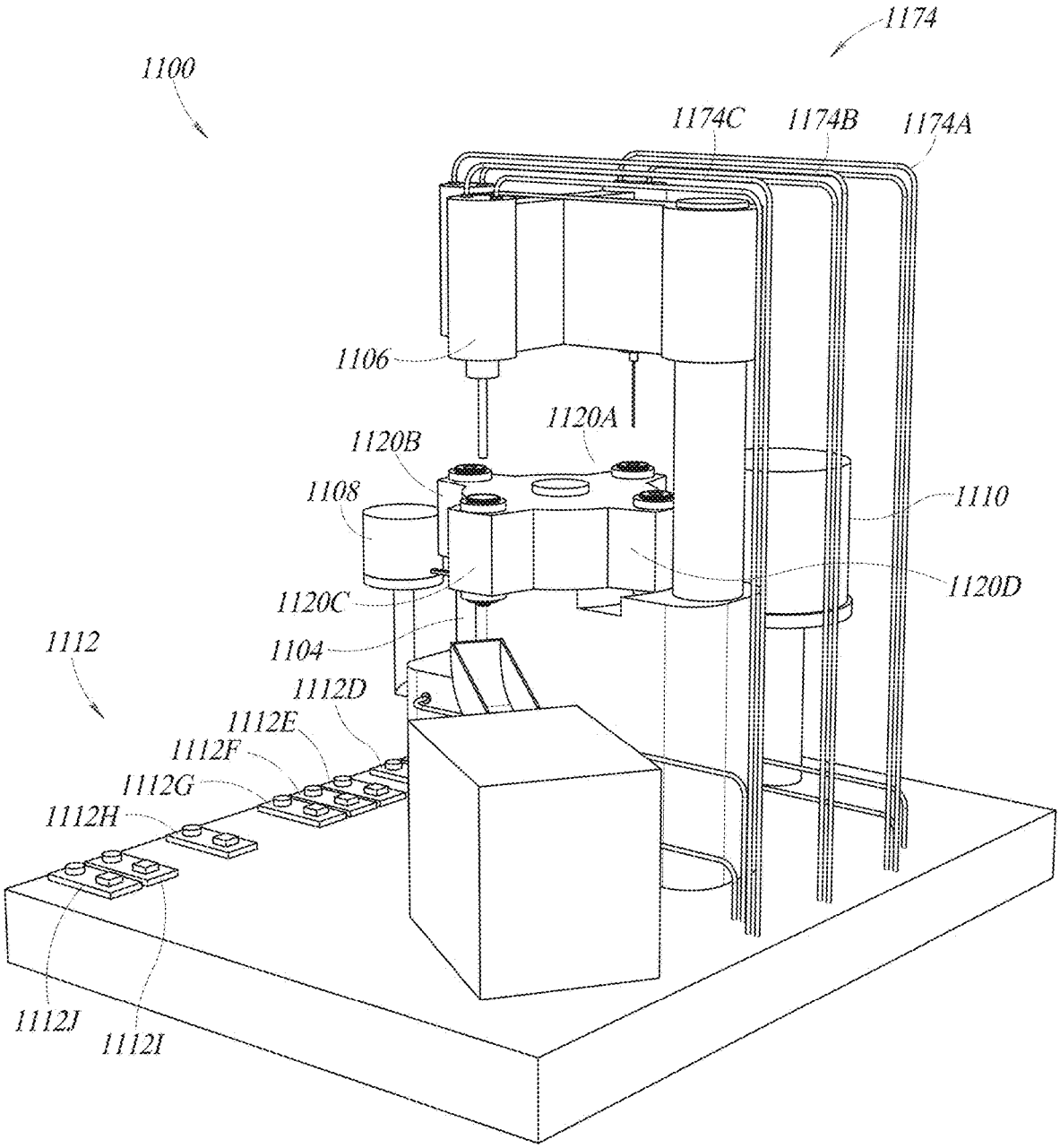

The schematic diagram in FIG. 11D includes an illustration of a projectile casing cleaning system 1100 from a lateral perspective. In at least one embodiment, system 1100 uses one or more controls 1112 to transition a projectile casing 1122 in a rotating component 1120C from projectile casing extractor 1106 to staging (e.g., position of staging rotation component 1120D) and/or to return to projectile casing placement component 1102 to repeat process with a subsequent projectile casing. Hydraulics 1174 may include one or more hydraulics 1174A-C, such as to position, raise, lower one or more portions of one or more components performing one or more functions, such as projectile casing placement component 1102, primer seating component 1104, and/or projectile casing extractor 1106. In at least one embodiment, hydraulics are otherwise a hydraulic pump, electronic motor, stepper motor, lever, pulley, or other mechanical, electrical or hydraulic system that raises, moves, or increases a height of a base, claw, clip, engagement element, or other mechanical, electrical or hydraulic system that pulls, lifts, moves, rotates, or slides one or more projectile casings 1122 or one or more components.

In at least one embodiment, a system, such as system 1100, includes a collection of one or more hardware and/or software computing resources with instructions that, when executed, performs one or more communication processes such as those described herein. In at least one embodiment, a system, such as system 1100, is a software program executing on computer hardware, application executing on computer hardware, and/or variations thereof. In at least one embodiment, one or more processes (e.g., process 1700) of system 1100 are performed by any suitable processing system or unit (e.g., graphics processing unit (GPU), general-purpose GPU (GPGPU), parallel processing unit (PPU), central processing unit (CPU)), a data processing unit (DPU), such as described below, and in any suitable manner, including sequential, parallel, and/or variations thereof. In at least one embodiment, system 1100 uses a machine learning training framework such as PYTORCH, TENSORFLOW, BOOST, CAFFE, MICROSOFT COGNITIVE TOOLKIT/CNTK, MXNET, CHAINER, KERAS, DEEPLEARNING4J, and/or other training framework to implement and perform operations described herein to seat (e.g., place and/or position) a primer and/or otherwise perform operations described herein.

FIGS. 12A-13B illustrate a schematic and cross-sectional view of a system (e.g., 1200 and/or 1300) to insert a projectile casing, in accordance with at least one embodiment. System 1200 and/or 1300 may be used to insert a projectile casing into rotator 1120.

Figure 12A:
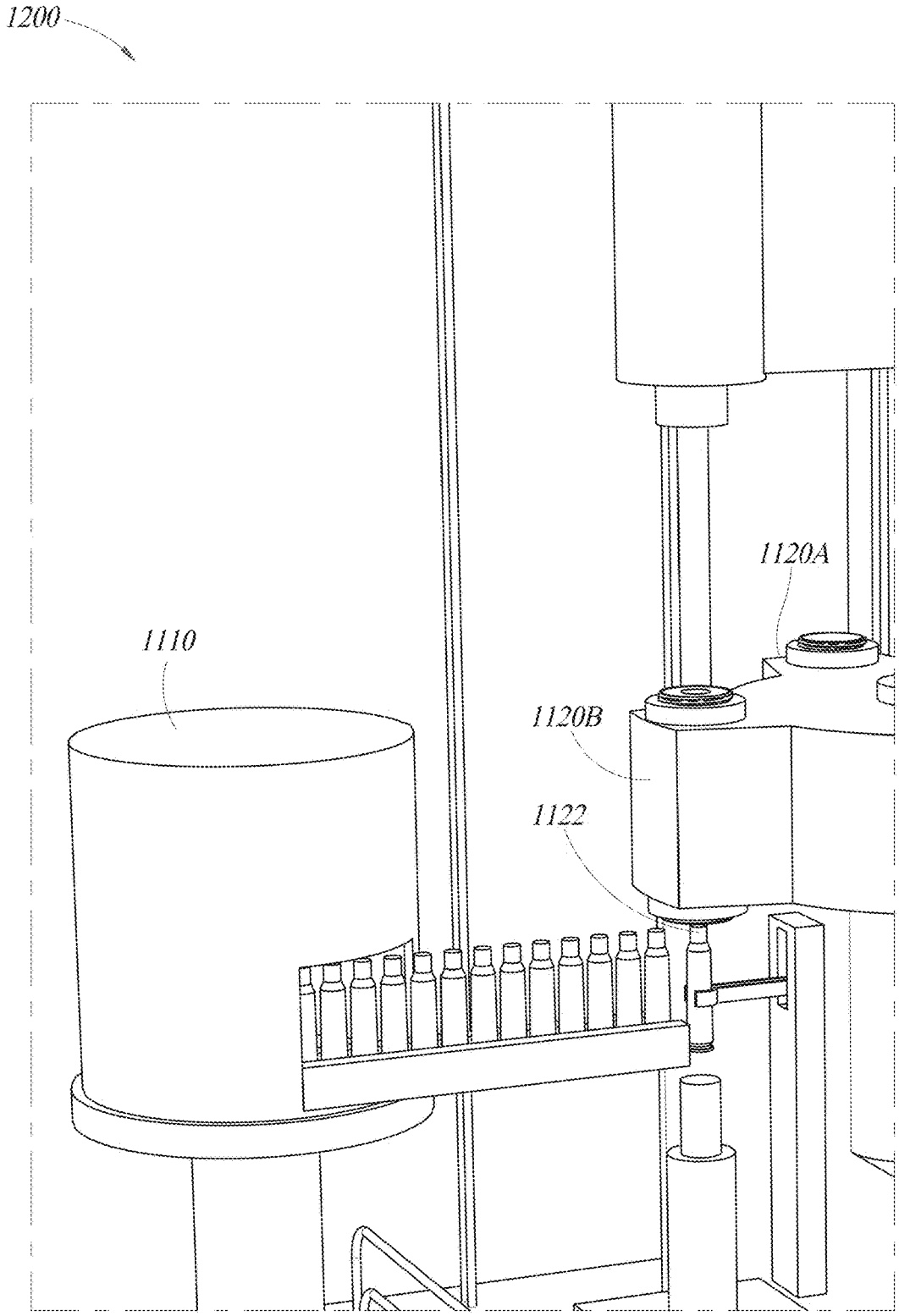
FIG. 12A illustrates a schematic view of a system to automatically insert a primer in a projectile casing, in accordance with at least one embodiment.
Figure 12B:
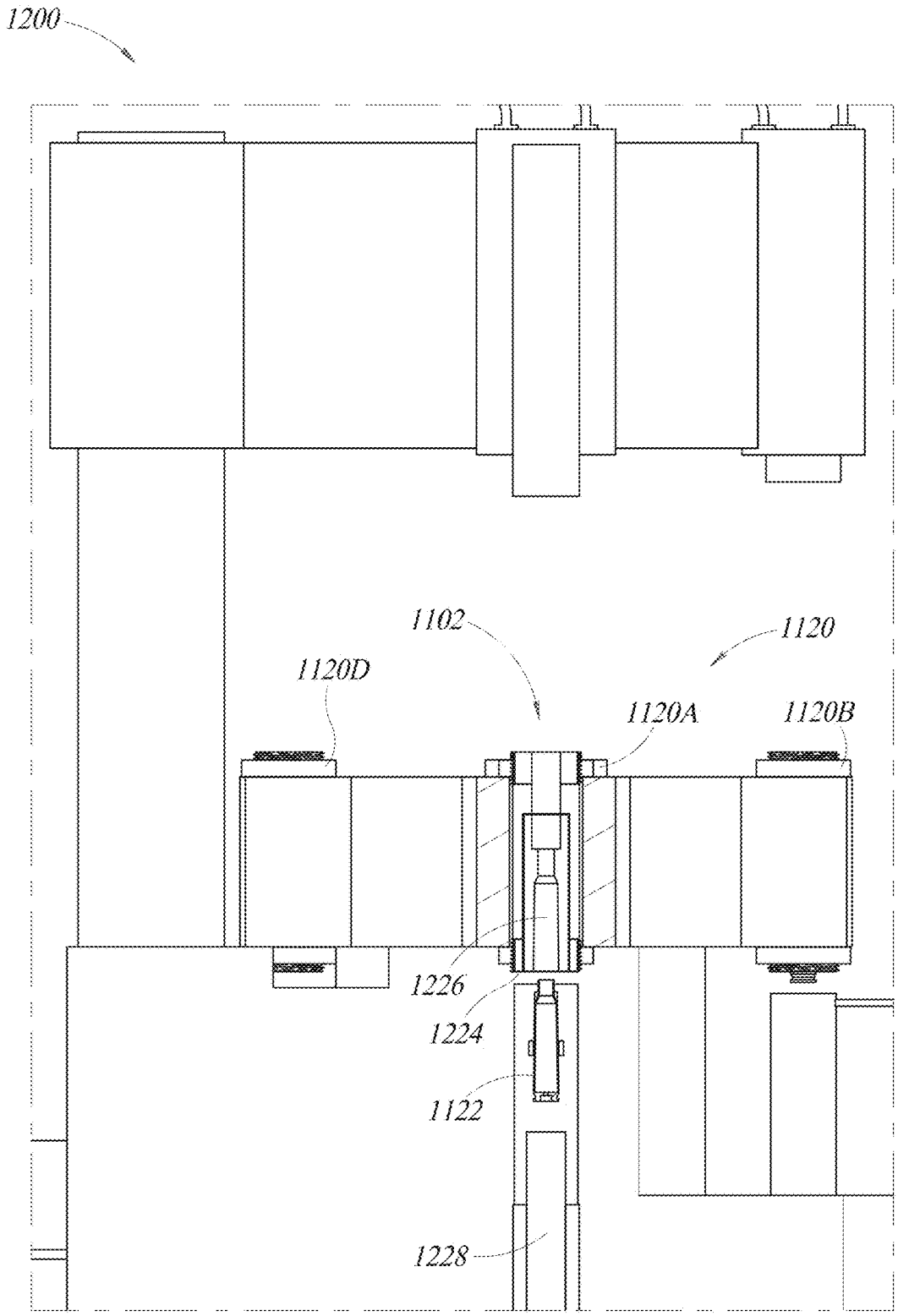
FIG. 12B illustrates a cross-sectional view of a system to automatically insert a primer in a projectile casing, in accordance with at least one embodiment.

FIGS. 12A and 12B illustrate a schematic and cross-sectional view of a system 1200 to insert a projectile casing, in accordance with at least one embodiment. In at least one embodiment, system 1200 includes projectile casing conveyer 1110, projectile casing 1122, projectile casing rotator 1120, one or more rotation components 1120A-1120D, projectile casing placement component 1102, projectile casing recess 1226, projectile casing component fastener 1224, projectile casing placement rod 1228, and/or combinations thereof. System 1200 may convey one or more projectile casings 1122, place (e.g., receive) one or more projectile casings 1122 in rotation component 1120A, and/or extract (e.g., remove) one or more primers.

FIG. 12A illustrates a schematic view of a diagram for a system 1200 to insert a projectile casing. A conveyer 1110 may otherwise be a series of projectile casings to be received by an automized system, a clip of projectile casing, a magazine of projectile casings, a batch of projectile casings, and/or be placed manually (e.g., singularly) into conveyer. As an example, a conveyer 1110 places projectile casings into securing arms, to align a projectile casing with component 1120B. As an example, a projectile casing placement rod 1228 may place (e.g., raise or lower) a projectile casing into rotation component 1120A.

FIG. 12B illustrates a cross-sectional view of a system 1200 to insert a projectile casing. System 1200 may receive one or more projectile casings 1122, such as by moving of a base (e.g., projectile casing placement rod 1228) towards a rotation component 1120A. As an example, projectile casing placement rod 1228 is raised using one or more hydraulics 1174A, such that projectile casing 1122 is aligned with projectile casing recess 1226 and placed in rotation component 1120A. Rotation component 1120A-D may include one or more dies and/or means for fixing a projectile casing in rotation component 1120A-D. A die can also be referred to as a "case forming" or "resizing die." Dies can be used to shape projectile casings (e.g., form brass cases). Dies can be used to reshape already fired projectile casings or projectile casings that are "fresh" (e.g., never been fired). Dies can also be used to confirm the shape of projectile casings used to perform precision marksmanship or fix anomalous projectile casings from a manufacturer. As an example, if a projectile casing from a manufacturer is too narrow, the projectile casing may be widened using one or more dies, progressively expanding the projectile casing by repeating a process with subsequent greater in diameter dies. Dies can be composed on multiple parts (e.g., a two piece die with multiple sets). Dies can correct, modify, or otherwise change length, size, and shaping of bullet projectile casings that have already been fired or have never been fired (e.g., produced by a manufacturer but not used yet). Dies can be composed of metal (e.g., steel), carbide, plastics, or a combination thereof.

System 1200 may include a means for expelling a primer (e.g., primer extraction rod) and/or catching an expelled (e.g., extracted) primer, such as by an expelled primer chute and expelled primer catch. Rotation component 1120A at projectile casing placement component 1102 may otherwise rotate into another functional component of a device, such as to primer seating component 1104, projectile casing extractor 1106, staging, or other functional additions to the device (e.g., projectile casing shaping and/or primer seating).

Figure 13A:
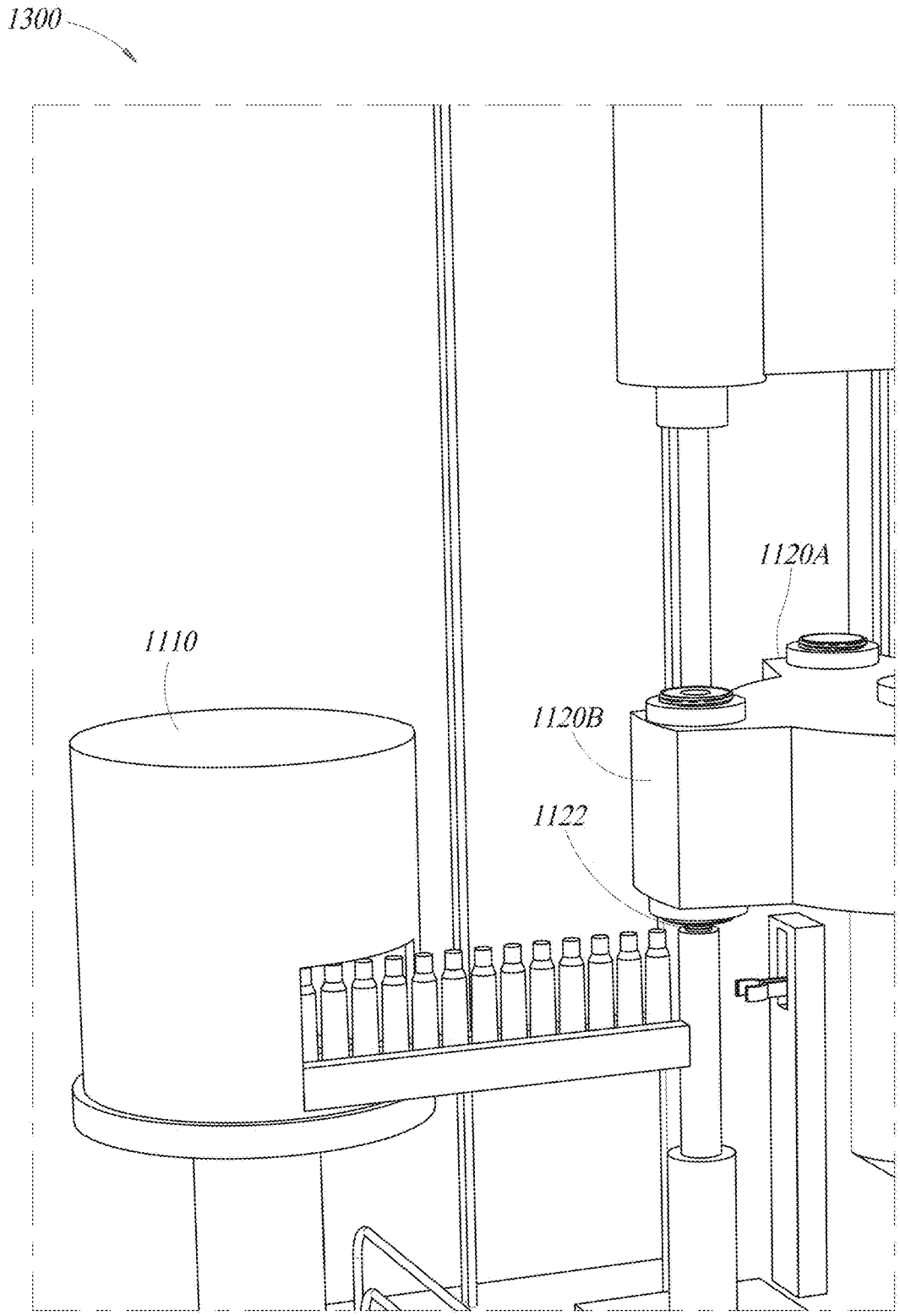
FIG. 13A illustrates a schematic view of a system to automatically insert a primer in a projectile casing, in accordance with at least one embodiment.
Figure 13B:
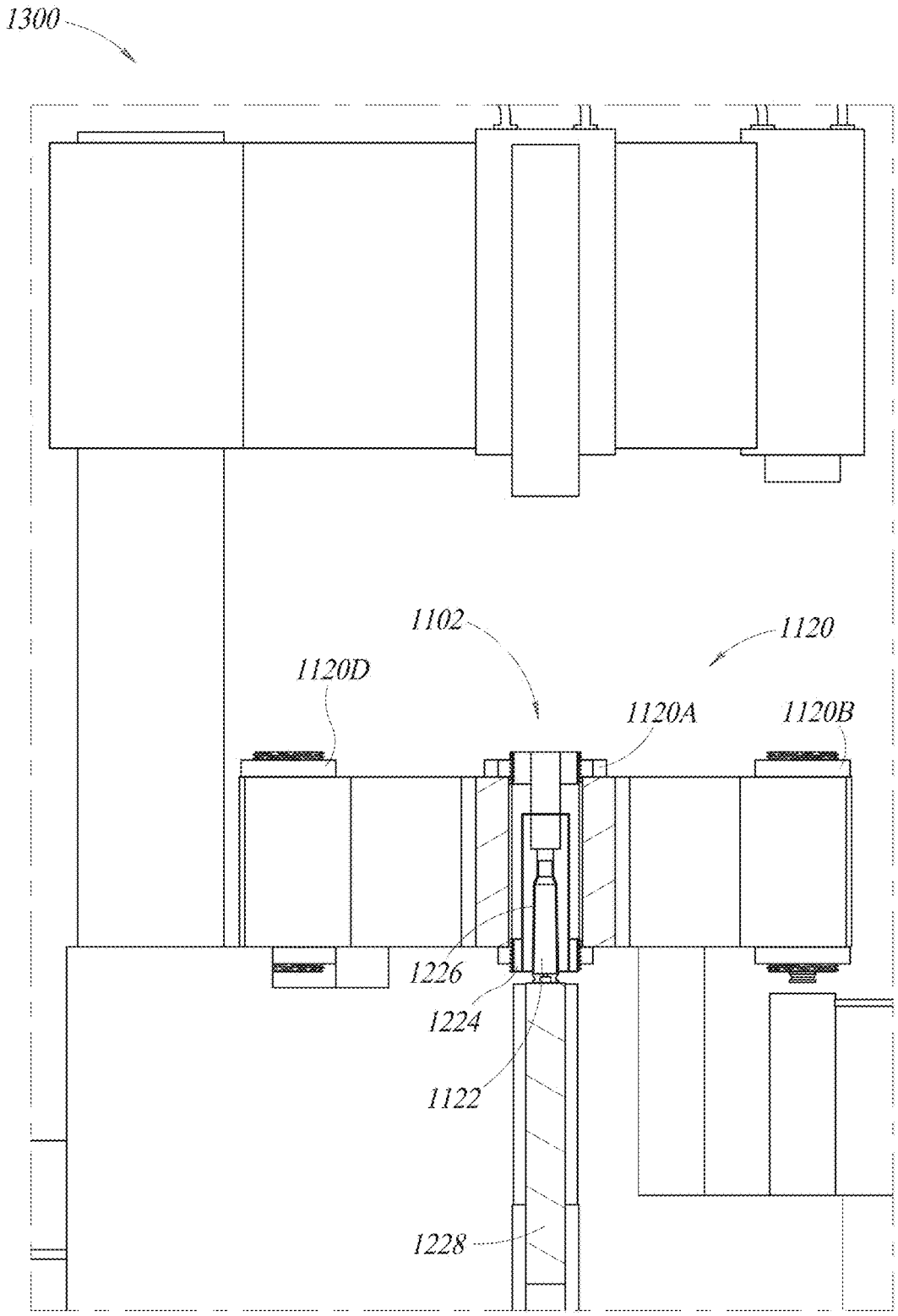
FIG. 13B illustrates a cross-sectional view of a system to automatically insert a primer in a projectile casing, in accordance with at least one embodiment.

FIGS. 13A and 13B illustrate a schematic and cross-sectional view diagram of a system 1300 inserting a projectile casing, in accordance with at least one embodiment. In at least one embodiment, system 1300 includes projectile casing conveyer 1110, projectile casing 1122, projectile casing rotator 1120, one or more rotation components 1120A-120D, projectile casing placement component 1102, projectile casing recess 1226, projectile casing component fastener 1224, projectile casing placement rod 1228, and/or combinations thereof.

FIG. 13A illustrates a schematic diagram of a system 1300 inserting a projectile casing. FIG. 13B illustrates a cross-sectional view diagram of a system 1300 removing a primer from a projectile casing. Projectile casing placement rod 1228 (e.g., base) positions projectile casing 1122 towards rotation component 1120A. Projectile casing 1122 may be positioned into and/or modified by shape of the projectile casing recess 1226, such as by using one or more dies. Projectile casing component fastener 1224 may include a component designed to receive a type of projectile casing (e.g., caliber of projectile casing) and be interchangeable with a second component designed to receive a second type of projectile casing. As an example, projectile casing component fastener 1224 may be unfastened to remove component 1120A and replaced with a second component (e.g., component designed for a second type of projectile casing).

FIGS. 14A-14F illustrate schematic and cross-sectional views of a system 1400 to seat a primer in a projectile casing using depth measured from a projectile casing base, in accordance with at least one embodiment. In at least one embodiment, system 1400 includes projectile casing rotator 1120, one or more rotation components 1120A-D, projectile casing placement component 1102, primer seating component 1104, primer queue (e.g., staging) component 1108, projectile casing 1122, projectile casing component fastener 1224, outer cylinder 1430, one or more prongs 220, inner cylinder 1432, channel 1434, stopping mechanism 1436, and/or combinations thereof.

Figure 14A:
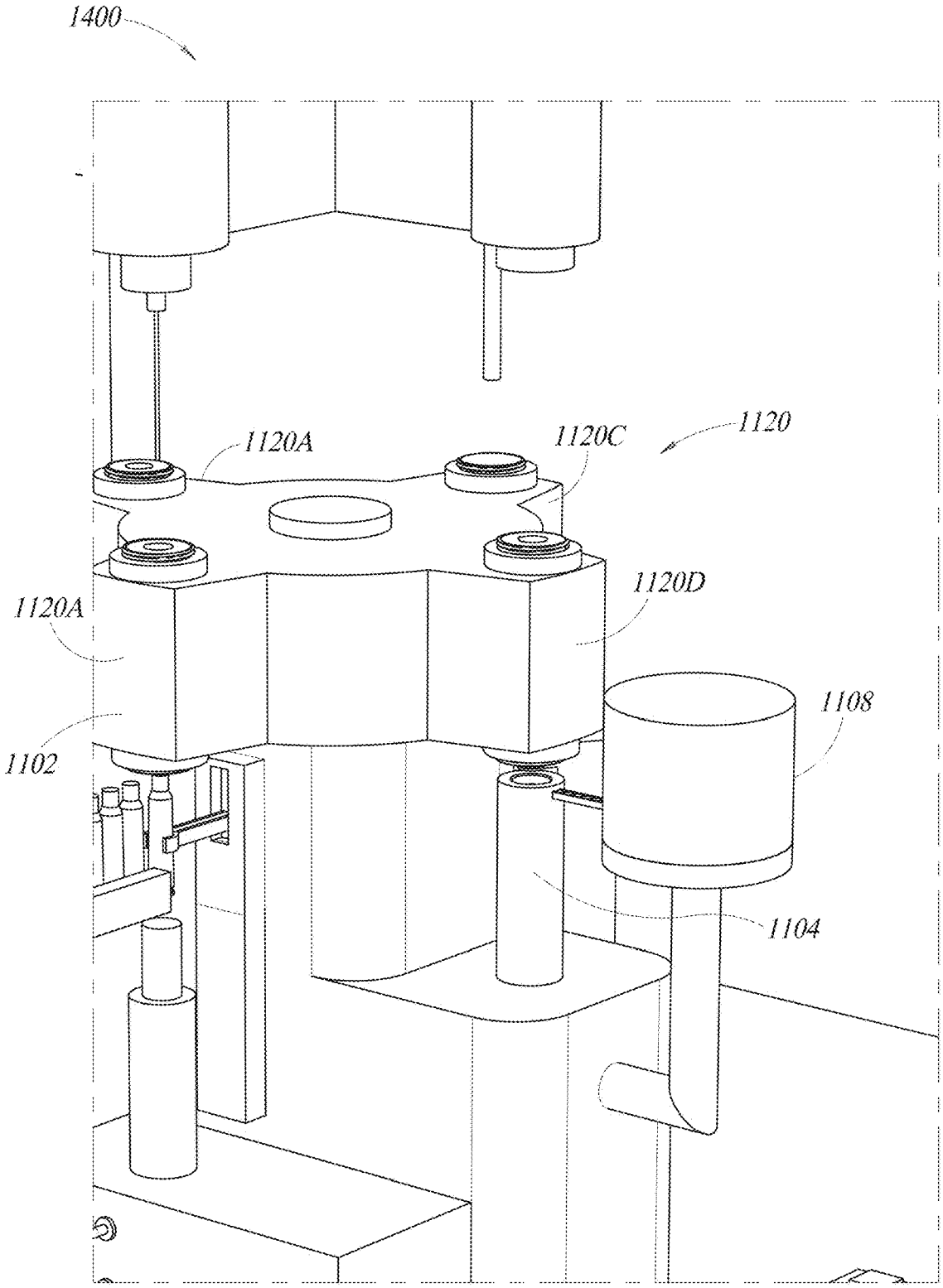
FIGS. 14A-14F illustrate views of a system to seat a primer in a projectile casing using depth indexed from a projectile casing base, in accordance with at least one embodiment.
Figure 14B:
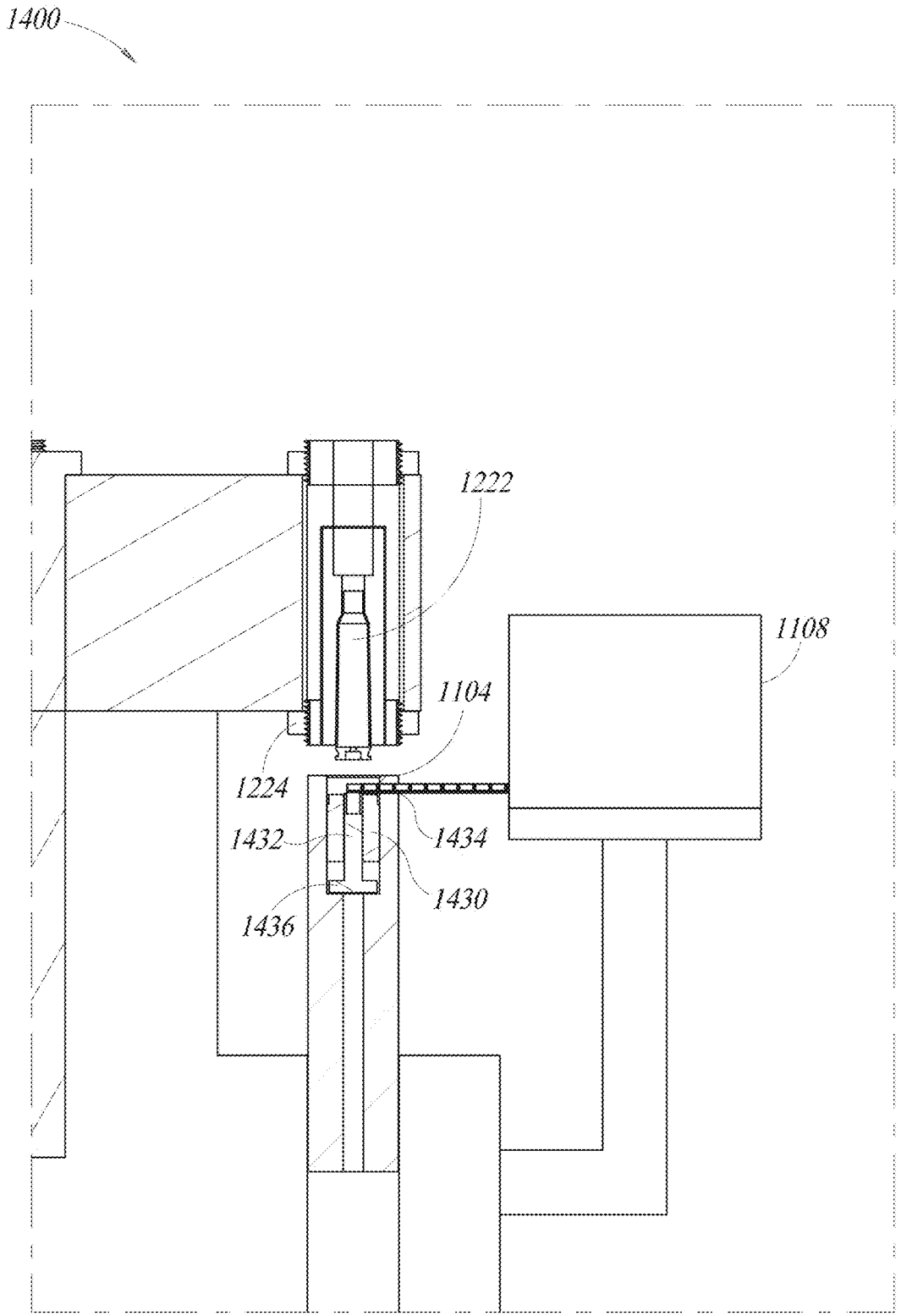

FIGS. 14A and 14B illustrate a schematic and cross-sectional view diagram of a system 1400 to seat a primer, inserting primer in primer seating component. Rotation component 1120B may include a projectile casing, such as a projectile casing 1122 previously inserted into system 1400 at projectile casing placement component 1102.

Rotation components 1120A-D may otherwise be replaceable with different size components, such that system 1400 may change a type of projectile casing to be received. Primer seating component 1104 may seat a primer in a projectile casing 1122 based, at least in part, on depth measured from a projectile casing's bottom (e.g., base, primer-pocket-end, and/or otherwise opposite of projectile casing neck). As an example, primer may be positioned, using primer queue component 1108, on an inner cylinder 1432. Inner cylinder 1432 may be lowered such that a primer may be received. Outer cylinder 1430 may include a channel 1434 with which primers can be centered over an inner cylinder 1432 when inner cylinder 1432 is in a first (e.g., lowered) position. Primer seating component 1104 may seat a primer in a projectile casing 1122, such as when invoked by one or more users and/or controls 1112.

Figure 14C:
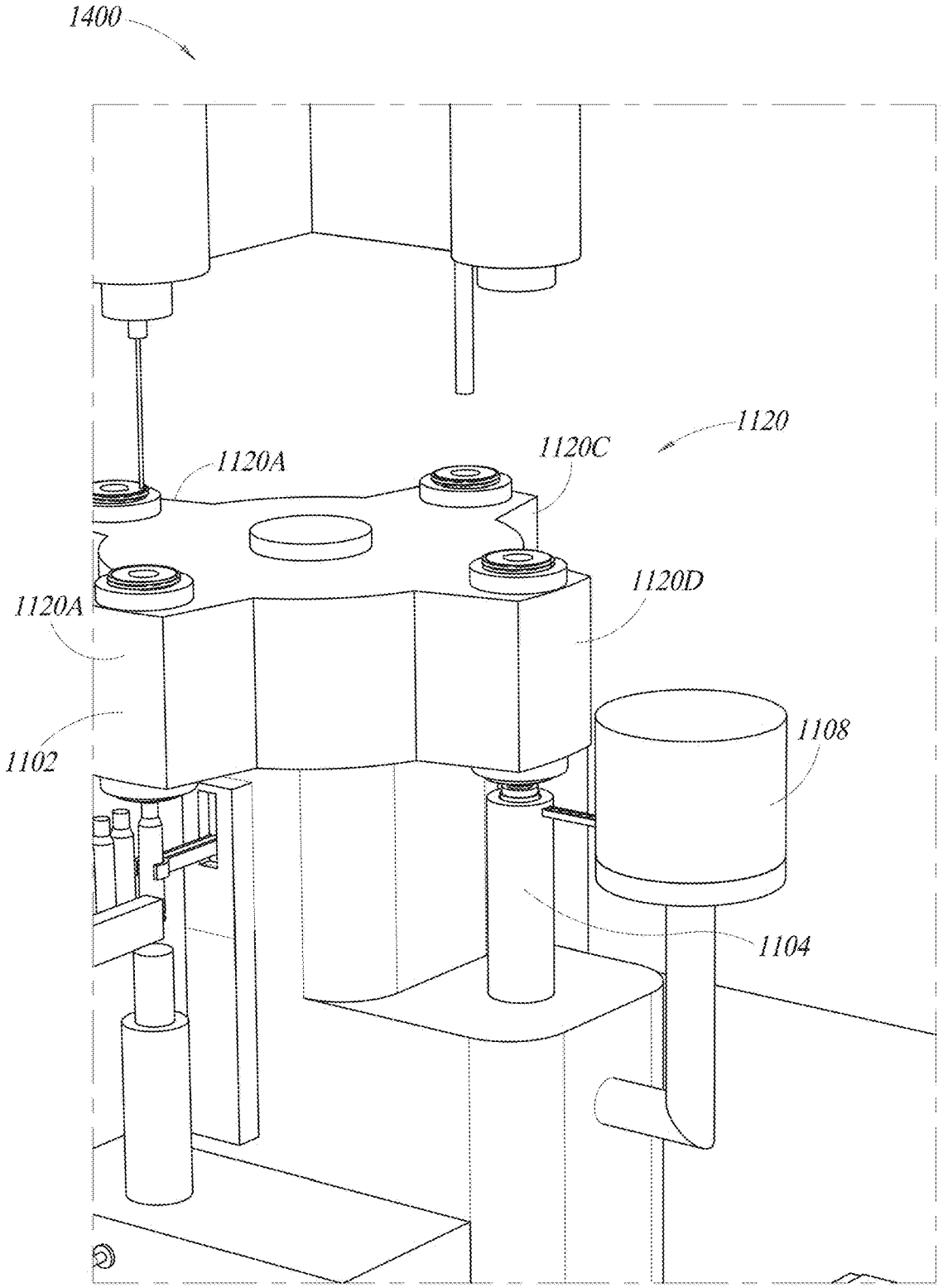
Figure 14D:
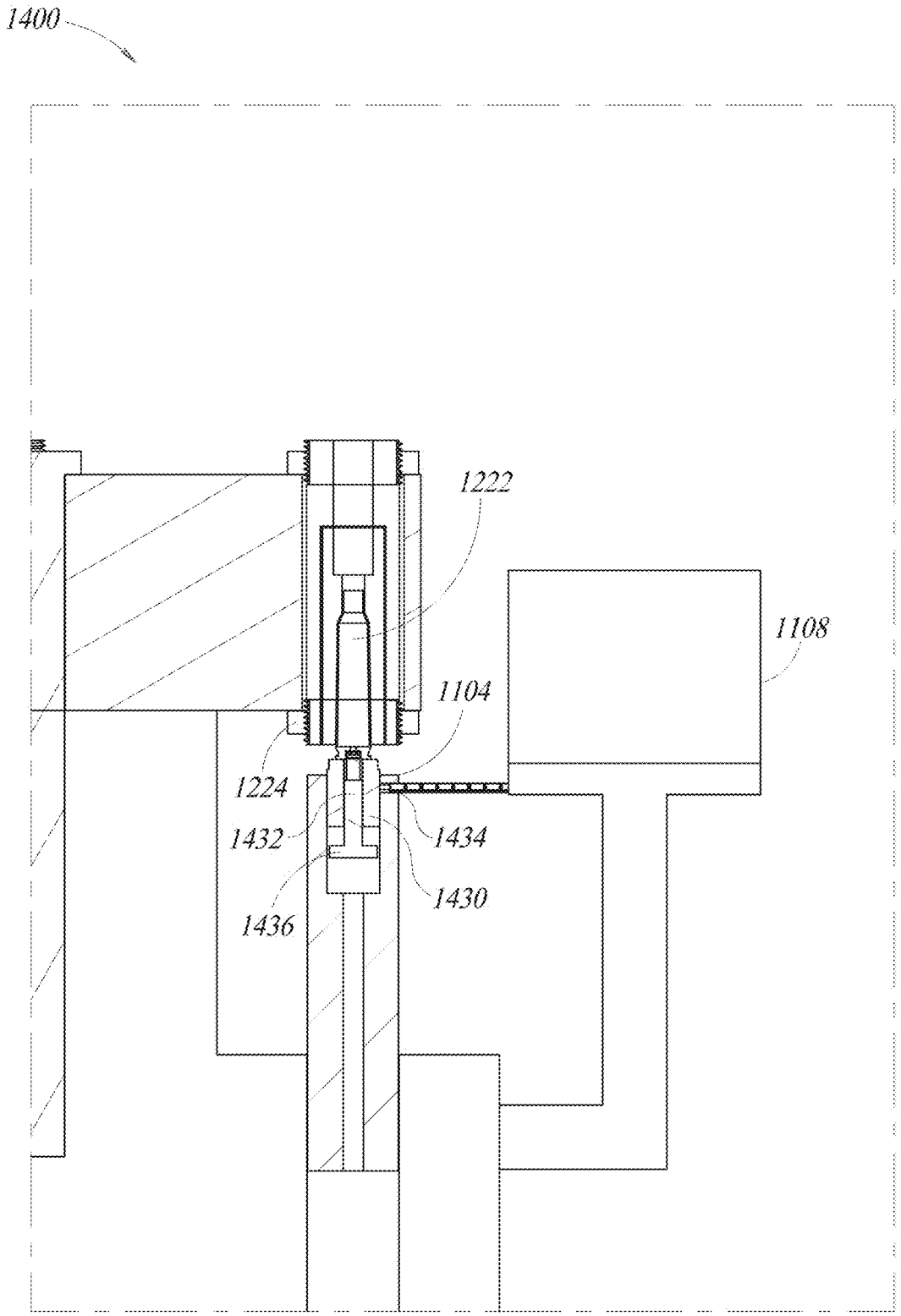

FIGS. 14C and 14D illustrate a schematic and cross-sectional view diagram of a system 1400 to seat a primer in primer pocket of a projectile casing. As an example, a primer seating component 1104 is moved (e.g., raised) from a first (e.g., lowered) position to a second (e.g., higher) position. A primer seating component 1102, when raised towards a projectile casing 1122, includes an outer cylinder 1430 which is raised until it contacts a projectile casing 1122. Inner cylinder 1432 inserts primer into projectile casing 1122 until it is stopped via stopping mechanism 1436. Primer seating component 1104, stopping mechanism 1436, inner cylinder 1432, one or more prongs 220, and/or outer cylinder 1434 are otherwise illustrated in FIGS. 1A-9L.

Figure 14E:
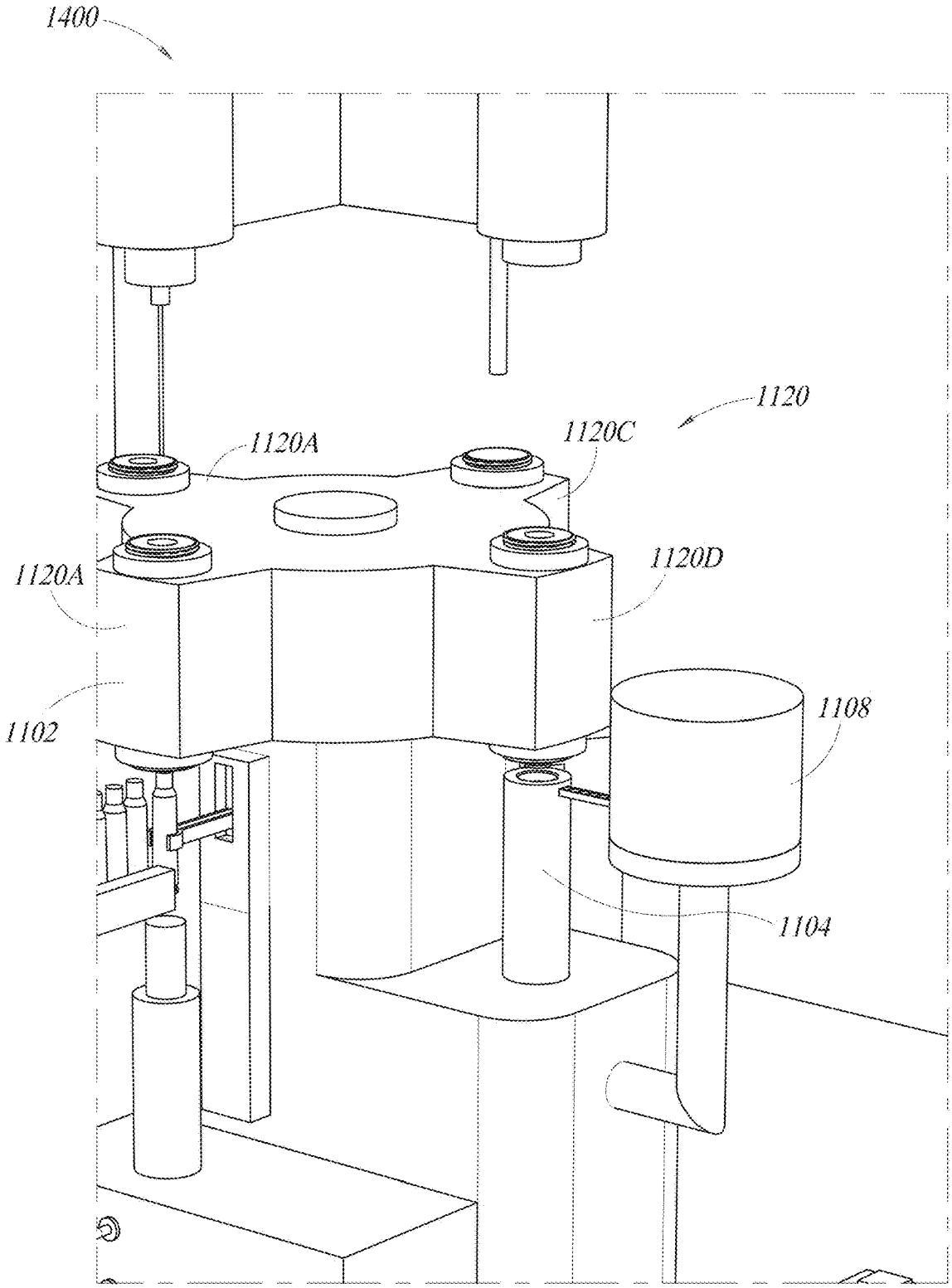
Figure 14F:
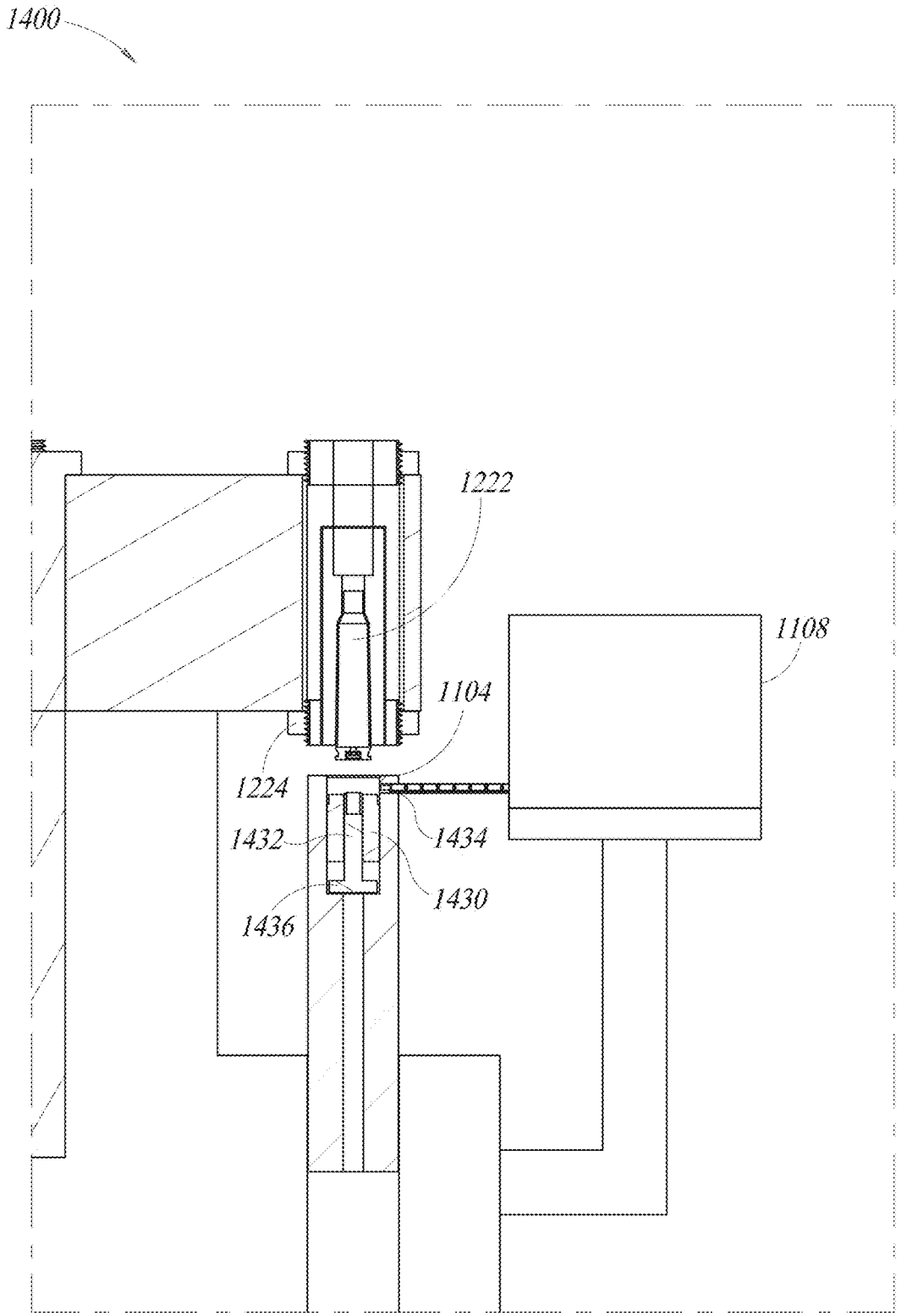

FIGS. 14E and 14F illustrate a schematic and cross-sectional view diagram of a system 1400 to seat a primer, extracting primer seating component 1104 from projectile from projectile casing 1222. As an example, a primer seating component 1104 is moved (e.g., lowered) from a second (e.g., higher) position to return to the first (e.g., lowered) position. As another example, a primer seating component 1104 is moved (e.g., lowered) from a second (e.g., higher) position to a third position that is lower than the second position, extracting primer seating component 1104. Primer is seated in projectile casing 1222, using one or more anvils of the primer, at a depth measured from the bottom of a projectile casing. Inner cylinder 1432 may have lowered further than an outer cylinder 1430 or the position of inner cylinder 1432 relative to outer cylinder 1430 is retained. In at least one embodiment, system 1400 includes one or more prongs 220 used to index seating a primer from a casing base.

Figure 15A:
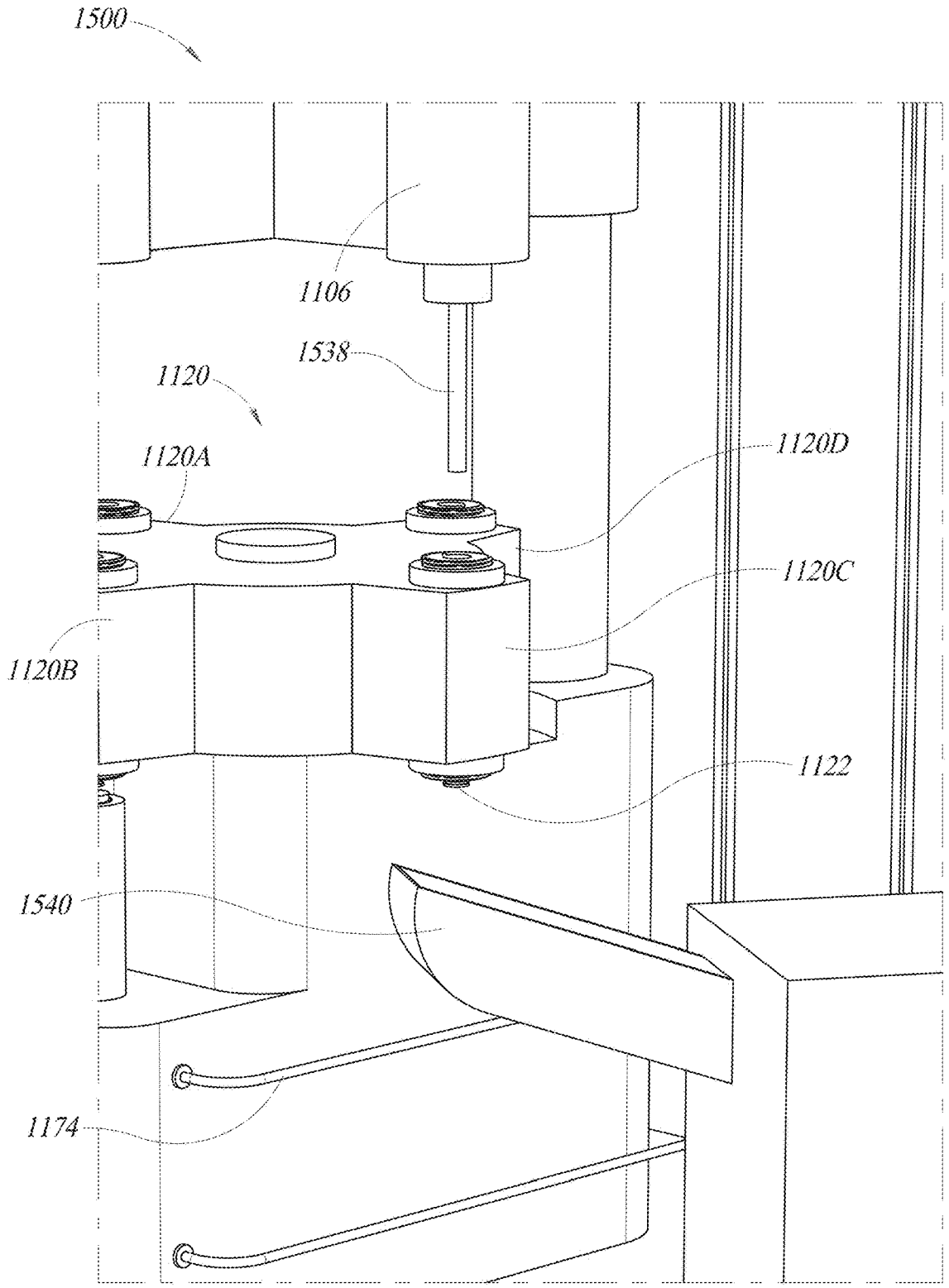
FIGS. 15A-15C illustrate schematic and cross-sectional views of a system to remove a projectile casing with primer seated using a length corresponding to a distance from a projectile casing base, in accordance with at least one embodiment.
Figure 15B:
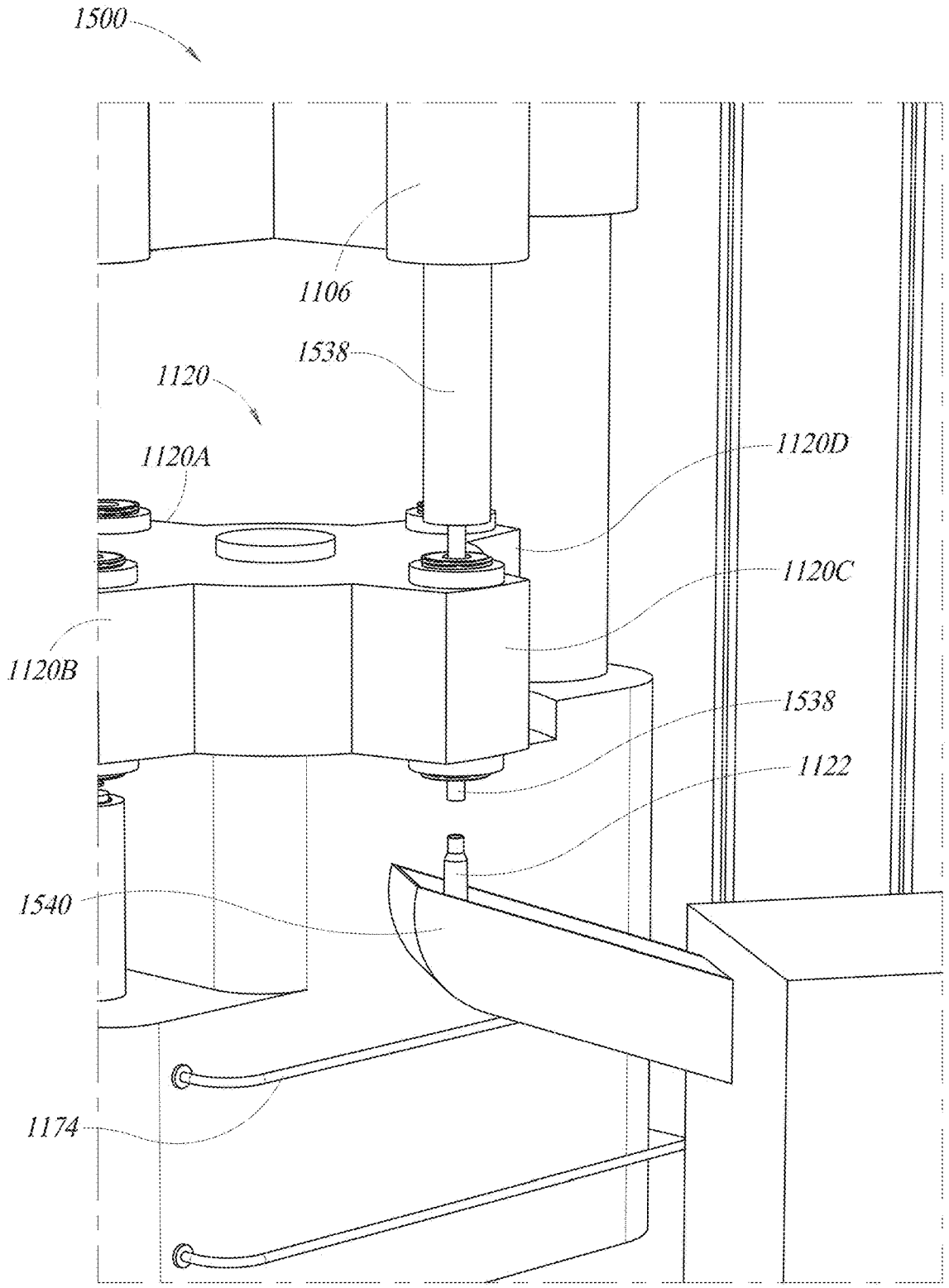
Figure 15C:
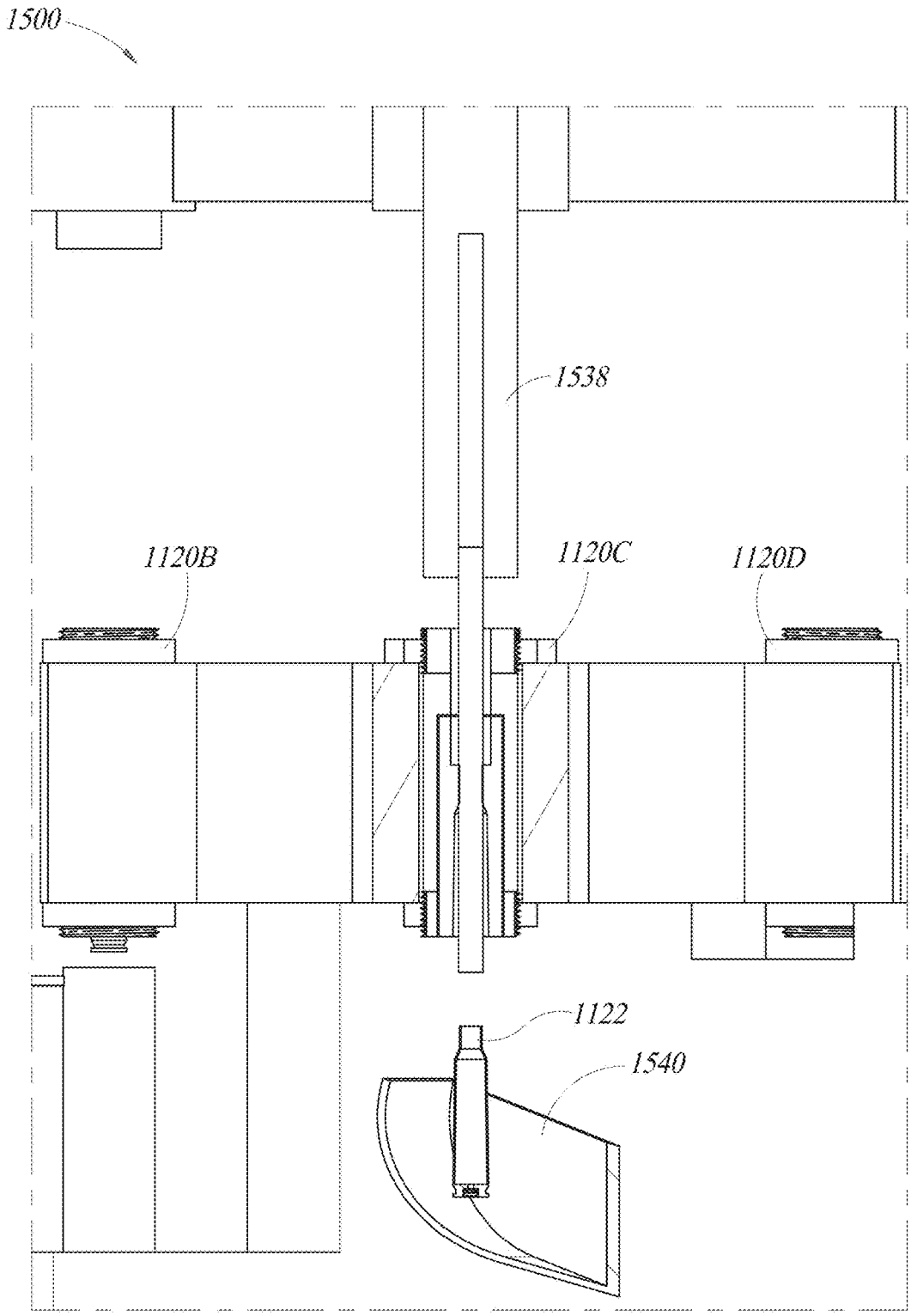

FIGS. 15A-15C illustrate schematic diagrams and a cross-sectional view of a system 1500 to remove a cleaned and/or modified projectile casing, in accordance with at least one embodiment. In at least one embodiment, system 1500 includes projectile casing extractor 1106, projectile casing rotator 1120, projectile casing 1122, components 1120A-D, hydraulics 1174, projectile casing extraction rod 1538, projectile casing catch 1540, and/or combinations thereof.

FIG. 15A illustrates a schematic diagram view of a system to remove a projectile casing 1122 with seated primer. In at least one embodiment, projectile casing 1122 is in rotation component 1120C with projectile casing extraction rod 1538 in line with neck of projectile casing 1122, such as to enable projectile casing rod 1538 to enter centered through projectile casing 1122. As an example, projectile casing rod 1538 is of a diameter narrower than a projectile casing 1122 neck, but greater than a flashing hole in projectile casing 1122 base. Furthermore, a projectile casing catch 1540 (e.g., chute) may be below rotation component 1120C to receive an expelled projectile casing 1122 with seated primer.

FIG. 15B illustrates a schematic diagram view of a system 1500 to remove a projectile casing with primer seated (e.g., seated by measuring from bottom of projectile casing). In at least one embodiment, projectile casing 1122 is expelled from rotation component 1120C with projectile casing extraction rod 1538 having entered both projectile casing 1122 and rotation component 1120C, pushing projectile casing from component 1120C. Furthermore, a projectile casing catch 1540 may receive projectile casing 1122, directing projectile into a projectile casing bin.

FIG. 15C illustrates a cross-section diagram view of a system 1500 to remove a projectile with seated primer. In at least one embodiment, projectile casing 1122 is expelled (e.g., removed) from rotation component 1120C with projectile casing extraction rod 1538 having entered both projectile casing 1122 and projectile casing recess of rotation component 1120C, pushing projectile casing from component 1120C. Furthermore, a projectile casing catch 1540 may receive projectile casing 1122. As an example, system 1500 may repeat a process to remove a projectile casing with seated primer for one or more projectile casings. Upon projectile casing extraction (e.g., removal) at component 1120C, a component may rotate such as to a staging location (e.g., staging rotation component 1120D).

Figure 16A:
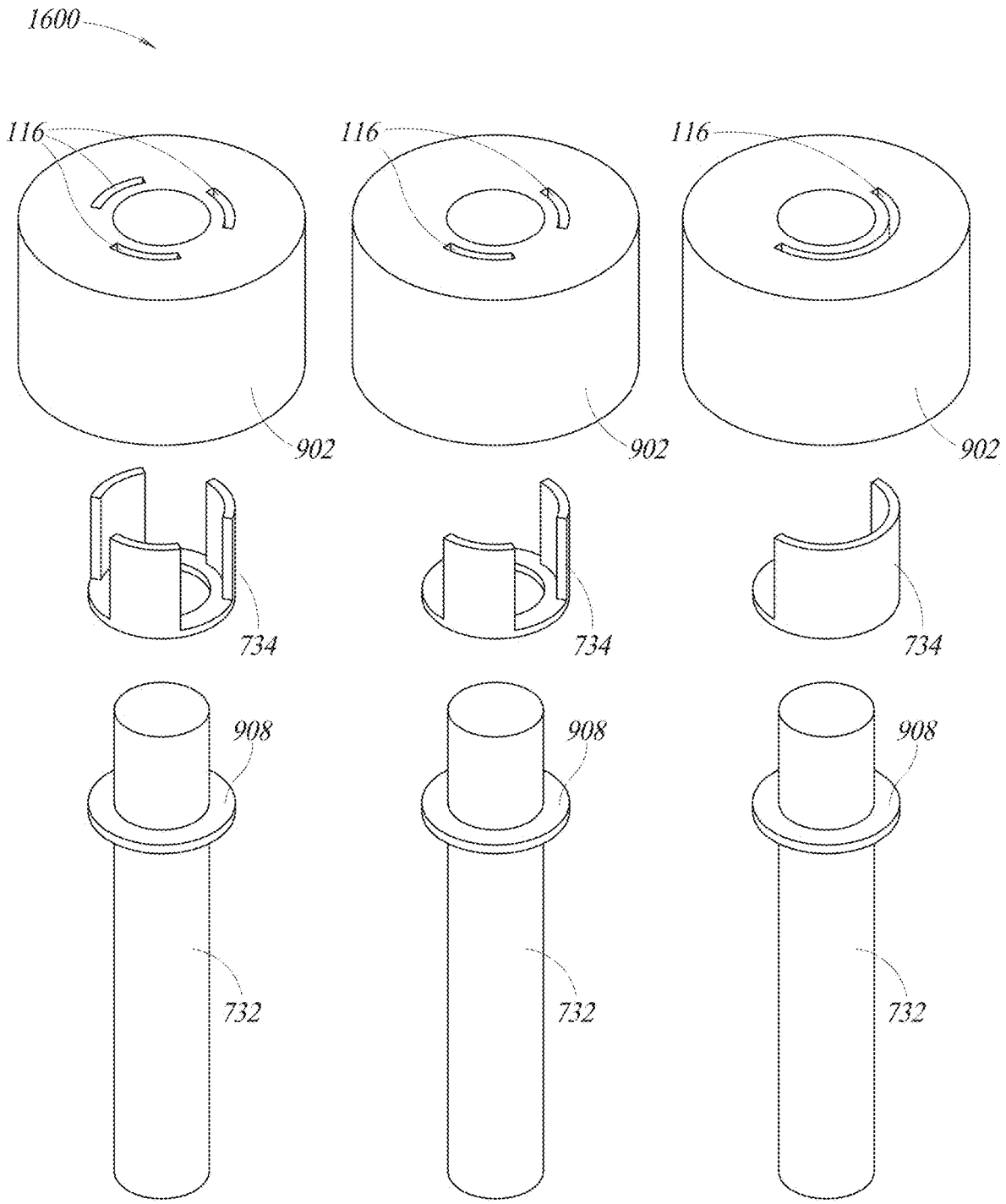
FIG. 16A illustrates a schematic view of a system to index depth of a primer from a casing using one or more prongs, in accordance with at least one embodiment.

FIG. 16A illustrates a schematic view of a system to index depth of a primer from a casing using one or more prongs, in accordance with at least one embodiment. In at least one embodiment, system 1600 is a primer seating component 110. As an example, primer seating component may include an outer cylinder 902, one or more prong holes 116, one or more prongs 734, one or more primer rods 732, a stop 908, and/or one or more components described herein. As an example, primer seating component 110 may include one, two, three, or more prongs to index seating a primer from a casing's base. As an example, an amount of prong holes 116 may correspond to an amount of prongs used and/or more than an amount of prongs used. Further, means of securing a prong (e.g., grooves and/or threading) may be included with one or more prongs 734, such as to prevent one or more prong attachments from shifting. In at least one embodiment, one or more primer rods may be interchanged within a primer seating component 110, such as to replace due to wear or to insert a primer rod of different dimensions (e.g., length).

Figure 16B:
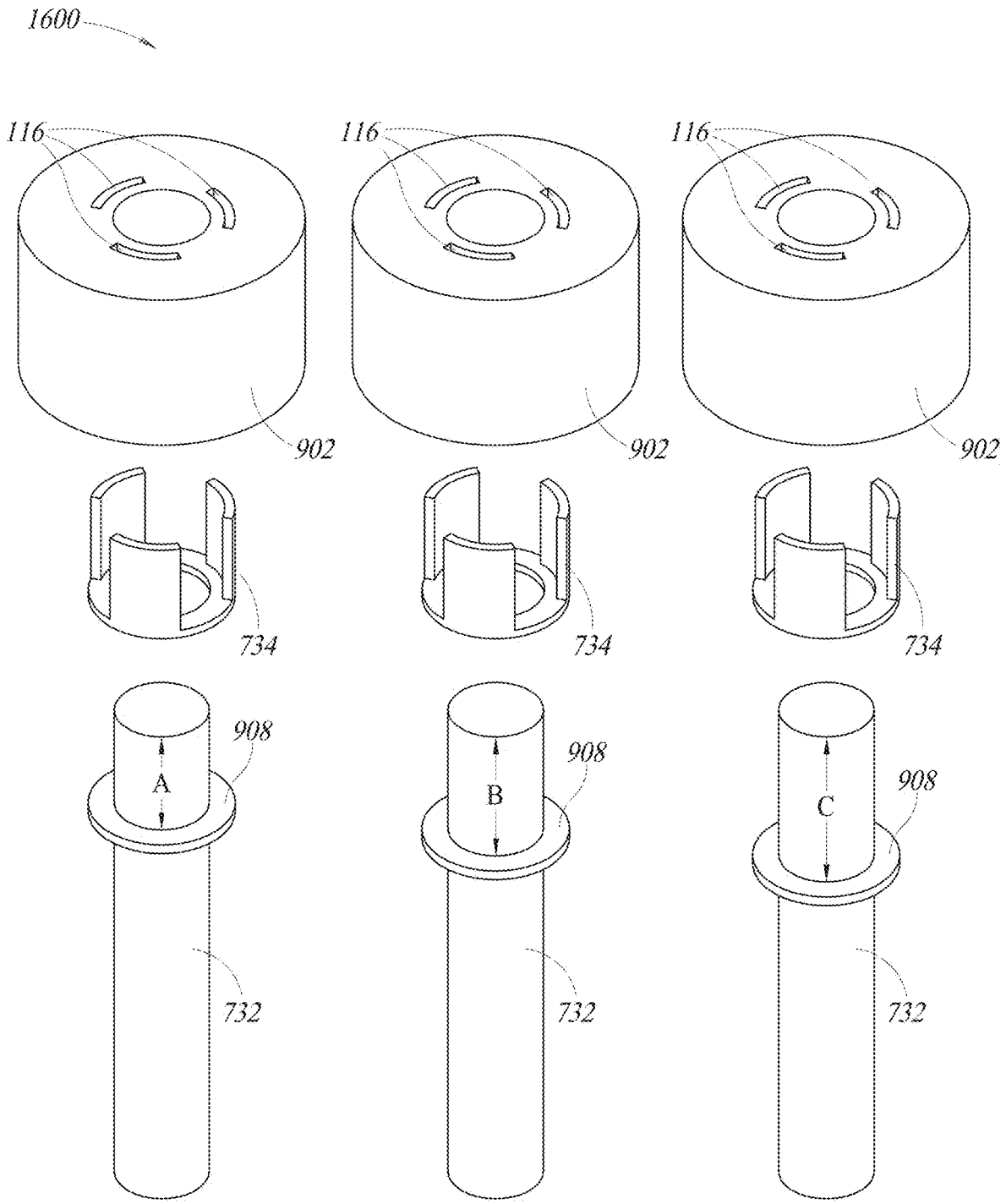
FIG. 16B illustrates a schematic view of a system to index depth of a primer from a casing based, at least in part, on a length of one or more primer rods, in accordance with at least one embodiment.

FIG. 16B illustrates a schematic view of a system to index depth of a primer from a casing based, at least in part, on a length of one or more primer rods, in accordance with at least one embodiment. In at least one embodiment, system 1600 is a primer seating component 110. As an example, primer seating component may include an outer cylinder 902, one or more prong holes 116, one or more prongs 734, one or more primer rods 732, a stop 908, and/or one or more components described herein. As an example, primer seating component 110 may include one or more primer rods of varying length, such as a length A, B, and/or C. As an example, system 1600 may include the capability of interchanging one or more primer rods of varying length, such as to adjust a depth to seat a primer. In at least one embodiment, system 1600 indexes a depth to seat a primer from a casing's base.

In at least one embodiment, system 1600 can implement, use, or otherwise execute a non-transitory computer-readable medium that stores instructions. When these instructions are executed by a computer, they perform operations similar to the method described above. The computer would control a machine that aligns the primer with the primer pocket, indexes from a depth from the base of the casing, and then presses the primer into place to a desired depth.

In at least one embodiment, system 1600 can position, locate, or otherwise move a primer into a projectile casing. For example, a system 1600 can include a primer seating component that holds the projectile casing in place. This casing has a base, a neck, and a primer pocket with a specific depth, e.g., a first depth that is measured by a marksman or provided by a manufacturer. The system also includes a primer queue component, which feeds primers into the casing and aligns them with the projectile casing. This mechanism is equipped with a blocking component to prevent the primer from being pressed too far. Additionally, a lever is attached to the positioning mechanism to move it, ensuring that the primer is pressed in place correctly. After the primer is set, a casing extractor removes the casing from the system, making it ready for the next step in the ammunition assembly process. For example, in a factory setting, this system could be part of an assembly line that prepares casings for final assembly into live ammunition, ensuring that each primer is seated perfectly to avoid misfires or other issues. As another example, a marksman can reuse bullet casings by placing primers inside the primer pocket using this disclosed technology and/or otherwise perform operations described herein. In at least one embodiment, system 1600 is, is included in, and/or otherwise includes systems illustrated in FIGS. 1A-16B to position, locate, or otherwise move a primer into a projectile casing by indexing from the base of the projectile casing and/or otherwise perform operations described herein. In at least one embodiment, system 1600 performs one or more processes illustrated in FIGS. 1A-17, such as process 1700 to position, locate, or otherwise move a primer into a projectile casing by indexing from the base of the projectile casing and/or otherwise perform operations described herein.

Figure 17:
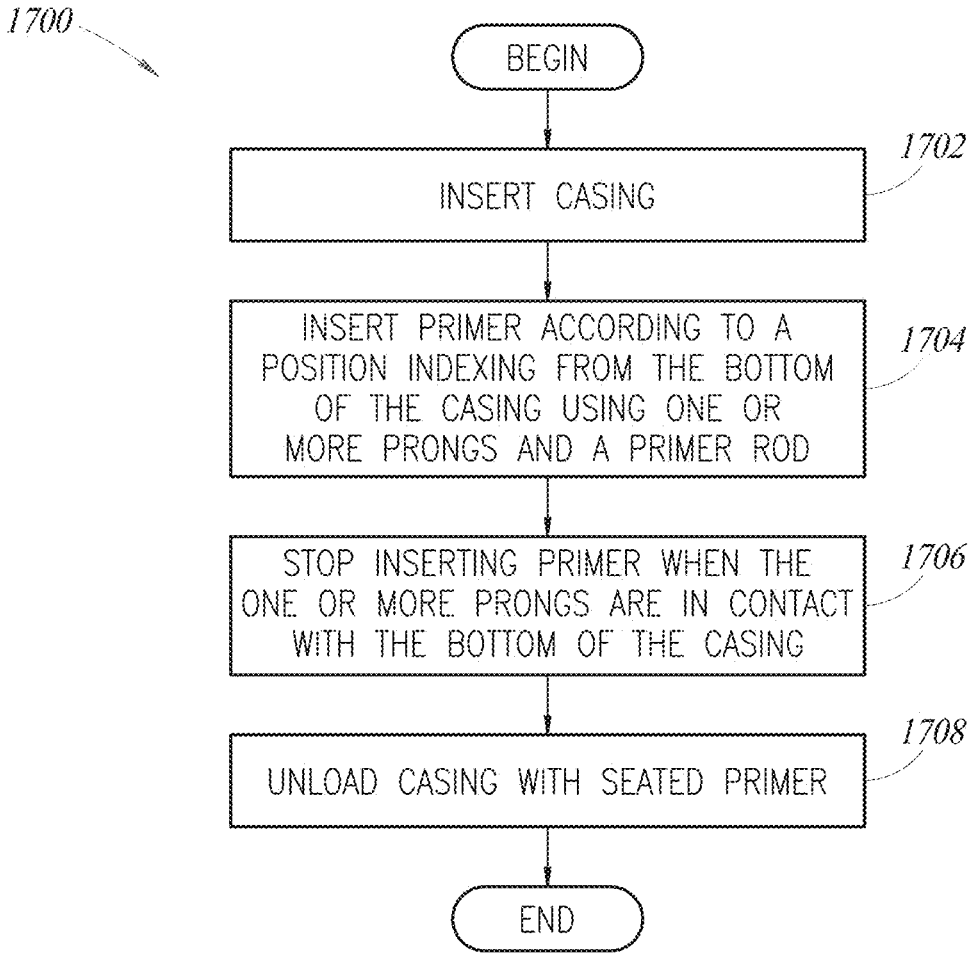
FIG. 17 illustrates a process flow diagram of indexing depth of a primer from a (e.g., base of) casing, in accordance with at least one embodiment.

FIG. 17 illustrates a process flow diagram of indexing depth of a primer from a casing, in accordance with at least one embodiment. In at least one embodiment, a processor, programmer, system 100 (from FIG. 1), or a marksman performs process 1700 that includes one or more steps to insert 1702 a casing, insert 1704 primer according to a position indexing from the bottom of the casing using one or more prongs and a primer rod, stop 1706 inserting primer when the one or more prongs are in contact with the bottom of the casing and a primer is inserted to a desired depth, unload 1708 a casing with a seated primer, perform operations described herein, and/or combinations thereof. A process 1700 may begin, such as by performing one or more steps of process 1700 and/or when invoked (e.g., initiated) by a programmer, system (e.g., illustrated in FIGS. 1A-16B), marksman, and/or user.

A system (e.g., one or more systems illustrated in FIGS. 1A-16B) performing process 1700 may insert 1702 a casing (e.g., into projectile casing using primer seating component). At insertion step 1702, system 100, 1100, or marksman may insert a projectile casing manually, automatically, using one or more devices, and/or by selecting a next projectile casing in a queue of one or more projectile casings. In at least one embodiment, a primer may be inserted into a projectile casing (e.g., in primer pocket) according to a depth indexed from a projectile casing base using one or more prongs. A process 1700 may include to insert a primer to a depth that is the difference one or more prongs and a central primer rod or central portion of a priming rod. As an example, system 1700 stops inserting primer at a depth indexed from a base of a projectile casing. A system (e.g., illustrated in FIGS. 1A-16B) performing process 1700 may stop inserting primer at a depth indexed from the base of a casing by using one or more stopping mechanisms. As an example, an inner cylinder (e.g., primer rod) is stopped 1706 from continuing to insert a primer, because stopping mechanism is located on an inner cylinder and halts inner cylinder from passing through an outer cylinder further (e.g., one or more prongs may protrude and/or be fixed to an outer cylinder). As another example, by a one or more prongs contacting a projectile casing bottom (e.g., brass at a location near primer pocket), the length the first (e.g., inner) cylinder is into primer pocket when stopped 1706 is a length indexed (e.g., corresponding) to a measurement from a projectile casing's base.

A programmer, one or more systems illustrated in FIGS. 1A-16B, a user or marksman may unload 1708 a projectile casing with a primer seated a depth indexed from a casing's base. As an example, unloading 1708 a projectile casing may include extracting, obtaining, and/or removing a projectile casing from a system. A user may unload a projectile casing from a system using projectile casing extractor 1106 and/or manually remove projectile casing, such as removing a projectile casing as illustrated in FIGS. 1A-16B. A process 1700 may include performing steps 1702, repeating one or more steps, performing one or more operations described herein, and/or proceeding to end.

In at least one embodiment, some or all of process 1700 (or any other processes described herein, or variations and/or combinations thereof) is performed under control of one or more computer systems configured with computer executable instructions and is implemented as code (e.g., computer executable instructions, one or more computer programs, or one or more applications) executing collectively on one or more processors, by hardware, software, or combinations thereof. In at least one embodiment, code is stored on a computer-readable storage medium in form of a computer program comprising a plurality of computer-readable instructions executable by one or more processors. In at least one embodiment, a computer-readable storage medium is a non-transitory computer-readable medium. In at least one embodiment, at least some computer-readable instructions usable to perform process 1700 are not stored solely using transitory signals (e.g., a propagating transient electric or electromagnetic transmission). In at least one embodiment, a non-transitory computer-readable medium does not necessarily include non-transitory data storage circuitry (e.g., buffers, caches, and queues) within transceivers of transitory signals. In at least one embodiment, process 1700 is performed at least in part on a computer system such as those described elsewhere in this disclosure. In at least one embodiment, logic (e.g., hardware, software, or a combination of hardware and software) performs process 1700.

In at least one embodiment, process 1700 includes one or more steps to index a depth to seat a primer from a projectile casing base and/or otherwise perform operations described herein. In at least one embodiment, process 1700 is, is included in, and/or otherwise includes one or more processes illustrated in FIGS. 1A-15C, such as to index a depth to seat a primer from a projectile casing base and/or otherwise perform operations described herein. In at least one embodiment, one or more systems illustrated in FIGS. 1A-15C perform process 1700, such as to index a depth to seat a primer from a projectile casing base and/or otherwise perform operations described herein.

What is claimed is:

1. A method of seating a primer in a primer pocket of a projectile casing, the method comprising:

providing a primer rod comprising a central portion extending in a longitudinal direction and an outer portion comprising a plurality of prongs surrounding the central portion, wherein the central portion extends farther in the longitudinal direction than the plurality of prongs;

providing a projectile casing including a base and a primer pocket with a first depth;

aligning a primer with the primer pocket of the projectile casing;

inserting the primer into the primer pocket by moving the central portion of the primer rod in the longitudinal direction toward the base of the projectile casing; and stopping movement of the central portion in response to the plurality of prongs at least partially contacting the base of the projectile casing, thereby seating the primer in the primer pocket to a second depth indexed from the base of the projectile casing.

2. The method of claim 1, wherein the plurality of prongs is fixed to a base portion of the primer rod and the central portion is slidable relative to the plurality of prongs.

3. The method of claim 1, wherein the primer rod is removable from the plurality of prongs and replaceable with another primer rod having a different length to modify the second depth.

4. The method of claim 1, wherein contacting the plurality of prongs with the base of the projectile casing causes the primer to be pressed into the primer pocket such that the primer is crushed by a predetermined amount, the predetermined amount of crush corresponding to a seating depth indexed from the base of the projectile casing corresponding to a longitudinal height difference between the plurality of prongs and the central portion.

5. The method of claim 1, wherein the central portion and the plurality of prongs is physically coupled to each other.

6. The method of claim 1, wherein moving the primer rod and the plurality of prongs include using a spring component.

7. The method of claim 1, the method further comprises:

after the primer has been inserted into the primer pocket, moving the projectile casing including the primer to a storage area.

8. The method of claim 1, wherein the plurality of prongs surround the central portion in an asymmetrical pattern.

9. The method of claim 1, wherein the plurality of prongs include a curved portion.

10. The method of claim 1, wherein the second depth is adjustable using a threaded stop, dial, or other mechanical adjustment component coupled to the primer rod.

11. The method of claim 1, further comprising:

securing the projectile casing in a casing holder such that the base of the projectile casing remains in a fixed reference plane during primer insertion.

12. The method of claim 1, wherein the primer rod and the plurality of prongs form a single component and the plurality of prongs are fixed in place relative to the central portion of the primer rod.

13. The method of claim 1, wherein the prongs surround the central portion in a symmetrical pattern.

14. The method of claim 1, further comprising:

removing the projectile casing after the primer is seated to the second depth.

15. The method of claim 1, wherein a difference in length between the central portion and the plurality of prongs corresponds to a predetermined primer seating depth within a tolerance range, wherein aligning the primer with the primer pocket of the projectile casing comprises:

sliding a shuttle containing the primer into a position below the primer pocket, wherein the shuttle includes beveled edges to prevent the primer from falling, and wherein the shuttle includes one or more slots through which the plurality of prongs extend to contact the projectile casing.

16. The method of claim 1, wherein the second depth is between 0.003 inches and 0.007 inches below the base of the projectile casing.

17. A system for seating a primer in a primer pocket of a projectile casing, the system comprising:

a primer seating component to receive the projectile casing and to hold the projectile casing when a primer is inserted into a primer pocket of the projectile casing;

a primer rod comprising a central portion extending along a longitudinal axis and an outer portion comprising at least one prong proximate to the central portion, wherein the central portion extends farther in a longitudinal direction than the at least one prong; and an actuator operatively coupled to the primer rod and to move the primer rod along the longitudinal axis to insert the primer into the primer pocket, and wherein the at least one prong is to contact a base of the projectile casing and prevent further advancement of the central portion, such that a depth at which the primer is seated in the primer pocket is indexed from the base of the projectile casing.

18. The system of claim 17, wherein the actuator comprises a lever, press, or cam-driven mechanism configured to advance the primer rod.

19. The system of claim 17, wherein the primer rod is removably coupled to the actuator to allow replacement with another primer rod of a different length.

20. The system of claim 17, further comprising an adjustment mechanism to modify the longitudinal extension of the central portion relative to the at least one prong.

21. The system of claim 17, wherein the primer seating component includes a casing holder to hold the projectile casing such that the base remains fixed during primer insertion, wherein the primer seating component includes slots to receive the at least one prong.

22. The system of claim 17, wherein the at least one prong is integrally formed with the primer rod as a unitary structure, and wherein the at least one prong is in a static position relative to the central portion of the primer rod.

23. The system of claim 17, wherein the at least one prong is deposed around the central portion.

24. The system of claim 17, wherein the depth at which the primer is seated corresponds to a predetermined amount of primer crush.

25. The system of claim 17, further comprising a shuttle including slots to receive the at least one prong and central portion to align a primer with the primer pocket prior to insertion.

26. A primer rod for inserting a primer into a primer pocket of a projectile casing, the projectile casing having a base and the primer pocket having a first width, the primer rod comprising:

a central rod portion extending along a longitudinal axis and configured to contact and press the primer into the primer pocket; and at least one prong positioned adjacent to the central rod portion and extending along the longitudinal axis, wherein the central rod portion extends farther than the at least one prong in a longitudinal direction such that a distal tip of the central rod portion protrudes beyond a distal tip of the at least one prong, and wherein the at least one prong is laterally spaced from the central rod portion such that a width spanned by the at least one prong exceeds the first width of the primer pocket, such that contact between the at least one prong and the base of the projectile casing prevents further advancement of the central rod portion during primer insertion.

27. The primer rod of claim 26, wherein the at least one prong includes at least one of the following: a straight edge, a curved edge, and a jagged edge.

28. The primer rod of claim 26, wherein a number of prongs is two, and the prongs are positioned on opposite sides of the central rod portion.

29. The primer rod of claim 26, wherein a number of prongs is three or more and the prongs are circumferentially spaced around the central rod portion.

30. The primer rod of claim 26, wherein the central rod portion extends between 0.003 inches and 0.007 inches farther in a longitudinal direction than a distal tip of the at least one prong.

* * * * *